US009734757B2

(12) United States Patent
Takahara

(10) Patent No.: US 9,734,757 B2
(45) **Date of Patent: *Aug. 15, 2017**

(54) GATE DRIVER INTEGRATED CIRCUIT, AND IMAGE DISPLAY APPARATUS INCLUDING THE SAME

(71) Applicant: JOLED INC., Tokyo (JP)

(72) Inventor: Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 183 days.

This patent is subject to a terminal disclaimer.

(21) Appl. No.: 14/435,189

(22) PCT Filed: Oct. 8, 2013

(86) PCT No.: PCT/JP2013/005984

§ 371 (c)(1),
(2) Date: Apr. 13, 2015

(87) PCT Pub. No.: WO2014/061231

PCT Pub. Date: Apr. 24, 2014

(65) Prior Publication Data

US 2015/0279272 A1 Oct. 1, 2015

(30) Foreign Application Priority Data

Oct. 17, 2012 (JP) ..... 2012-229448
Nov. 15, 2012 (JP) ..... 2012-250914

(51) Int. Cl.
*G09G 3/30* (2006.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0408* (2013.01);
(Continued)

(58) Field of Classification Search
CPC .. G09G 3/3266; G09G 3/3233; G09G 3/3258; G09G 2310/0286; G09G 2310/0281
(Continued)

(56) References Cited

U.S. PATENT DOCUMENTS 6,407,796 B2 6/2002 Tajima et al.
6,847,172 B2 1/2005 Suzuki
(Continued)

FOREIGN PATENT DOCUMENTS

JP 10-214858 8/1998
JP 2001-264731 9/2001
(Continued)

OTHER PUBLICATIONS

Office Action from United States Patent and Trademark Office (USPTO) in U.S. Appl. No. 14/433,479, dated Aug. 23, 2016.
(Continued)

*Primary Examiner* — Vijay Shankar
(74) *Attorney, Agent, or Firm* — Greenblum & Bernstein, P.L.C.

(57) ABSTRACT

An image display apparatus includes a display screen on which pixel circuits are disposed in a matrix, each of which includes an EL element, a transistor connected to a first gate signal line, a transistor connected to a second gate signal line, and a driving transistor. A second gate signal line driving unit and a first gate signal line driving unit of a first gate driving circuit apply a control voltage to the first gate signal line and the second gate signal line, respectively. The second gate signal line driving unit of a second gate driving circuit applies a control voltage to the first gate signal line. An ON voltage, a first OFF voltage, and a second OFF voltage are sequentially applied to the first gate signal line. The ON voltage and the first OFF voltage are sequentially applied to the second gate signal line.

20 Claims, 50 Drawing Sheets

(52) U.S. Cl.
CPC ..... *G09G 2300/0814* (2013.01); *G09G 2300/0819* (2013.01); *G09G 2300/0842* (2013.01); *G09G 2300/0852* (2013.01); *G09G 2300/0861* (2013.01); *G09G 2300/0866* (2013.01); *G09G 2310/0281* (2013.01); *G09G 2310/0283* (2013.01); *G09G 2310/0286* (2013.01); *G09G 2310/08* (2013.01); *G09G 2330/028* (2013.01)

(58) Field of Classification Search
USPC ..... 345/76–83, 90–100
See application file for complete search history.

(56) References Cited

U.S. PATENT DOCUMENTS

| | | | |
|---|---|---|---|
| 7,283,193 | B2 | 10/2007 | Sugimoto et al. |
| 7,599,193 | B2 | 10/2009 | Park et al. |
| 7,705,812 | B2 | 4/2010 | Yuda et al. |
| 7,830,489 | B2 | 11/2010 | Kim |
| 7,868,865 | B2 | 1/2011 | Shin et al. |
| 7,948,768 | B2 | 5/2011 | Park et al. |
| 8,130,187 | B2 | 3/2012 | Nakao et al. |
| 8,243,107 | B2 | 8/2012 | Matsui et al. |
| 8,289,350 | B2 | 10/2012 | Matsui et al. |
| 8,294,701 | B2 | 10/2012 | Matsui et al. |
| 8,547,307 | B2 | 10/2013 | Shirouzu et al. |
| 8,553,023 | B2 | 10/2013 | Yoshizaki et al. |
| 8,649,477 | B2 | 2/2014 | Matsui |
| 8,692,741 | B2 | 4/2014 | Shin |
| 8,699,656 | B2 | 4/2014 | Matsui |
| 8,890,778 | B2 | 11/2014 | Shirouzu et al. |
| 8,917,227 | B2 | 12/2014 | Osako |
| 8,933,870 | B2 | 1/2015 | Higashijima et al. |
| 9,049,784 | B2 | 6/2015 | Osako |
| 9,111,490 | B2 | 8/2015 | Ra et al. |
| 9,129,920 | B2 | 9/2015 | Masumoto et al. |
| 9,226,432 | B2 | 12/2015 | Yamakita |
| 2001/0040664 | A1 | 11/2001 | Tajima et al. |
| 2002/0180686 | A1 | 12/2002 | Yuda et al. |
| 2003/0098657 | A1 | 5/2003 | Suzuki |
| 2004/0041766 | A1 | 3/2004 | Nakao et al. |
| 2004/0061825 | A1 | 4/2004 | Sugimoto et al. |
| 2005/0121796 | A1 | 6/2005 | Park et al. |
| 2006/0001621 | A1 | 1/2006 | Ono et al. |
| 2006/0055649 | A1 | 3/2006 | Yuda et al. |
| 2006/0114196 | A1 | 6/2006 | Shin et al. |
| 2006/0233003 | A1 | 10/2006 | Iwanaga et al. |
| 2007/0063950 | A1 | 3/2007 | Shin |
| 2007/0167036 | A1 | 7/2007 | Kim |
| 2008/0048948 | A1 | 2/2008 | Koh et al. |
| 2008/0150933 | A1 | 6/2008 | Toyomura et al. |
| 2009/0073100 | A1 | 3/2009 | Kim et al. |
| 2009/0184899 | A1 | 7/2009 | Kim et al. |
| 2009/0251446 | A1 | 10/2009 | Ogawa et al. |
| 2010/0149775 | A1 | 6/2010 | Park et al. |
| 2010/0289788 | A1 | 11/2010 | Yoshizaki et al. |
| 2011/0102729 | A1 | 5/2011 | Kawamura et al. |
| 2011/0273408 | A1 | 11/2011 | Ra et al. |
| 2012/0075282 | A1 | 3/2012 | Higashijima et al. |
| 2014/0131693 | A1 | 5/2014 | Masumoto et al. |
| 2014/0160674 | A1 | 6/2014 | Yamakita |
| 2015/0116194 | A1 | 4/2015 | Matsui et al. |
| 2015/0255015 | A1 | 9/2015 | Takahara |
| 2015/0279272 | A1 | 10/2015 | Takahara |
| 2016/0163264 | A1 | 6/2016 | Nishimura et al. |
| 2016/0171933 | A1 | 6/2016 | Takahara et al. |
| 2016/0372035 | A1* | 12/2016 | Nakatani ..... G09G 3/3266 |

FOREIGN PATENT DOCUMENTS

| | | |
|---|---|---|
| JP | 2002-098939 | 4/2002 |
| JP | 2003-050402 | 2/2003 |
| JP | 2003-167269 | 6/2003 |
| JP | 2003-167551 | 6/2003 |
| JP | 2004-133428 | 4/2004 |
| JP | 2005-167238 | 6/2005 |
| JP | 2006-049514 | 2/2006 |
| JP | 2006-154822 | 6/2006 |
| JP | 2007-086728 | 4/2007 |
| JP | 2007-188078 | 7/2007 |
| JP | 2008-158378 | 7/2008 |
| JP | 2010-145893 | 7/2010 |
| JP | 2010-266715 | 11/2010 |
| JP | 2010-282060 | 12/2010 |
| JP | 2011-237763 | 11/2011 |
| JP | 2012-058748 | 3/2012 |
| JP | 2012-060514 | 3/2012 |
| JP | 2012-068592 | 4/2012 |

OTHER PUBLICATIONS

Office Action from United States Patent and Trademark Office (USPTO) in U.S. Appl. No. 14/434,851, dated Sep. 22, 2016.
U.S. Appl. No. 14/433,479 to Hiroshi Takahara, filed Apr. 3, 2015.
U.S. Appl. No. 14/434,851 to Hiroshi Takahara, filed Apr. 10, 2015.
International Search Report (ISR) in International Patent Application No. PCT/JP2013/006030, dated Jan. 7, 2014.
International Search Report (ISR) in International Patent Application No. PCT/JP2013/005966, dated Jan. 21, 2014.
International Search Report (ISR) in International Patent Application No. PCT/JP2013/005984, dated Dec. 3, 2013.
Office Action from United States Patent and Trademark Office (USPTO) in U.S. Appl. No. 14/434,851, dated Mar. 8, 2017.

* cited by examiner

FIG. 24

| a | b | Select |
|---|---|---|
| 0 | 0 | Voff |
| 0 | 1 | Vovd |
| 1 | 0 | Von |
| 1 | 1 | Von |

FIG. 27

| i | i+1 | Select |
|---|---|---|
| 0 | 0 | Voff |
| 0 | 1 | Vovd |
| 1 | 0 | Von |
| 1 | 1 | Von |

GATE DRIVER INTEGRATED CIRCUIT, AND IMAGE DISPLAY APPARATUS INCLUDING THE SAME

TECHNICAL FIELD

The present disclosure relates to an active-matrix image display apparatus including a current light-emitting element, and a gate driver integrated circuit (gate drive IC) included in the image display apparatus.

BACKGROUND ART

Recent years have seen commercialization of an image display panel including pixel circuits arranged in a matrix each of which includes an electro luminescence (EL) device, and an image display apparatus including the image display panel. The EL element emits light upon application of a current to a light emitting layer disposed between an anode electrode and a cathode electrode.

Each of the pixel circuits includes transistors. Furthermore, the image display panel includes gate signal lines of different kinds for controlling the transistors in the pixel circuit. These gate signal lines can be divided into ones with high load capacity and ones with relatively low load capacity. Furthermore, a slew rate required of a control signal to be applied to each of the gate signal lines differs. For example, while the gate signal lines through which an image signal voltage is supplied to the pixel circuit require a high slew rate, the gate signal lines that control a current to be supplied to the EL elements have no problem with a relatively low slew rate.

For example, PTL 1 discloses, as a method of driving a gate signal line with high load capacity at a high slew rate, forming, in a scanning period for controlling a switching element, a driving waveform including a driving waveform portion for turning ON or OFF the switching element, followed by a maintained waveform portion for maintaining the ON or OFF state of the switching element. Furthermore, PTL 2 discloses an image display apparatus that applies voltages with the same driving waveform from both ends of one gate signal line, that is, an image display apparatus that performs so-called bilateral driving.

CITATION LIST

Patent Literature

[PTL 1] Japanese Unexamined Patent Application Publication No. 2001-264731

[PTL 2] Japanese Unexamined Patent Application Publication No. 2012-068592

SUMMARY OF INVENTION

Technical Problem

The present disclosure provides an image display apparatus including a gate driver integrated circuit (gate drive IC) which is highly versatile and can be used irrespective of the number of the gate signal lines which should be driven at high speed and the number of the gate signal lines to which the bilateral driving should be applied or the arrangement of the gate signal lines.

Solution to Problem

An image display apparatus according to an aspect of the present disclosure includes: a display screen which includes pixels arranged in a matrix, each of the pixels including a light-emitting element, a first switching transistor, a second switching transistor, and a driving transistor that supplies a current to the light-emitting element; a first gate signal line disposed for each of rows of the pixels and connected to the first switching transistor; a second gate signal line disposed for each of the rows of the pixels and connected to the second switching transistor; a source signal line disposed for each of columns of the pixels; a gate driver circuit which applies a control voltage to the first gate signal line and the second gate signal line; and a source driver circuit which supplies a video signal to the source signal line, wherein the gate driver circuit supplies a first control voltage to the first gate signal line, and supplies a second control voltage to the second gate signal line, the first control voltage being one of an ON voltage, a first OFF voltage, and a second OFF voltage, the second control voltage being one of the ON voltage and the first OFF voltage.

In addition, a gate driver integrated circuit (gate drive IC) according to an aspect of the present disclosure includes: a plurality of gate signal line driving circuits each having a shift register circuit and an output circuit; an ON voltage input terminal to which an ON voltage is applied; a first OFF voltage input terminal to which a first OFF voltage is applied; a second OFF voltage input terminal to which a second OFF voltage is applied; and an operation mode setting terminal, wherein the gate driver integrated circuit has: a first operation mode in which a scanning signal including the ON voltage and the first OFF voltage is supplied; and a second operation mode in which a scanning signal including the ON voltage, the first OFF voltage, and the second OFF voltage is supplied, and selects one of the first operation mode and the second operation mode based on a signal applied to the operation mode setting terminal. The gate driver integrated circuit according to an aspect of the present disclosure is used mainly as a driving IC for the gate signal lines in the image display apparatus according to the present invention.

Advantageous Effects of Invention

According to the present disclosure, it is possible to provide an image display apparatus including a gate driver integrated circuit which is highly versatile and can be used irrespective of the number of the gate signal lines which should be driven at high speed and the number of the gate signal lines to which the bilateral driving should be applied or the arrangement of the gate signal lines.

BRIEF DESCRIPTION OF DRAWINGS

FIG. 24 is a diagram illustrating a first example of a voltage selected by a selecting circuit.

FIG. 27 is a diagram illustrating a second example of a voltage selected by the selecting circuit.

DESCRIPTION OF EMBODIMENTS

Figure 1:
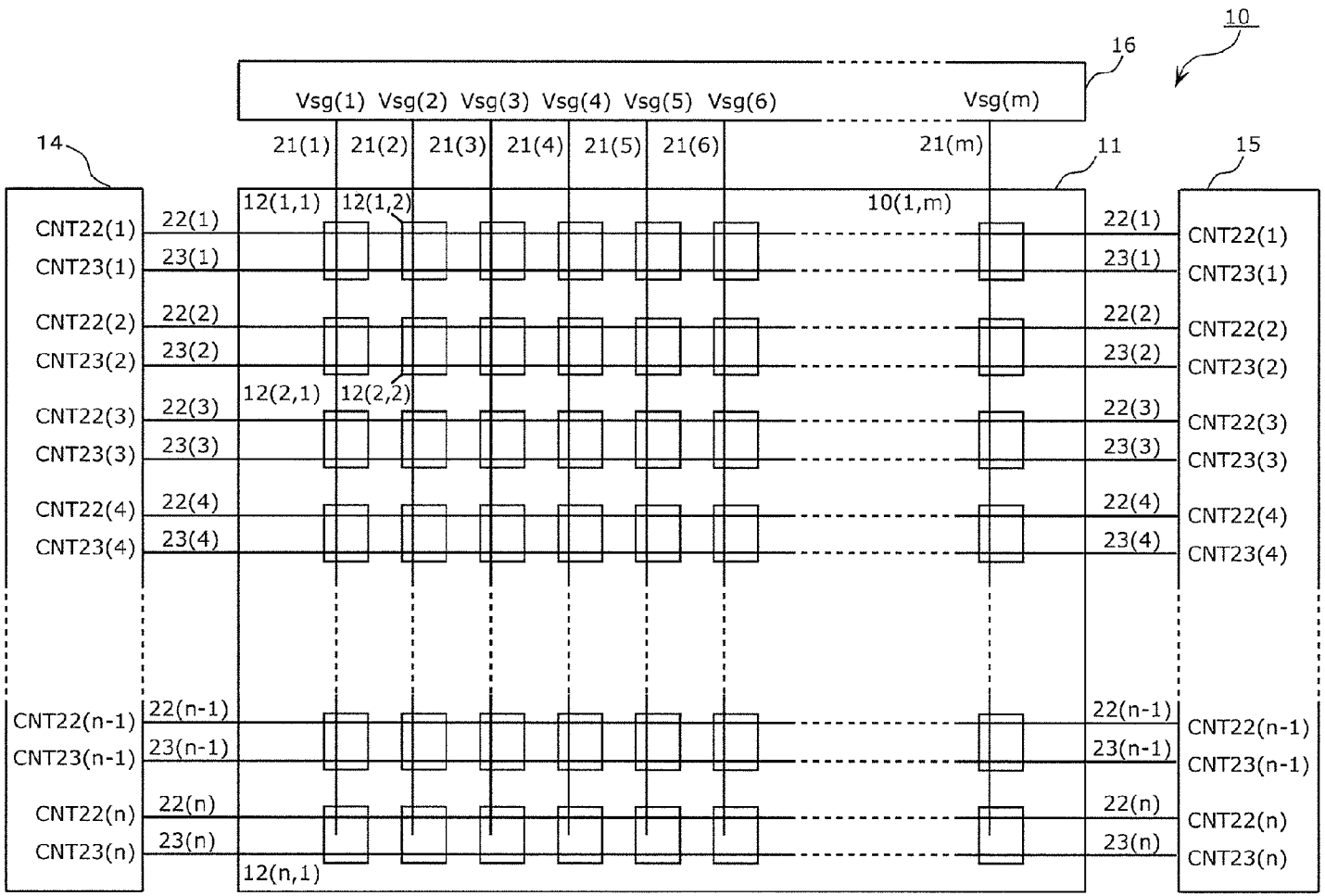
FIG. 1 is a schematic diagram illustrating a configuration of an image display apparatus according to Embodiment 1.

Underlying Knowledge Forming the Basis of the Present Disclosure

Underlying knowledge forming the basis of the present disclosure is described below prior to describing details of the present disclosure.

As described above, an image display panel includes gate signal lines disposed for each transistor included in a pixel circuit. The more the number of the transistors per pixel circuit increases, the more the kinds of the gate signal lines increases. Furthermore, the number of the gate signal lines per kind is equal to the number of the pixel circuits in a vertical direction. For example, the number of the gate signal lines included in an image display panel of Extended Graphics Array (XGA) is 768, and that of Super-XGA (SXGA) is 1024. Thus, for example, an image display panel of SXGA including pixel circuits each including four kinds of gate signal lines has in total 1024×4=4096 of the gate signal lines.

The image display apparatus includes gate driving circuits for driving the multiple gate signal lines described above. The gate driving circuits each includes gate driver integrated circuits which are integrated, and mounted near terminals of the gate signal lines drawn from the image display panel.

It is to be noted that the gate driver integrated circuit (gate drive IC) includes a semiconductor chip and is mounted on a panel according to an aspect of the present disclosure and used. However, the gate driver integrated circuit (gate drive IC) is not limited to the semiconductor chip. For example, the gate driver IC may be directly formed on a display panel substrate concurrently with the process of forming pixel circuits or the like using the techniques of TAOS, a low-temperature poly silicon, and a high-temperature polycrystalline silicon. In other words, the gate driver IC is not limited to the semiconductor chips, but may be a gate driver circuit. The same applies to the source driver IC, and the source driver IC is not limited to the semiconductor chips, but may be a source driver circuit.

However, when both of the gate signal line which requires high-speed driving and the gate signal line which does not require high-speed driving are included, and further, both of the gate signal line which requires bilateral driving and the gate signal line which does not require bilateral driving (which is driven by unilateral driving) are included, the number and arrangement of the gate signal lines drawn from one end of the image display panel are generally different from the number of and arrangement of the gate signal lines drawn from the other end. In addition, with different specifications or the like of the image display apparatus, the specifications of the pixel circuit also differ, and the number of transistors per pixel circuit also differs. Thus, the number of gate signal lines to be driven differs as well. The transistors included in a pixel circuit include both of the transistor which require a high-speed operation and a transistor which is sufficient with a low-speed operation. Accordingly, the number of the gate signal lines which should be driven at high speed and the number of the gate signal lines which should be applied with the bilateral driving are also different. There is a problem that tremendous amounts of money and time are required for generating a dedicated gate driver integrated circuit according to the number and arrangement of the gate signal lines drawn from the image display panel, and further according to the specifications or the like of the image display apparatus.

In view of the above, inventors of the present disclosure have invented an image display apparatus including a gate driver integrated circuit which is highly versatile and can be used irrespective of the number of the gate signal lines which should be driven at high speed and the number of the gate signal lines to which the bilateral driving should be applied, and irrespective of the arrangement of the gate signal lines.

Hereinafter, non-limiting embodiments are described in greater detail with reference to the accompanying Drawings. However, there are instances where excessively detailed description is omitted. For example, there are instances where detailed description of well-known matter and redundant description of substantially identical components are omitted. This is for the purpose of preventing the following description from being unnecessarily redundant and facilitating understanding of those skilled in the art.

It is to be noted that the accompanying Drawings and subsequent description are provided by the inventors to allow a person of ordinary skill in the art to sufficiently understand the present disclosure, and are thus not intended to limit the scope of the subject matter recited in the Claims.

Hereinafter, an image display apparatus according to embodiments of the present invention will be described with reference to the Drawings. The image display apparatus includes: an image display panel including pixel circuits disposed in a matrix; and a driving circuit which drives the image display panel.

Here, an image display apparatus will be described which includes: an EL element, in an image display panel, in which active-matrix pixel circuits each of which causes the EL element to emit light using a driving transistor are arranged; and a driving circuit which drives the image display panel.

Embodiment 1

FIG. 1 is a schematic diagram illustrating a configuration of an image display apparatus 10 according to Embodiment 1. The image display apparatus 10 according to the present embodiment includes an image display panel 11 and a driving circuit which drives the image display panel 11. The driving circuit includes: a source driving circuit 16; a first gate driving circuit 14; a second gate driving circuit 15; and a power supply circuit (not illustrated).

The image display panel 11 includes a plurality of pixel circuits 12($i$, $j$) arranged in a matrix of n rows and m columns ($1 \le i \le n$, $1 \le j \le m$). In FIG. 1, a source signal line 21($j$) is connected independently to each of pixel circuit columns including the pixel circuits 12(1, $j$) to 12($n$, $j$) arranged in a column direction. In addition, a first gate signal line 22($i$) and a second gate signal line 23($i$) are connected independently to each of pixel circuit rows including the pixel circuits 12($i$, 1) to 12($i$, $m$) arranged in a row direction. In the following description, the first gate signal line 22($i$) is simply referred to as a gate signal line 22($i$), and the second gate signal line 23($i$) is simply referred to as a gate signal line 23($i$).

The source signal lines 21($j$) are each drawn from an upper side of the image display panel 11, and connected to the source driving circuit 16 in FIG. 1.

Each of the gate signal lines 22($i$) and 23($i$) is drawn from the both sides of the image display panel 11, has one end connected to the first gate driving circuit 14 and the other end connected to the second gate driving circuit 15. Accordingly, bilateral driving is applied to the gate signal lines 22($i$) and 23($i$).

As described above, in the image display panel 11 according to the present embodiment, the gate signal line 22($i$) and the gate signal line 23($i$) are connected in common to the pixel circuits 12($i$, 1) to 12($i$, $m$) arranged in the row direction.

The source driving circuit 16 supplies an image signal voltage Vsg(j) independently to each of the source signal lines 21($j$).

The first gate driving circuit 14 supplies each of the gate signal lines 22($i$) with a write controlling signal CNT22($i$) that is a first controlling signal, and supplies each of the gate signal lines 23($i$) with a display controlling signal CNT23($i$)

that is a second controlling signal. In addition, the second gate driving circuit 15, as with the first gate driving circuit 14, supplies each of the gate signal lines 22(*i*) with CNT22(*i*) and supplies each of the gate signal lines 23(*i*) with CNT23(*i*).

Here, the write controlling signals CNT22(*i*) and CNT23(*i*) supplied by the second gate driving circuit 15 are signals having the same voltage waveforms as the voltage waveforms of the write controlling signals CNT22(*i*) and CNT23(*i*), respectively, supplied by the first gate driving circuit 14.

As described above, the gate signal lines 22(*i*) and 23(*i*) are gate signal lines to which the bilateral driving is performed, according to the present embodiment.

It is to be noted that, in the following description, the write controlling signal CNT22(*i*) that is the first controlling signal is simply referred to as the write controlling signal CNT22(*i*), and the display controlling signal CNT23(*i*) that is the second controlling signal is simply referred to as the display controlling signal CNT23(*i*).

The power supply circuit supplies a voltage Vdd (anode voltage Vdd) to a power line on a high-voltage side connected to all of the pixel circuits 12(1, 1) to 12(*n, m*) in common, and supplies a voltage Vss (cathode voltage Vss) to a power line on a low-voltage side. The power supply of the voltage Vdd and the voltage Vss is a power supply for causing the EL element to emit light as described below. According to the present embodiment, the voltage on the high-voltage side Vdd=10 (V), and the voltage on the low-voltage side Vss=−10 (V). However, it is desirable to optimally set these numerical values according to the specification of the pixel circuit or the characteristics of each element.

Next, the pixel circuit 12(*i, j*) will be described.

Figure 2:
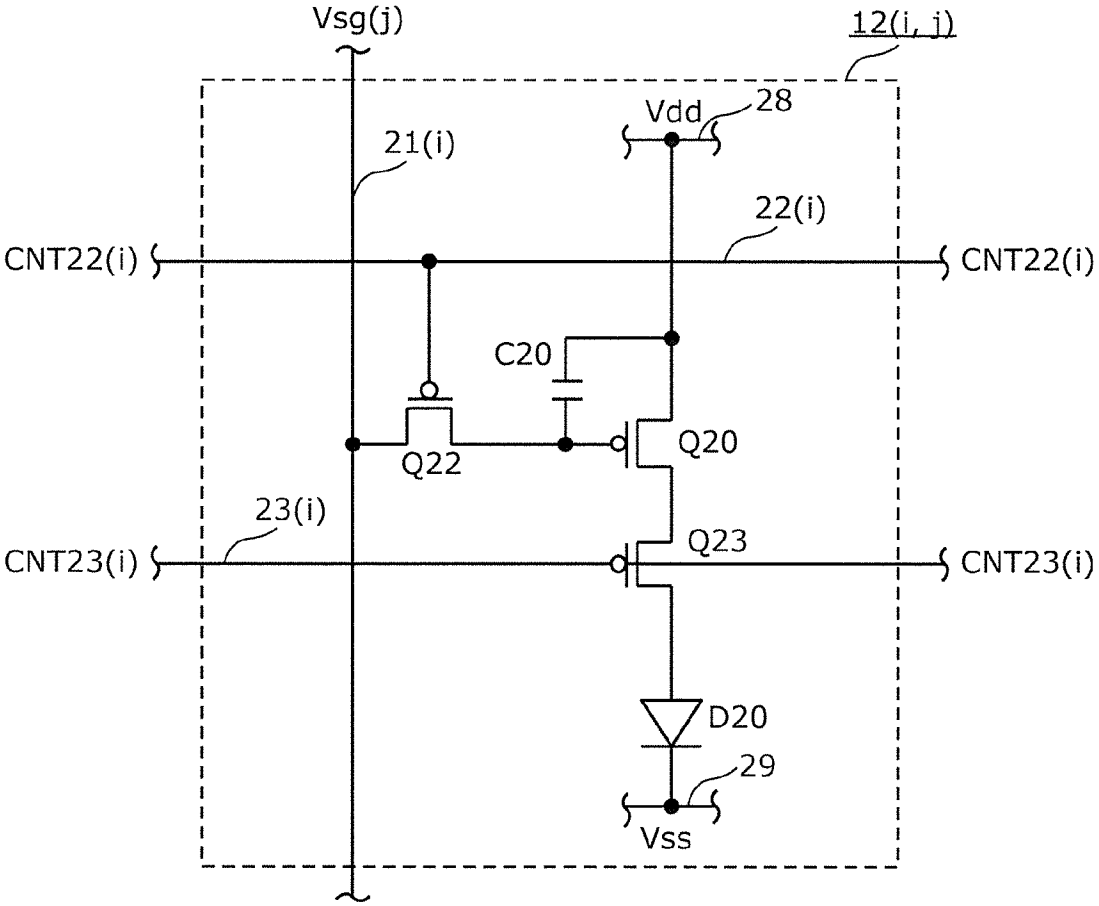
FIG. 2 is a circuit diagram illustrating a pixel circuit of the image display apparatus according to Embodiment 1.

FIG. 2 is a circuit diagram illustrating the pixel circuit 12(*i, j*) of the image display apparatus 10 according to Embodiment 1. The pixel circuit 12(*i, j*) according to the present embodiment includes: an EL element D20 that is a current light-emitting element; a driving transistor Q20; a capacitor C20; and a transistor Q22 and a transistor Q23 each operating as a switch.

The driving transistor Q20 provides the EL element D20 with a current according to the image signal voltage Vsg(j). The capacitor C20 holds the image signal voltage Vsg(j). The transistor Q22 is a switch for applying the image signal voltage Vsg(j) to the capacitor C20. The transistor Q23 is a switch for supplying the EL element D20 with a current to cause the EL element D20 to emit light. The EL element D20 is supplied with a current from the driving transistor Q20, by turning ON (turning into an operating state) the transistor Q23. The current from the driving transistor Q20 is interrupted by turning OFF (turning into a non-operating state) the transistor Q23, and the EL element D20 stops emitting light.

The pixel circuit 12(*i, j*) includes an anode power line 28 on the high-voltage side and a cathode power line 29 on the low-voltage side. The power line 28 is supplied with a voltage Vdd from the power supply circuit. The power line 29 is supplied with a voltage Vss from the power supply circuit. The source of the driving transistor Q20 is connected to the anode power line 28, the drain of the driving transistor Q20 is connected to the source of the transistor Q23, the drain of the transistor Q23 is connected to the anode of the EL element D20, and the cathode of the EL element D20 is connected to the cathode power line 29.

The transistor Q22 is a first switching transistor which has a function of applying, to the pixel circuit 12(*i, j*), the video signal applied to the source signal line 21(*i*). The capacitor C20 is connected between the gate and the source of the driving transistor Q20. The drain (or source) of the transistor Q22 is connected to the gate of the driving transistor Q20, the source (or drain) of the transistor Q22 is connected to the source signal line 21(*j*) which transmits the image signal voltage Vsg(j), and the gate of the transistor Q22 is connected to the gate signal line 22(*i*). According to the above-described configuration, the gate of the driving transistor Q20 is supplied with the image signal voltage Vsg(j) in response to conduction of the transistor Q22.

The transistor Q23 is, as described above, a second switching transistor connected between the drain of the driving transistor Q20 and the anode of the EL element D20. The gate of the transistor Q23 is connected to the gate signal line 23(*i*). According to the above-described configuration, the EL element D20 is supplied with a current controlled by the driving transistor Q20, in response to conduction of the transistor Q23.

As described above, the image display panel (image display panel 11) according to the present embodiment includes the source signal line 21(*j*) which supplies the image signal voltage Vsg(j) independently to each of the pixel circuit columns including the pixel circuits 12(1, *j*) to 12(*n, j*) arranged in the column direction.

Furthermore, the image display panel includes the gate signal line 22(*i*) which supplies the write controlling signal CNT22(*i*) independently to each of the pixel circuit rows including the pixel circuits 12(*i*, 1) to 12(*i, m*) arranged in the row direction, from the both sides of the pixel circuit row, and the gate signal line 23(*i*) which supplies the display controlling signal CNT 23(*i*) independently to each of the pixel circuit rows, from the both sides of the pixel circuit row.

It is to be noted that, although it has been described that the driving transistor Q20, and the transistors Q22 and Q23 are each a P-channel thin-film transistor according to the present embodiment, the present invention is not limited to this. For example, the pixel circuit may be configured using an N-channel thin-film transistor.

Figure 3:
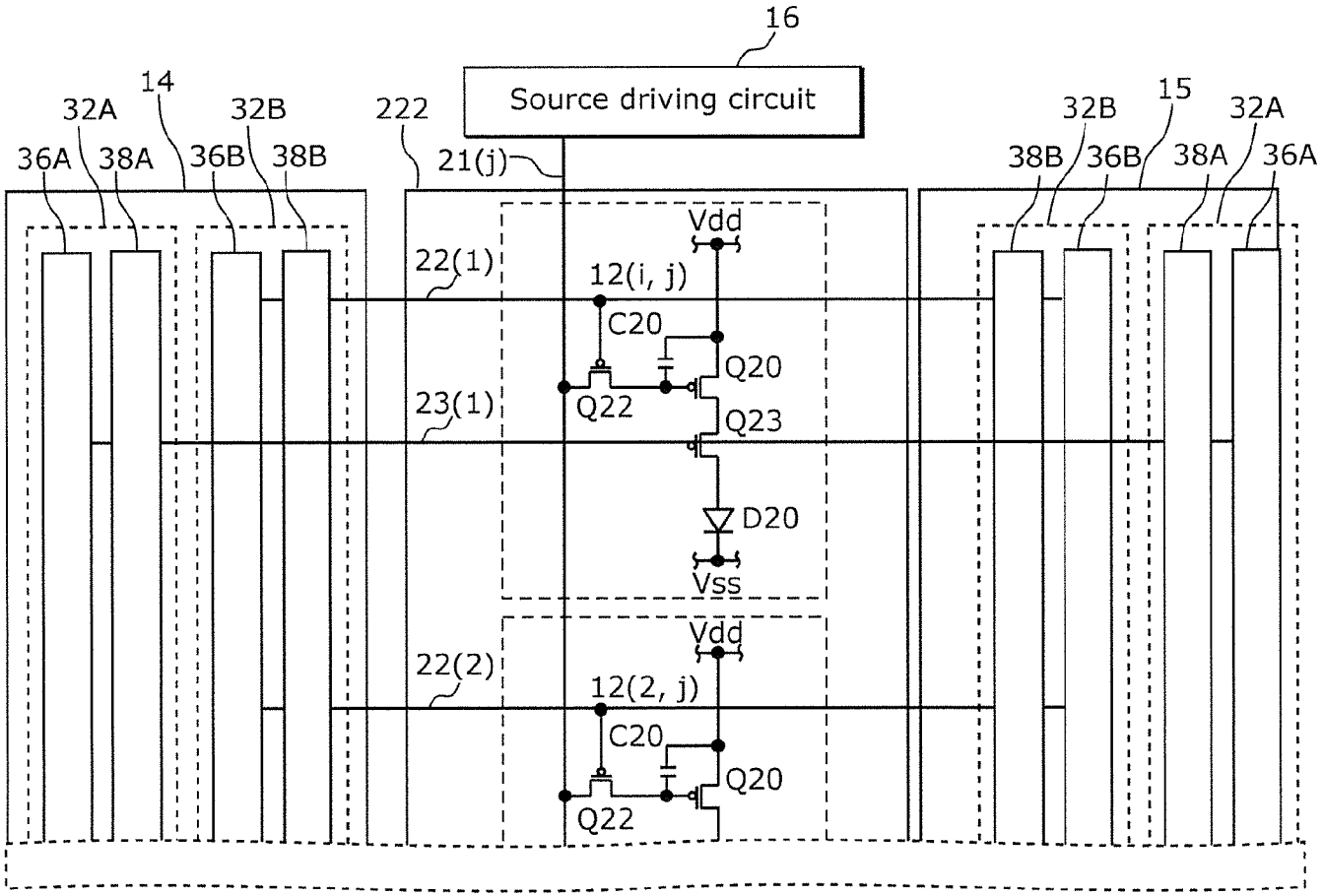
FIG. 3 is a diagram showing a connection state between gate driving circuits and pixel circuits according to Embodiment 1.

FIG. 3 is a diagram illustrating a connection state between the gate driving circuits and the pixel circuits. Each of the gate driving circuits includes two gate signal line driving units. The first gate signal line driving unit drives the gate signal lines 22, and the second gate signal line driving unit drives the gate signal lines 23.

A gate driver circuit according to the present disclosure includes at least m (m is an integer not less than two) gate signal line driving units when the number of gate signal lines included in the pixel circuit 12 is m. The gate signal line driving unit 32A includes a shift register unit 36A and a voltage outputting unit 38A. The gate signal line driving unit 32B includes a shift register unit 36B and a voltage outputting unit 38B.

The gate signal line driving unit 32A of the first gate driving circuit 14 and the gate signal line driving unit 32A of the second gate driving circuit 15 drive the gate signal line 23(*i*). The gate signal line driving unit 32B of the first gate driving circuit 14 and the gate signal line driving unit 32B of the second gate driving circuit 15 drive the gate signal line 22(*i*).

It is to be noted that the gate driver circuit has a function of inverting a scanning direction. For example, the scanning direction of the shift register circuit in the first gate driving circuit 14 and the scanning direction of the shift register circuit in the second gate driving circuit 15 are set to be inverted. In addition, the gate driver circuit includes a terminal which specifies the scanning direction for inverting the shift register.

Figure 4:
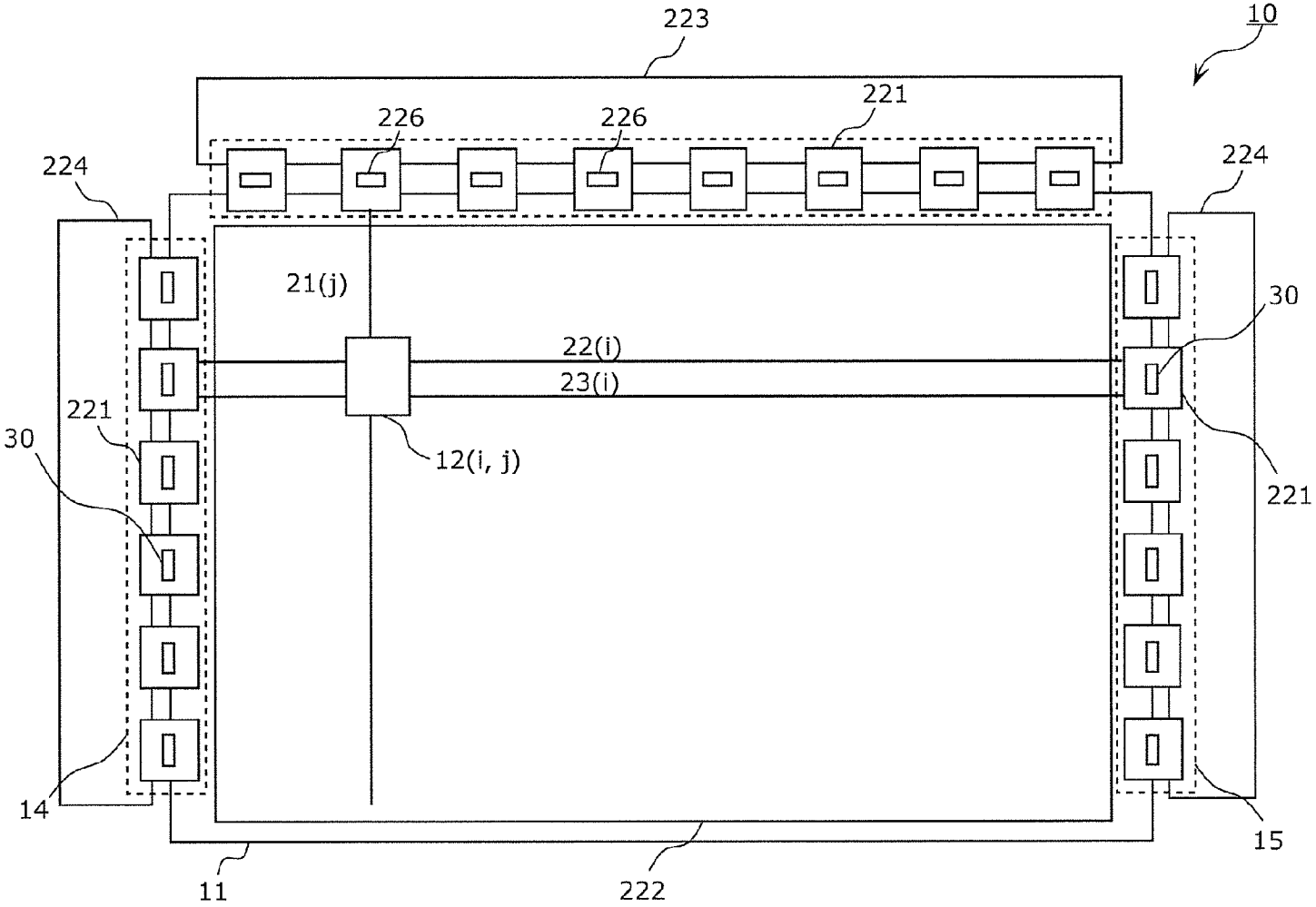
FIG. 4 is a diagram showing an arrangement relationship between an image display panel, gate driving circuits, a source driving circuit, etc.

FIG. 4 is a diagram showing an arrangement relationship between the image display panel, the gate driving circuits, the source driving circuit, etc.

Each of the gate driver IC and the source driver IC 226 is mounted on a COF (chip of film) 221. In order to prevent halation due to light emitted from the image display panel 11, each of the COFs 221 is formed by applying or forming light absorbing paint or a material, or applying a sheet, on a front surface and a rear surface of the COF 221 so as to absorb the light. In addition, a heatsink is disposed or formed on the front surface of a driver IC mounted on the COF, to dissipate heat from the gate driver IC30 and the source driver IC226. In addition, chassis (not illustrated) for dissipating heat is disposed on the rear surface of the image display panel 11, to dissipate heat generated by the driver IC to the chassis. The above-described chassis and the driver IC or the COF are closely attached using an adhesive or the like.

The COF 221 on which the gate driver IC 30 is mounted is electrically connected to the image display panel 11 and a gate printed circuit board 224. The connection is carried out using an ACF (anisotropic conductive film) resin. The COF 221 on which the source driver IC 226 is mounted is electrically connected to the image display panel 11 and a source printed circuit board 223. It is to be noted that the source driving circuit 16 (or source driver IC), the first gate driving circuit 14, and the second gate driving circuit 15 (or gate driver IC) each include, on the output side, a switch for disconnecting the circuit (IC) and the source signal line or the gate signal line. it is possible to set the portion between the source driving circuit 16 (IC) and the source signal line into a high impedance state, by turning OFF the above-described switch of the source driving circuit 16 (IC). The above-described switch can be controlled by a logic signal which is applied to the terminal at which the source driving circuit 16 (IC) is provided. In addition, it is possible to set the portions between the first gate driving circuit 14 and the gate signal line, and the second gate driving circuit 15 (IC) and the gate signal line into a high impedance state, by turning OFF the above-described switch of the first gate driving circuit 14 and the second gate driving circuit 15 (IC). The above-described switch can be controlled by a logic signal which is applied to the terminal at which the first gate driving circuit 14 and the second gate driving circuit 15 (IC) are provided.

It should be understood that the above-described matters can be applied to other embodiments as well.

Next, an operation of the pixel circuit 12(*i, j*) will be described. One field period is divided into a plurality of periods including a writing period Tw and a display period Td, and each of the pixel circuits 12(*i, j*) performs a writing operation of writing the image signal voltage Vsg(j) to be displayed in the writing period Tw, and causes the EL element D20 to emit light in the display period Td based on the image signal voltage Vsg(j) which has been written.

(Writing Period Tw)

Figure 5:
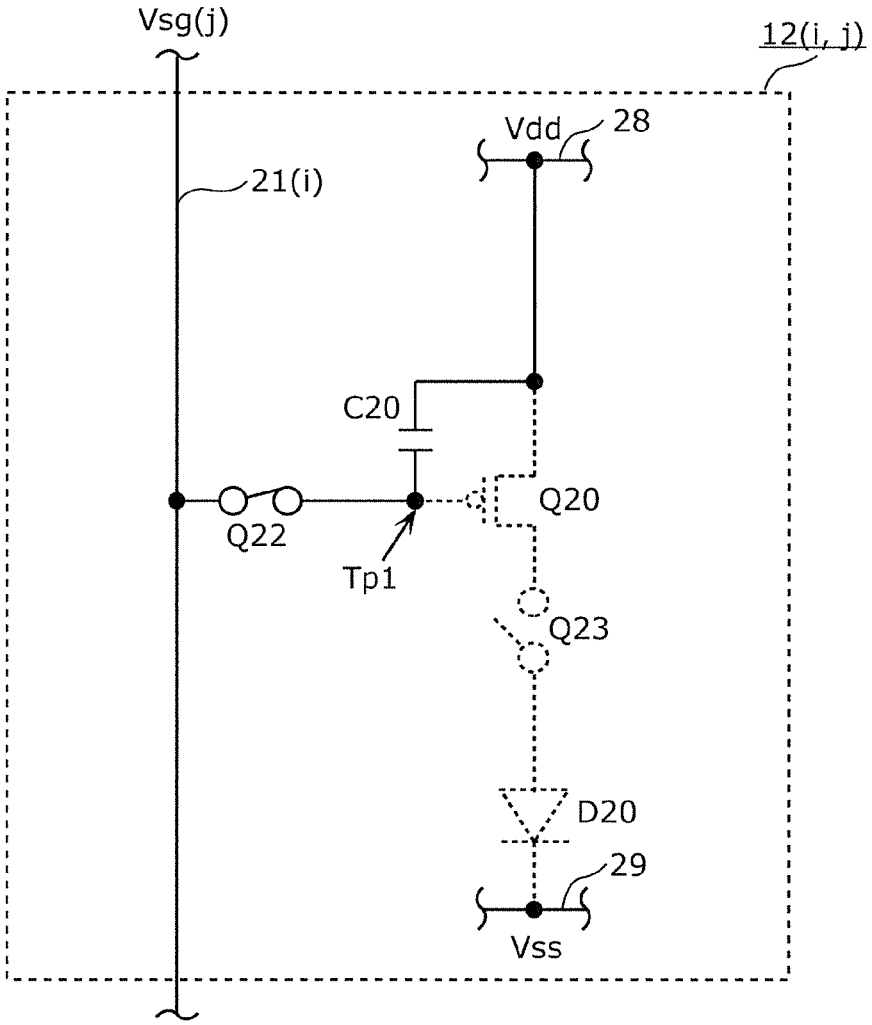
FIG. 5 is a diagram for explaining an operation in a writing period of the pixel circuit according to Embodiment 1.

FIG. 5 is a diagram illustrating an operation in a writing period Tw of the pixel circuit 12(*i, j*) of the image display apparatus 10 according to Embodiment 1. It is to be noted that the each of the transistors Q22 and Q23 illustrated in FIG. 1 is denoted by a symbol of switches in FIG. 5. In addition, a path through which a current does not pass is denoted as a dashed line.

For performing the writing operation, the write controlling signal CNT22(*i*) is set at an ON voltage level (V22on) to turn ON the transistor Q22. Then, the video signal voltage Vsg(j) is applied to the gate terminal of the driving transistor Q20, and the capacitor C20 is charged to have a voltage (Vdd−Vsg(j)) between the terminals. Subsequent to the writing operation, the write controlling signal CNT22(*i*) is set at an OFF voltage level (V22off) to turn OFF the transistor Q22.

According to the present embodiment, an over-drive voltage V22*ovd* is applied for a predetermined time period so that an amplitude exceeds an absolute value of the voltage (V22on−V22off) at rising of the write controlling signal CNT22(*i*) when switching the transistor Q22 from the ON state to the OFF state. Subsequently, the voltage V22off is applied to hold the transistor Q22 in the OFF state.

Meanwhile, the display controlling signal CN23(*i*) is set at the OFF voltage level (V23off) to turn OFF the transistor Q23. With this, a current does not pass through the EL element D20, and thus the EL element D20 does not emit light.

It is to be noted that, although the details will be given later, the writing operation should be sequentially performed by n pixel circuits 12(1, *j*) to 12(*n, j*) disposed in the column direction, using the source signal lines 21(*j*) within one field period. For that reason, a time period of the writing period Tw to be allocated to each of the pixel circuits 12(*i, j*) is short; that is, 3.5 μs according to the present embodiment.

(Display Period Td)

Figure 6:
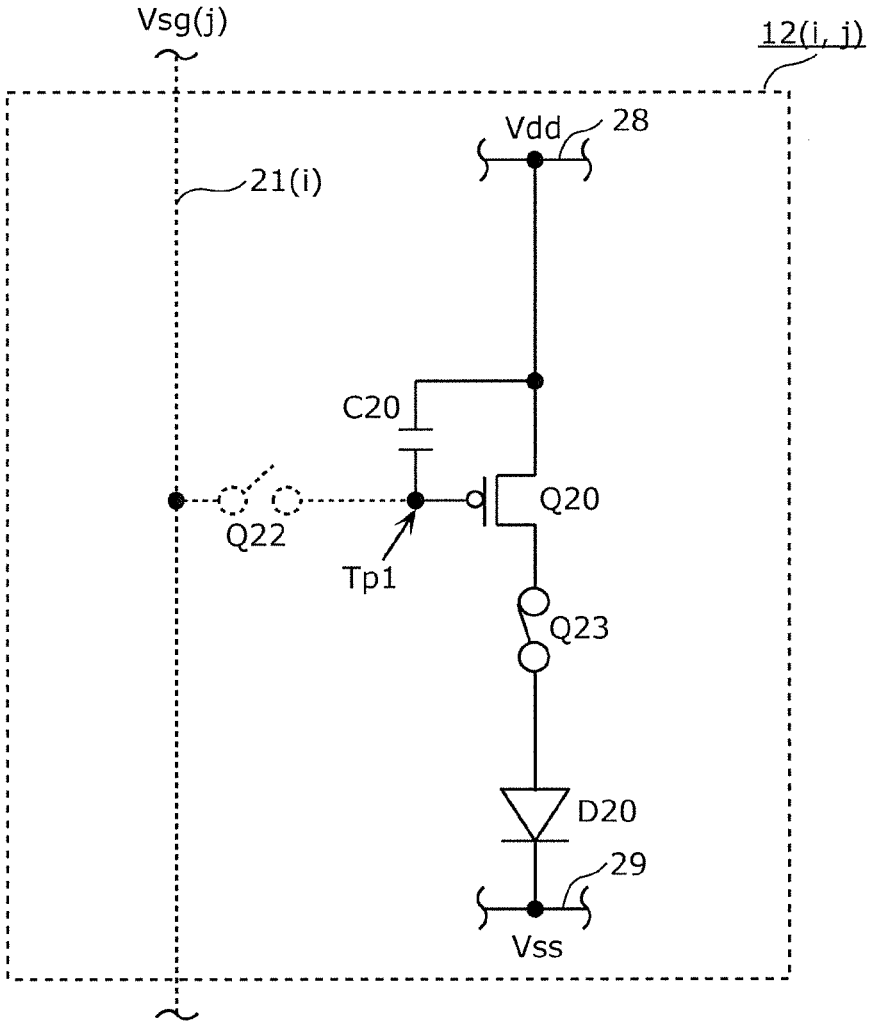
FIG. 6 is a diagram for explaining an operation in a display period of the pixel circuit according to Embodiment 1.

FIG. 6 is diagram illustrating an operation in a display period Td of the pixel circuit 12(*i, j*) of the image display apparatus 10 according to Embodiment 1.

While the write controlling signal CNT22(*i*) is set at the voltage V22*ovd* or the voltage V22off to maintain the OFF state of the transistor Q22, the display controlling signal CNT23(*i*) is set at the ON voltage level (V23on) to turn ON the transistor Q23. Then, the drain voltage of the driving transistor Q20 increases, and a current according to the voltage between the gate and the source (Vdd−Vsg(j)) flows through the EL element D20. In the manner as described above, the EL element D20 emits light, in the display period Td, at a luminance according to the image signal voltage Vsg(j) which has been written in the writing period Tw.

It is to be noted that, since the light emitting period of the EL element D20 becomes longer as the display period Td is set longer, it is possible to improve the luminance of the image display apparatus 10. According to the present embodiment, most part of the one field period other than the writing period Tw is the display period Td.

Next, an operation of the image display apparatus 10 according to the present embodiment will be described.

Figure 7:
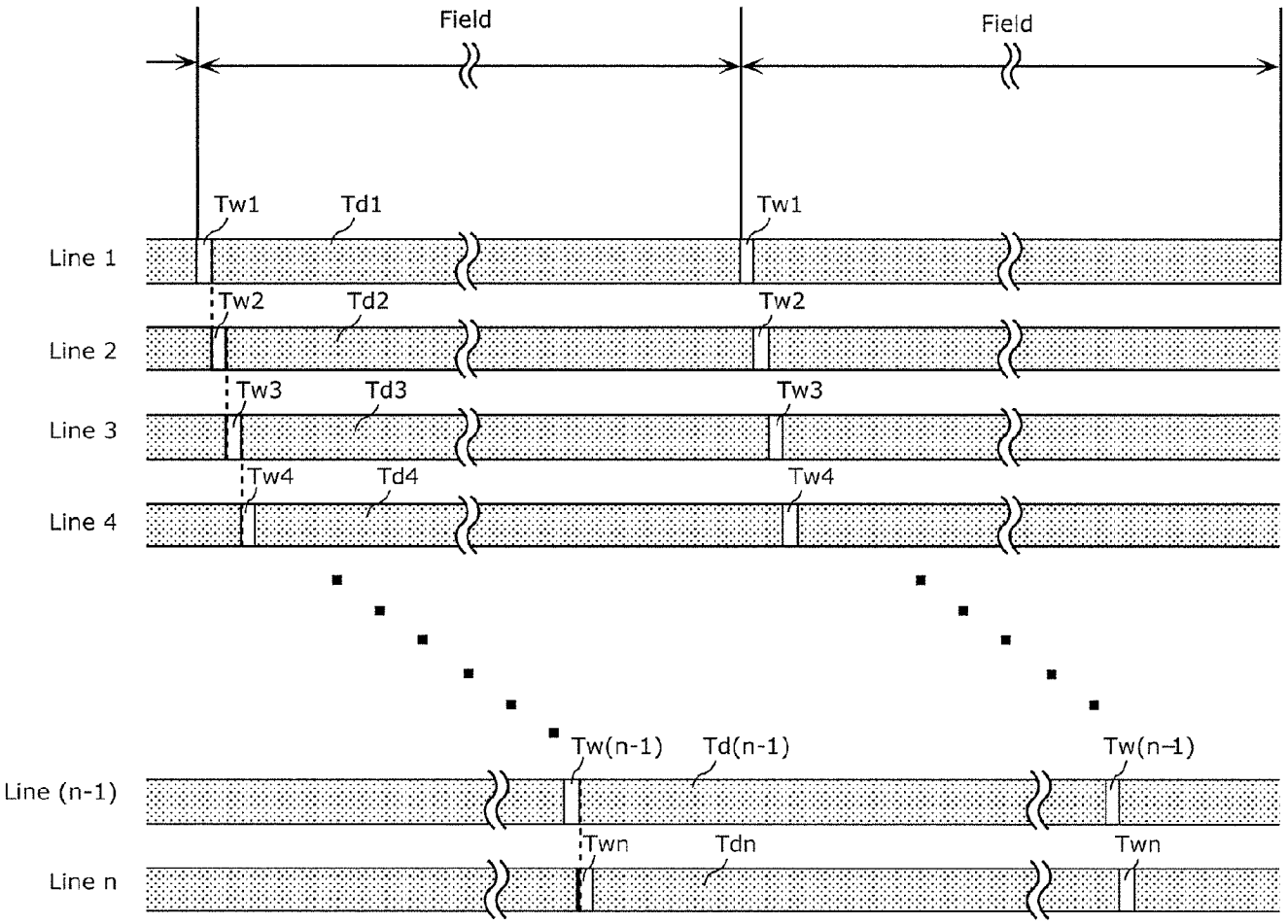
FIG. 7 is a timing chart showing an operation of the image display apparatus according to Embodiment 1.

FIG. 7 is a timing chart showing an operation of the image display device 10 according to Embodiment 1. It is to be noted that, in the following description, a pixel row including the pixel circuits 12(*i*, 1) to 12(*i, m*) arranged in the row direction at the ith row is simply referred to as a line i.

According to the present embodiment, the writing period Tw1 of the pixel circuits 12(1, 1) to 12(1, *m*) in the line 1 is set to start first in the one field period, and a predetermined period before the next writing period Tw1 following the writing period Tw1 is set as the display period Td1 of the pixel circuits 12(1, 1) to 12(1, *m*) in the line 1.

In addition, the writing period Tw2 of the pixel circuits 12(2, 1) to 12(2, *m*) in the line 2 is set to start immediately after the end of the writing period Tw1, and a predetermined period before the next writing period Tw2 following the writing period Tw2 is set as the display period Td2 of the pixel circuits 12(2, 1) to 12(2, *m*) in the line 2.

In the same manner as above, the writing period Twi of the pixel circuits 12(*i*, 1) to 12(*i, m*) in the line i is set to start immediately after the end of the writing period Tw(i−1), and a predetermined period before the next writing period Twi following the writing period Twi is set as the display period Tdi of the pixel circuits 12(*i*, 1) to 12(*i, m*) in the line i.

As described above, the writing operation is sequentially performed starting from the pixel circuits 12(1, 1) to 12(1, *m*) in the line 1 to the pixel circuits 12(*n*, 1) to 12(*n, m*) in the line n, by setting the writing periods Tw1 to Twn. In addition, the display operation is performed in most of the time other than the writing period Tw in each of the pixel circuits, by setting the display periods Td1 to Tdn as described above.

Figure 8:
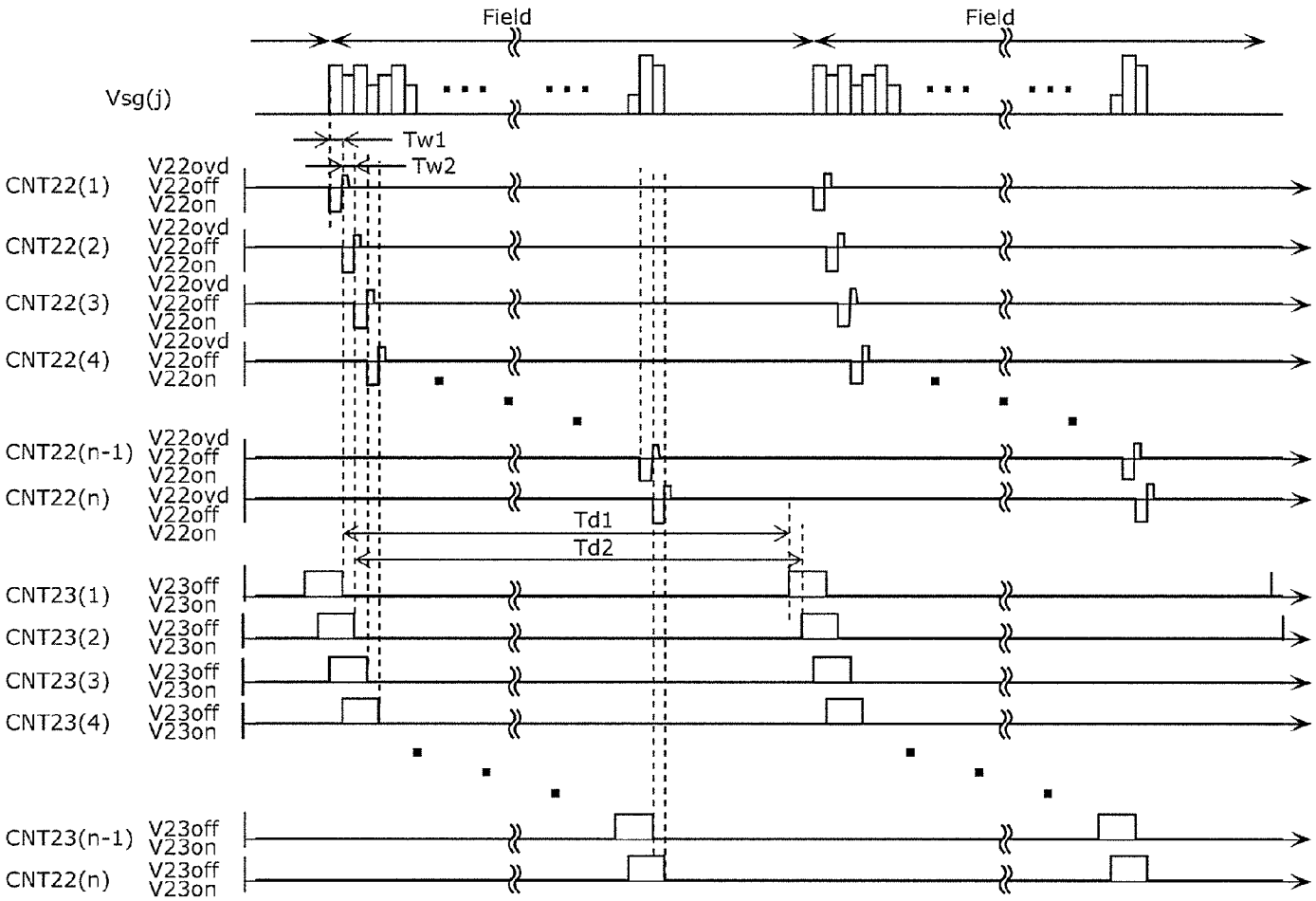
FIG. 8 is a timing chart of an image signal voltage, a write controlling signal, and a display controlling signal, of the image display apparatus according to Embodiment 1.

FIG. 8 illustrates a timing chart of the image signal voltage Vsg(1) to Vsg(m), the write controlling signal CNT22(1) to CNT22(*n*), and the display controlling signal CNT23(1) to CNT23(*n*) of the image display apparatus 10 according to Embodiment 1.

It is to be noted that, only the image signal voltage Vsg(j) among the image signal voltages Vsg(1) to Vsg(m) is illustrated in FIG. 8. In addition, since the transistors Q22 and Q23 according to the present embodiment are each the P-channel transistor, the gate voltage which turns OFF each of the transistors is higher than the gate voltage which turns ON each of the transistors.

During the writing period Tw1 of the line 1, the source driving circuit 16 supplies the source signal lines 21(1) to 21(*m*) with the image signal voltages Vsg(1) to Vsg(m), respectively, to be displayed on the pixel circuits 12(1, 1) to 12(1, *m*) in the first line. Then, the gate driving circuit sets the write controlling signal CNT22(1) in the line 1 to the voltage V22on, and the writing operation is performed in the pixel circuits 12(1, 1) to 12(1, *m*) in the line 1. Subsequently, the gate driving circuit applies the over-drive voltage V22*ovd* to the write controlling signal CNT22(1) in the line 1 for a predetermined time period. After that, the gate driving circuit resets the write controlling signal CNT22(1) to the voltage V22off.

During the writing period Tw2 of the line 2, the source driving circuit 16 supplies the source signal lines 21(1) to 21(*m*) with the image signal voltages Vsg(1) to Vsg(m), respectively, to be displayed on the pixel circuits 12(2, 1) to 12(2, *m*) in the second line. Then, the gate driving circuit sets the write controlling signal CNT22(2) in the line 2 to the voltage V22on, and the writing operation is performed in the pixel circuits 12(2, 1) to 12(2, *m*) in the line 2. Subsequently, the gate driving circuit applies the over-drive voltage V22*ovd* to the write controlling signal CNT22(2) in the line 2 for a predetermined time period. After that, the gate driving circuit resets the write controlling signal CNT22(2) to the voltage V22off.

In the same manner as above, during the writing period Twi in the line i, the source driver circuit 16 supplies the source signal lines 21(1) to 21(*m*) with the image signal voltages Vsg(1) to Vsg(m), respectively, to be displayed on the pixel circuits 12(*i*, 1) to 12(*i, m*) in the ith line. Next, the gate driving circuit sets the write controlling signal CNT22(*i*) in the line i to the voltage V22on to perform the writing operation in the pixel circuits 12(*i*, 1) to 12(*i, m*) in the line i. Subsequently, the gate driving circuit applies the over-drive voltage V22*ovd* to the write controlling signal CNT22(*i*) in the line i for a predetermined time period. After that, the gate driving circuit resets the write controlling signal CNT22(*i*) to the voltage V22off.

With the above-described timing for driving, the gate driving circuit sequentially applies the pulsed voltage V22on to each of the write controlling signals CNT22(1) to CNT22(*n*) so as not to overlap with each other, and sequentially performs the writing operation in the pixel circuits of the lines 1 to n.

The method of driving a gate signal line by applying voltages of three different levels including the over-drive voltage (Vovd), i.e. Von, Voff, and Vovd, as in the above-described timing for driving, is hereinafter referred to "gate voltage ternary driving". In the display period Td1 of the line 1, the display controlling signal CNT23(1) in the line 1 is set to the voltage V23on, and the display operation is performed in the pixel circuits 12(1, 1) to 12(1, *m*) in the line 1. Then, the gate driving circuit sets the display controlling signal CNT23(1) to the voltage V23off at the end of the display period Td1, to end the display operation.

In the display period Td2 of the line 2, the gate driving circuit sets the display controlling signal CNT23(2) in the line 2 to the voltage V23on, and the display operation is performed in the pixel circuits 12(2, 1) to 12(2, *m*) in the line 2. Then, the gate driving circuit sets the display controlling signal CNT23(2) to the voltage V23off at the end of the display period Td2, to end the display operation.

In the same manner as above, in the display period Tdi of the line i, the gate driving circuit sets the display controlling signal CNT23(*i*) in the line i to the voltage V23on, and the display operation is performed in the pixel circuits 12(*i*, 1) to 12(*i, m*) in the line i. Then, the gate driving circuit sets the display controlling signal CNT23(*i*) to the voltage V23off at the end of the display period Tdi, to end the display operation.

With the above-described timing for driving, the gate driving circuit applies the voltage V23on to each of the display controlling signals CNT23(1) to CNT23(*n*) in most of the time in the one field period other than the writing period Tw, and the display operation is sequentially performed in the pixel circuits of the lines 1 to n The method of driving a gate signal line by applying two voltages of different levels not including the over-drive voltage (Vovd), i.e. Von and Voff, as described above, is hereinafter referred to "gate voltage binary driving".

It is to be noted that the amount of time of the writing period Tw to be allocated to one line is short as described above, and set as 3.5 μs according to the present embodiment. For performing the writing operation within the short writing period Tw, it is necessary to turn ON or OFF the transistor Q22 of each of the pixel circuits 12(*i, j*) at high speed. However, impedance of each of the gate signal lines 22(*i*) rises as the size of the display screen of the image display panel 11 increases, and attached additional capacity also increases.

For that reason, assuming that the gate signal line 22(*i*) is supplied with the write controlling signal CNT22(*i*) only from the first gate driving circuit 14 disposed on the left side of the image display panel 11, for example, a voltage waveform substantially equivalent to an output waveform of the first gate driving circuit 14 is applied to the gate terminal of the transistor Q22 of the pixel circuit disposed on the supply side; that is, on the left side. Accordingly, it is possible to turn ON or OFF the transistor Q22 at high speed. However, since the voltage waveform rounds with distance from the supply side in the gate signal line 22(*i*), it is not possible to turn ON or OFF at high speed the transistor Q22 of the pixel circuit disposed on the right side. For that reason, crosstalk, luminance gradient, display unevenness, etc. occur as the position of the pixel circuit becomes closer to the right side of the display screen, causing a decrease in the image display quality.

According to the present embodiment, however, the bilateral driving is applied to the gate signal line 22(*i*) which supplies the write controlling signal CNT22(*i*). More specifically, the write controlling signal CNT22(*i*) is supplied to the gate signal line 22(*i*) from both of the first gate driving circuit 14 disposed on the left side of the image display panel 11 and the second gate driving circuit 15 disposed on the right side of the image display panel 11. For that reason, since it is possible to significantly suppress the rounding of the voltage waveform and turn ON or OFF at high speed the transistor Q22 of the pixel circuit 12(*i, j*) in the entire display screen, a high quality image can be displayed.

Furthermore, according to the present embodiment, the over-drive voltage V22*ovd* is applied for a predetermined time period so that an amplitude exceeds an absolute value of the voltage (V22on−V22off) at falling of the write controlling signal CNT22(*i*) when switching the transistor Q22 from the ON state to the OFF state.

Figure 9:
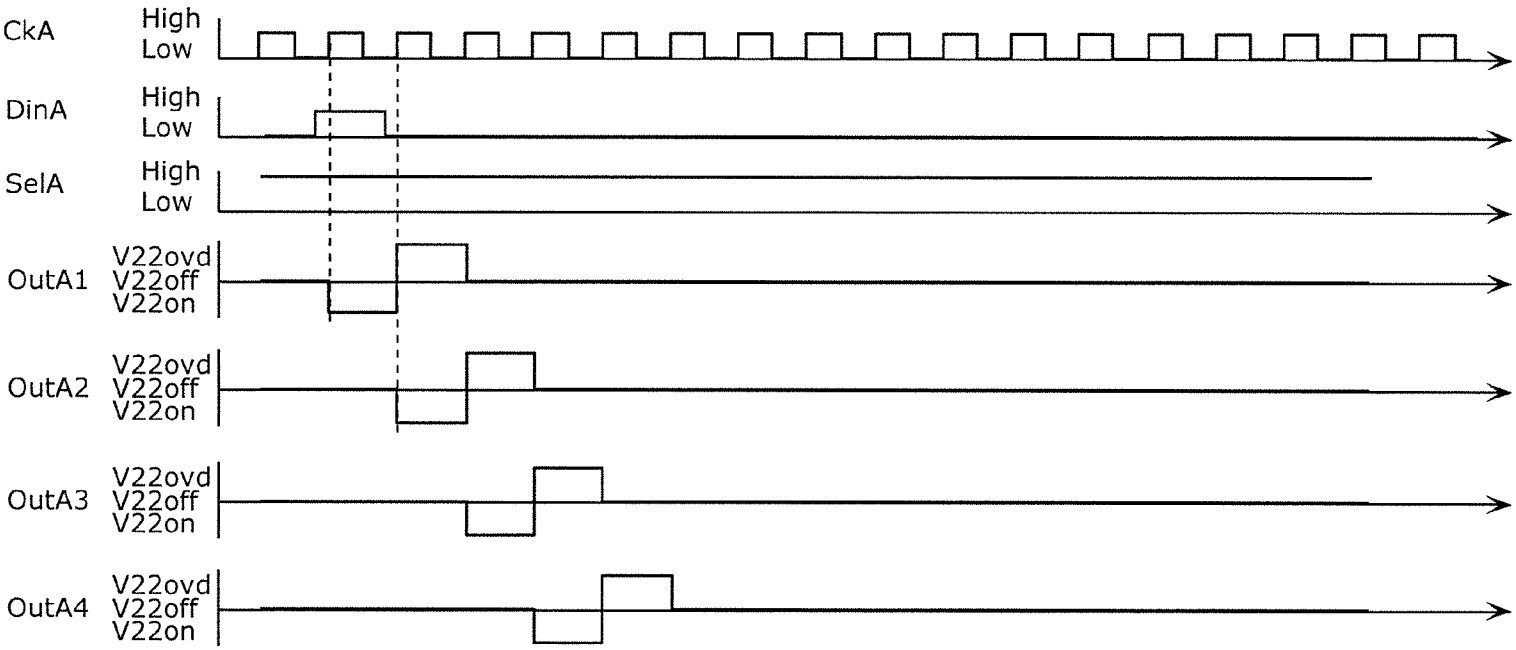
FIG. 9 is a timing chart of a gate signal line illustrating a first example of gate voltage ternary driving.
Figure 10:
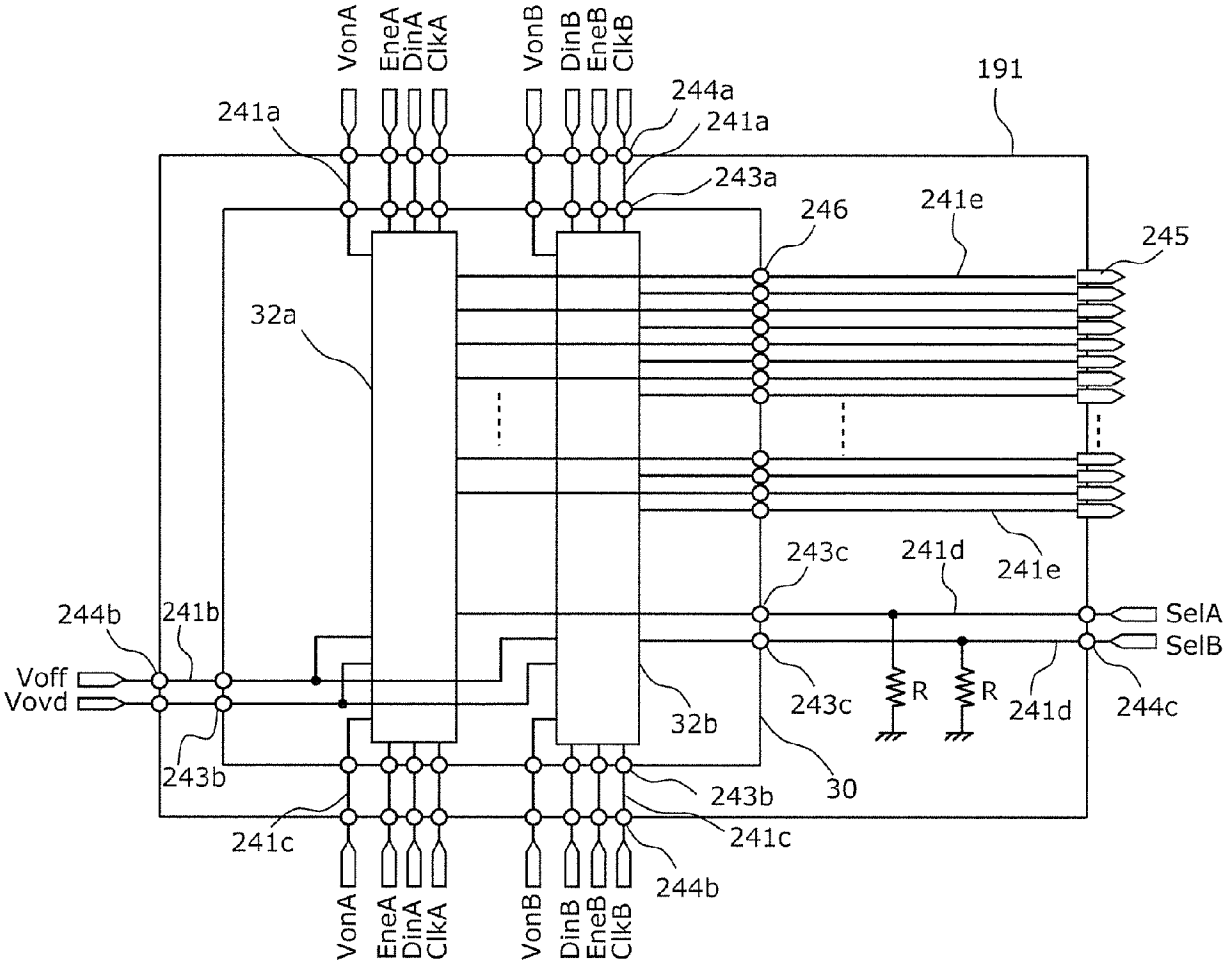
FIG. 10 is a circuit configuration diagram of a gate driver IC according to Embodiment 1.

FIG. 9 is a timing chart of a gate signal line illustrating a first example of the gate voltage ternary driving. The position of applying the voltage Von is sequentially shifted in synchronization with rising of a clock CkA. FIG. 10 is a circuit configuration diagram of the gate driver IC according to Embodiment 1. A selecting terminal (SelA) illustrated in FIG. 10 is set at a level "high". With this, the gate signal line driving unit 32A is set to be applied with the gate voltage ternary driving. The gate signal line driving unit 32B is set to be applied with the gate voltage ternary driving by setting the terminal SelB at a level "high".

It is to be noted that there are instances where "high" and "low" are expressed or denoted as "H" and "L", respectively.

As illustrated in FIG. 10, a pulldown setting is applied to the terminal Sel by a resistance R or the like in the COF 191 or the gate driver IC 30. This means that the terminals Sel are set at "low" by default, in other words, set to be applied with the gate voltage binary driving.

In addition, the voltage Voff is configured so that a common voltage can be applied to the gate signal line driving units 32*a* and 32*b*. Furthermore, the voltage Voff is configured so as to be set by an external power supply of the COF 191 or the gate driver IC 30.

In addition, the voltage Vovd is configured so that a common voltage can be applied to the gate signal line driving units 32*a* and 32*b*. Furthermore, the voltage Vovd is configured so as to be set by an external power supply of the COF 191 or the gate driver IC 30 (see FIG. 28 and FIG. 29, etc. which will be described later).

The voltage Von is configured so that a voltage can be applied individually to the gate signal line driving units 32*a* and 32*b* (terminals VonA and VonB). Furthermore, the voltage Von is configured so as to be set by an external power supply of the COF 191 or the gate driver IC 30 (see FIG. 30 and FIG. 31, etc. which will be described later). For example, the voltage Von of the switching transistor Q123 in FIG. 44 which will be described later is set higher than the voltage Von of other transistors (in the case where the transistors are N-channel transistors). This is because it is possible to reduce an ON resistance of the transistor Q123 and lower the Vdd voltage by setting the ON voltage of the transistor Q123 higher, and thus it is possible to reduce power for the panel.

It is to be noted that, in the configuration illustrated in FIG. 10, the gate signal line driving unit includes two sets of gate signal line driving units, the gate signal line driving unit 32*a* and the gate signal line driving unit 32*b*; however, the present disclosure is not limited to this. The gate signal line driving unit includes two sets of gate driver ICs 30 when two gate signal lines are provided for the pixel circuit 12 (FIG. 2, for example). The gate signal line driving unit includes four sets of gate driver ICs 30 when four gate signal lines are provided for the pixel circuit 12 (not illustrated). More specifically, when the number of the gate signal lines provided for the pixel circuit 12 is m (m is an integer not less than one), the gate signal line driving unit includes m sets of gate driver ICs 30 or the gate driver integrated circuit 30.

According to the present embodiment, the period for applying the ON voltage Von is a period of 1H (selecting period for one pixel row) and the period for applying the over-drive voltage Vovd is also a period of 1H (selecting period for one pixel row). In other periods, the OFF voltage Voff is applied to the gate signal line 22.

Figure 11:
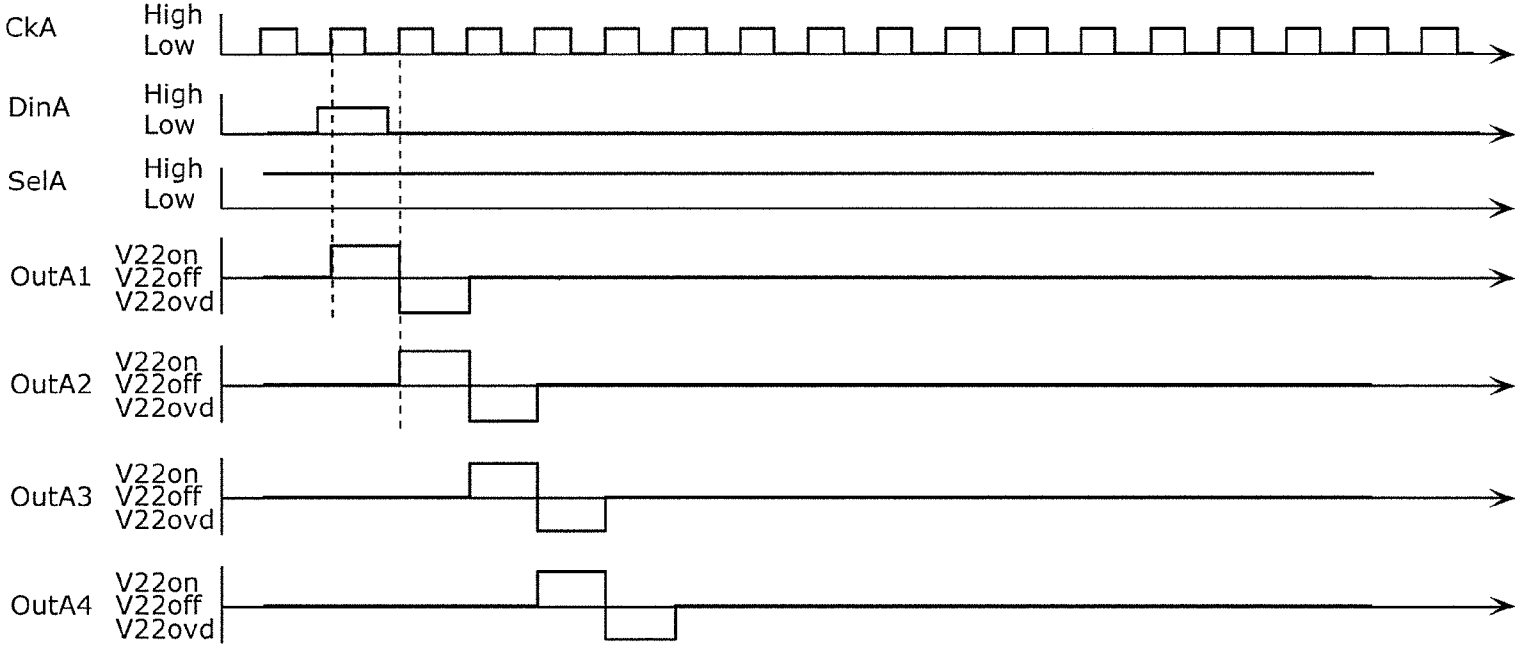
FIG. 11 is a timing chart of a gate signal line illustrating a second example of gate voltage ternary driving.
Figure 12:
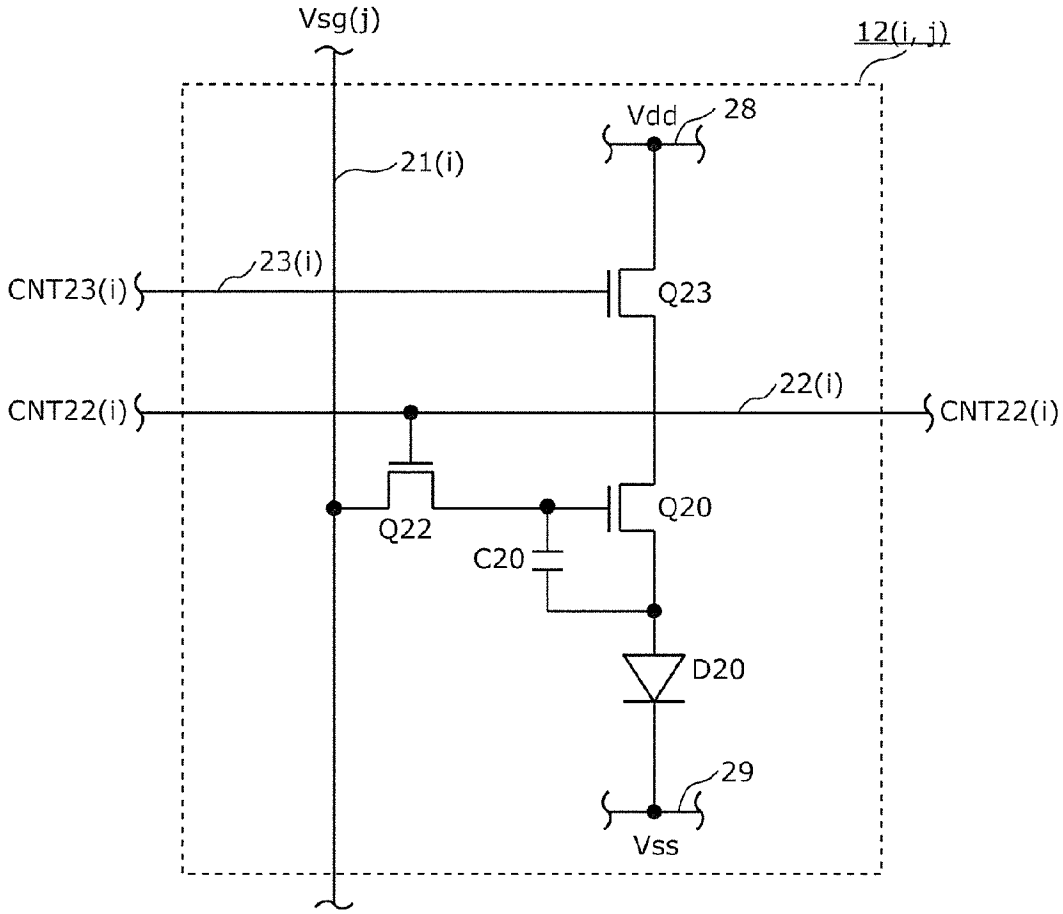
FIG. 12 is a circuit diagram illustrating a pixel circuit of an image display apparatus according to a first modification example of Embodiment 1.

FIG. 11 is a timing chart of a gate signal line illustrating a second example of the gate voltage ternary driving. The transistors are each an N-channel transistor in the timing chart illustrated in FIG. 11, whereas the transistors are each the P-channel transistor in the timing chart illustrated in FIG. 9. For example, FIG. 12 exemplifies the pixel circuit 12. FIG. 12 is a circuit diagram illustrating a pixel circuit of an image display apparatus according to a first modification example of Embodiment 1. The driving sequence as shown in FIG. 11 is equivalent or similar to the driving sequence as shown in FIG. 9, and thus description will be omitted.

Figure 13:
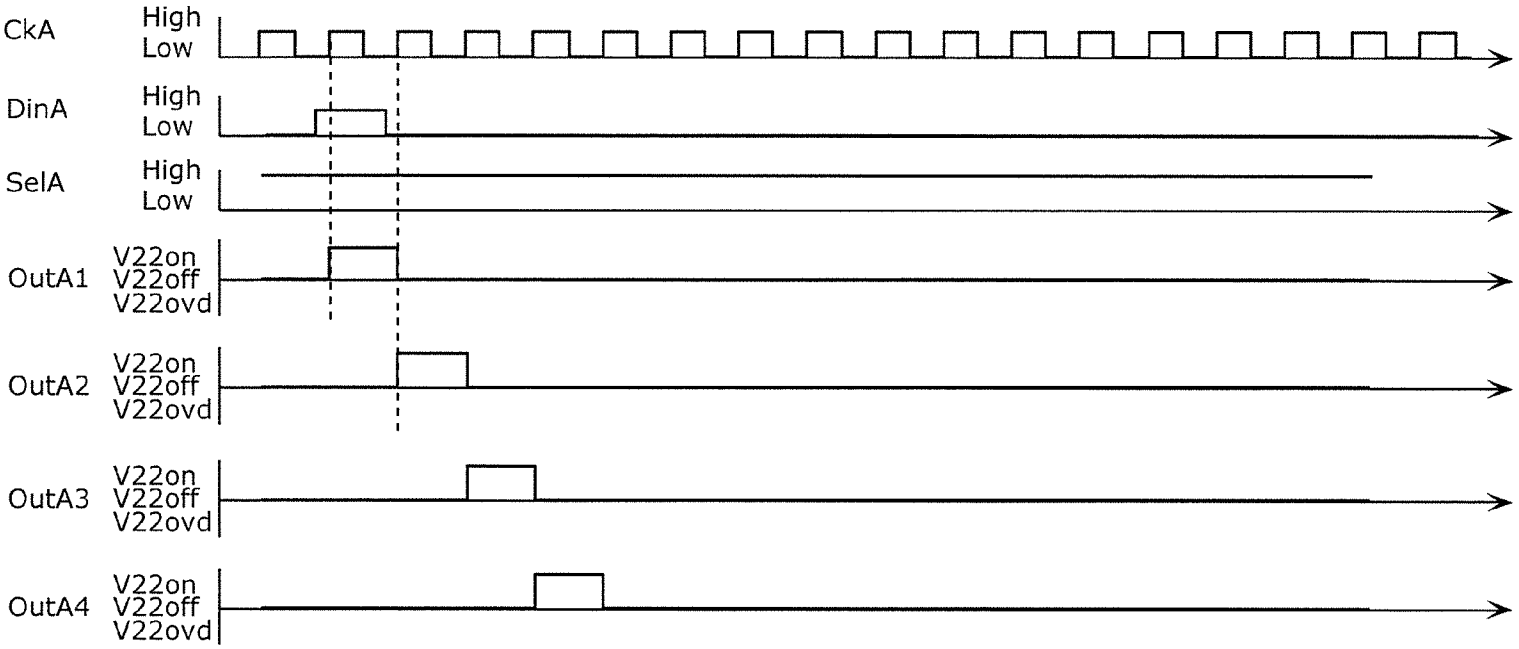
FIG. 13 is a timing chart of a gate signal line illustrating an example of gate voltage binary driving.

FIG. 13 is a timing chart of a gate signal line illustrating an example of the gate voltage binary driving. In the case of the gate voltage binary driving, the terminal Sel (SelA) in FIG. 10 is set at the level "low". However, as illustrated in FIG. 10, a pulldown setting is applied to the terminal Sel by a resistance R or the like in the COF 191 or the gate driver IC 30. In other words, the terminal Sel is set as "low" by default. Accordingly, the gate voltage binary driving is selected even when the terminal Sel is in an open state.

In addition, the voltage Voff is configured so that a common voltage can be applied to the gate signal line driving units 32*a* and 32*b*. Furthermore, the voltage Voff is configured so as to be set by an external power supply of the COF 191 or the gate driver IC 30.

In addition, the voltage Vovd is configured so that a common voltage can be applied to the gate signal line driving units 32*a* and 32*b*. However, since the gate voltage binary driving is applied, the voltage Vovd is not used in driving. However, in terms of the design of the gate driver IC 30, the voltage Vovd is applied according to the IC breakdown voltage or configuration restriction.

It is to be noted that when the transistors are each an N-channel transistor, the voltage Vovd is set so as to be a voltage not higher than the voltage Voff. When the transistors are each the P-channel transistor, the voltage Vovd is set so as to be a voltage not lower than the voltage Voff.

The voltage Von is configured so that a voltage can be applied individually the gate signal line driving units 32*a* and 32*b* (terminals VonA and VonB). Furthermore, the voltage Von is configured so as to be set by an external power supply of the COF 191 or the gate driver IC 30 (see FIG. 30 and FIG. 31, etc. which will be described later). FIG. 13 illustrates a timing chart of the case where the transistors are each the N-channel transistor and the gate voltage binary driving is applied. When the transistors are each the P-channel, the voltage signal waveform illustrated in the timing chart of FIG. 13 is inverted.

Figure 14:
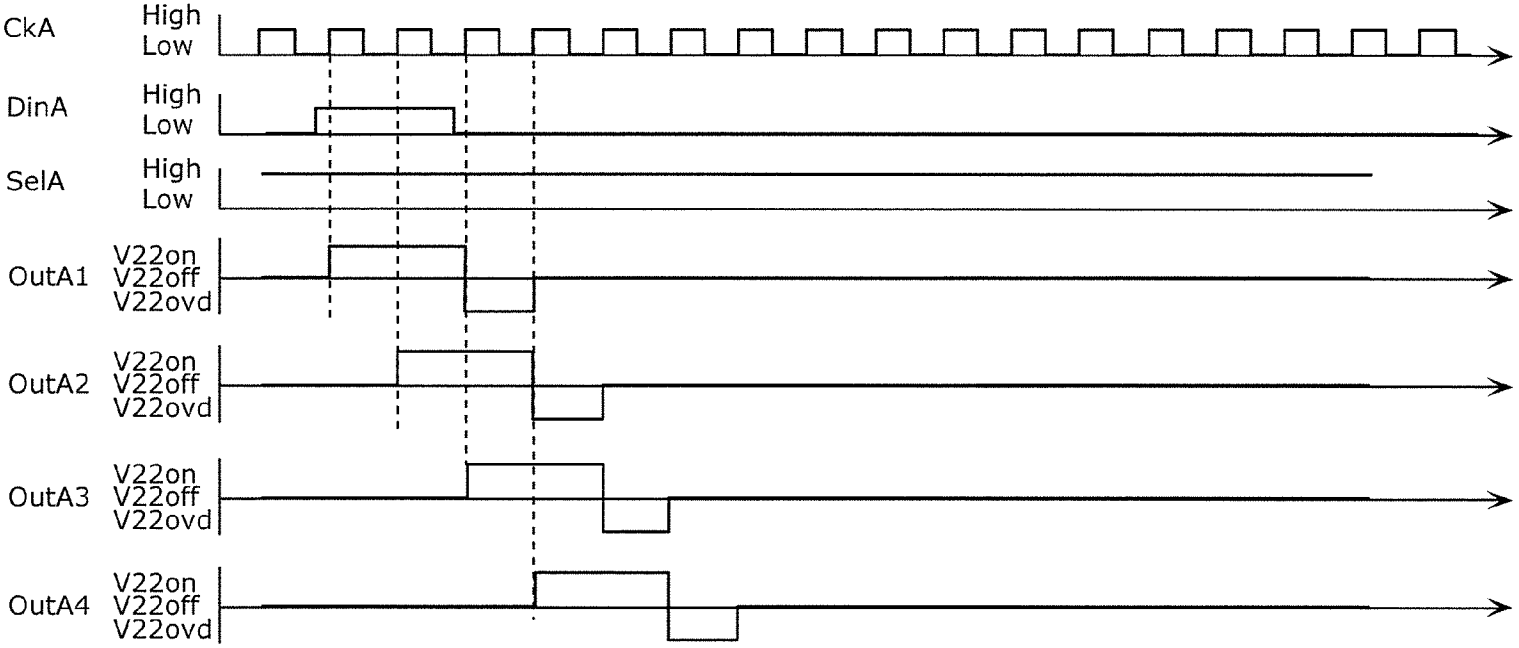
FIG. 14 is a timing chart of a gate signal line illustrating a third example of gate voltage ternary driving.

FIG. 14 is a timing chart of a gate signal line illustrating a third example of the gate voltage ternary driving. The diagram shows the timing chart in the case where the transistors are each the N-channel transistor, and the voltage Von is applied for a period of 2H. The voltage Vovd is applied during the period of 1H without depending on the application period of the voltage Von.

The charge of the capacitance between the gate and the source or the charge of the capacitance between the gate and drain can be discharged in a short amount of time, by applying the gate electrode of the transistor with the over-drive voltage Vovd when switching the transistor from the ON state to the OFF state as described above, and thus it is possible to quickly set the transistor into the OFF state. With this, a variation in an image signal voltage or crosstalk between pixel circuits can be suppressed, and thus it is possible to further suppress luminance gradient, display unevenness, etc.

The reason why the voltage is set again to the voltage Voff after applying the over-drive voltage Vovd for the period of 1H is to prevent a change in the characteristics of the transistor due to an excessive application of the over-drive voltage Vovd for a long period of time to the gate electrode of the transistor.

It is to be noted that the gate voltage ternary driving is performed on the gate signal line to which a transistor that applies a video signal to the pixel circuit is connected, such as the transistor Q 22 illustrated in FIG. 2 or FIG. 12, and the transistor Q122 illustrated in FIG. 44 which will be described later. Furthermore, the gate voltage ternary driving is performed on the gate signal line to which a transistor that applies a voltage to the gate terminal of the driving transistor Q120, such as the transistor Q125 illustrated in FIG. 44 which will be described later.

Figure 15:
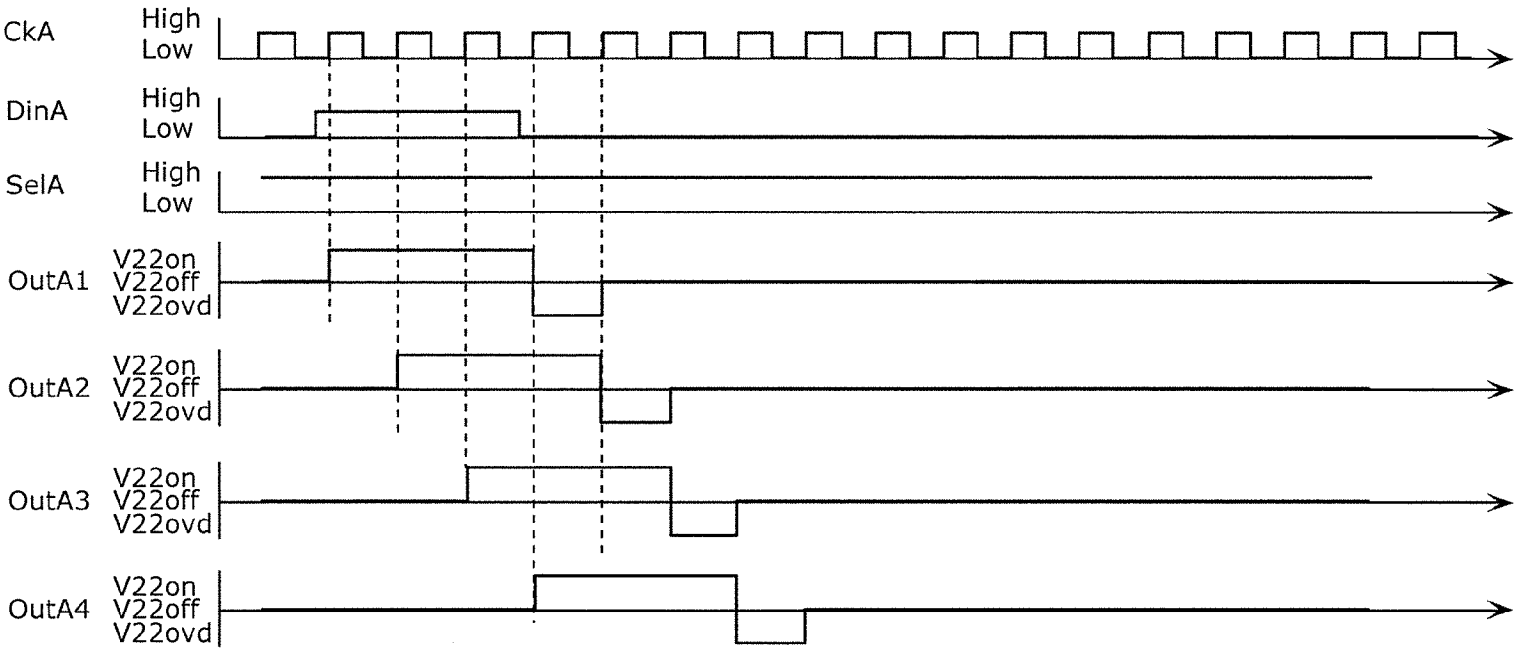
FIG. 15 is a timing chart of a gate signal line illustrating a fourth example of gate voltage ternary driving.

FIG. 15 is a timing chart of a gate signal line illustrating a fourth example of the gate voltage ternary driving. The diagram shows the timing chart in the case where the transistors are each the N-channel transistor, and the voltage Von is applied for a period of 3H. The voltage Vovd is applied during the period of 1H without depending on the application period of the voltage Von. With the period for applying the voltage Von being longer, it is possible to write a video signal voltage sufficiently into the pixel circuit 12 even when the load capacitance of the source signal line 21 is large, or even when the driving capacity of the switching transistor Q12 (FIG. 2) is low.

It is to be noted that, in the timing chart illustrated in each of FIG. 11, FIG. 13, FIG. 14, and FIG. 15, the circuit configuration of the gate signal line driving unit illustrated in FIG. 23 and FIG. 25 which will be described later is applied.

In addition, FIG. 11, FIG. 13, FIG. 14, and FIG. 15 each illustrates an example in the case where the transistor is the N-channel transistor. It should be understood that it is only required to invert the polarity of the voltage amplitude when the transistors are each the P-channel transistor.

The charge of the capacitance between the gate and the source or the charge of the capacitance between the gate and drain can be discharged in a short amount of time, by applying the gate electrode of the transistor with the over-drive voltage Vovd when switching the transistor from the ON state to the OFF state as described above, and thus it is possible to quickly set the transistor into the OFF state. In addition, it is possible to successfully apply the video signal voltage to the pixel circuit, by setting the application period of the voltage Von as two or more H periods.

It should be understood that the gate signal line driving unit illustrated in FIG. 21 etc., which will be described later, can be applied to the above-described ternary driving. However, the relationship between the clock CK, Din, and Out needs naturally to be adapted to the circuit configuration, etc. illustrated in FIG. 21 which will be described later.

Figure 16:
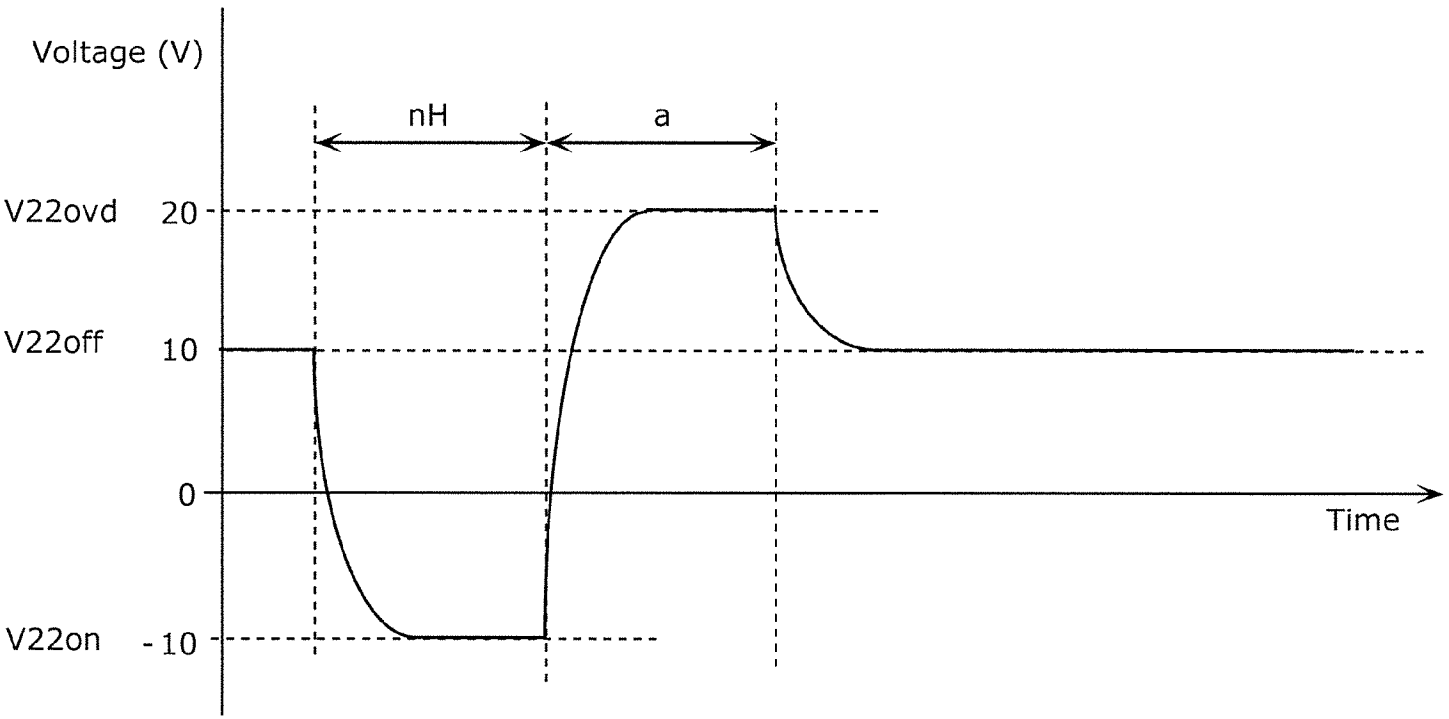
FIG. 16 is a driving waveform illustrating the details of a write controlling signal of the image display apparatus according to Embodiment 1.

FIG. 16 illustrates a driving waveform showing details of the write controlling signal CNT22(*i*) of the image display apparatus 10 according to Embodiment 1.

The voltages are as follows in the present embodiment: the voltage V22on=−10V; the voltage V22off=10V; and the voltage V22*ovd*=20V. In this case, a turned OFF time of the transistor Q22 is approximately 1.5 μs. Furthermore, when the gate voltage binary driving is performed in this case, the turned OFF time of the transistor Q22 is approximately 4.2 μs.

As described above, the charge of the capacitance between the gate and the source or the charge of the capacitance between the gate and drain can be discharged in a short amount of time, by applying the gate with the over-drive voltage V22*ovd* when switching the transistor Q22 from the ON state to the OFF state as described above, and thus it is possible to quickly set the transistor Q22 into the OFF state. With this, a variation in an image signal voltage or crosstalk between pixel circuits can be suppressed, and thus it is possible to further suppress luminance gradient, display unevenness, etc.

It is to be noted that the reason why the write controlling signal CNT22(*i*) is reset to the voltage V22off after the over-drive voltage V22*ovd* is applied for a predetermined time period is to prevent a change in the characteristics of the transistor Q22 due to an excessive application of the over-drive voltage V22*ovd* for a long period of time to the gate of the transistor Q22.

In addition, the time period for which the voltage V22on is applied is not limited to the one horizontal scanning period (1H: the selecting period for one pixel row). As illustrated in FIG. 16, the time period for which the voltage V22on is applied may be a period of nH (n is an integer not less than one). With the value n being set as two or more, it is possible to sufficiently apply the image signal voltage to each of the pixel rows even when the load capacitance of the gate signal line 22(*i*) is large.

In addition, the period a is a period of 1H or shorter. This is for the purpose of preventing a change in the characteristics of the transistor Q22 due to an excessive application of the over-drive voltage V22*ovd* for a long period of time to the gate of the transistor Q22.

Meanwhile, the display controlling signal CNT23(*i*) performs the gate voltage binary driving during the display period Td. Accordingly, the voltage applied to the gate signal line 23 changes from Von to Voff, and the change is relatively slow. However, the rounding of the voltage waveform of the display controlling signal CNT23(*i*) delays only slightly the start and the end of the display operation of the pixel circuits, and thus image display quality does not decrease.

For the same reason, the display controlling signal CNT23(*i*) does not require the gate voltage ternary driving.

Next, the first gate driving circuit 14 and the second gate driving circuit 15 will be described in detail. The write controlling signals CNT22(1) to CNT22(*n*) each have a voltage waveform having the voltage V22on, the voltage V22*ovd*, and the voltage V22off as illustrated in FIG. 8, and it is possible to generate the write controlling signals CNT22(2) to CNT22(*n*) by sequentially shifting the write controlling signal CNT22(1).

Furthermore, the display controlling signals CNT23(1) to CNT23(*n*) each have a voltage waveform having the voltage V23on and the voltage V23off, and it is possible to generate the display controlling signals CNT23(2) to CNT23(*n*) by sequentially shifting the display controlling signal CNT23(1).

For that reason, the first gate driving circuit 14 and the second gate driving circuit 15 can each include: shift register units each having a length corresponding to at least the same number of the pixel circuit rows included in the image display panel 11 and shifting and outputting a digital signal per clock input; and voltage outputting units each can convert an output from each of the shift register units into a control signal having a predetermined voltage and an amplitude, and also can apply, for a predetermined period, an over-drive voltage which has an amplitude exceeding at least one of rising and falling of the control signal. It is to be noted that in the present application, "length of the shift register unit" can also be referred to as "the number of stages of the shift register units".

The gate signal line 22(*i*) is supplied with the write controlling signal CNT22(*i*) resulting from applying an over-drive voltage for a predetermined period to a selected one of three voltages, i.e., the voltage V22on, the voltage V22*ovd*, and the voltage V22off, and the gate signal line 23(*i*) is supplied with the display controlling signal CNT23 (*i*) which is a selected one of two voltages, i.e., the voltage V23on and the voltage 23off without applying the over-drive voltage.

FIG. 1 and FIG. 2 each illustrate an example in which the bilateral driving is performed on the gate signal lines 22(*i*) and 23(*i*). However, the gate signal line 23(*i*) is a signal line to which a signal for turning ON or OFF the switching transistor Q23 is applied. Accordingly, the switching transistor Q23 does not require a high slew rate operation. Thus, the gate signal line 23(*i*) may be driven by the unilateral driving. The following describes a configuration of the image display apparatus in which the unilateral driving is applied to the gate signal line 23(*i*).

Figure 17:
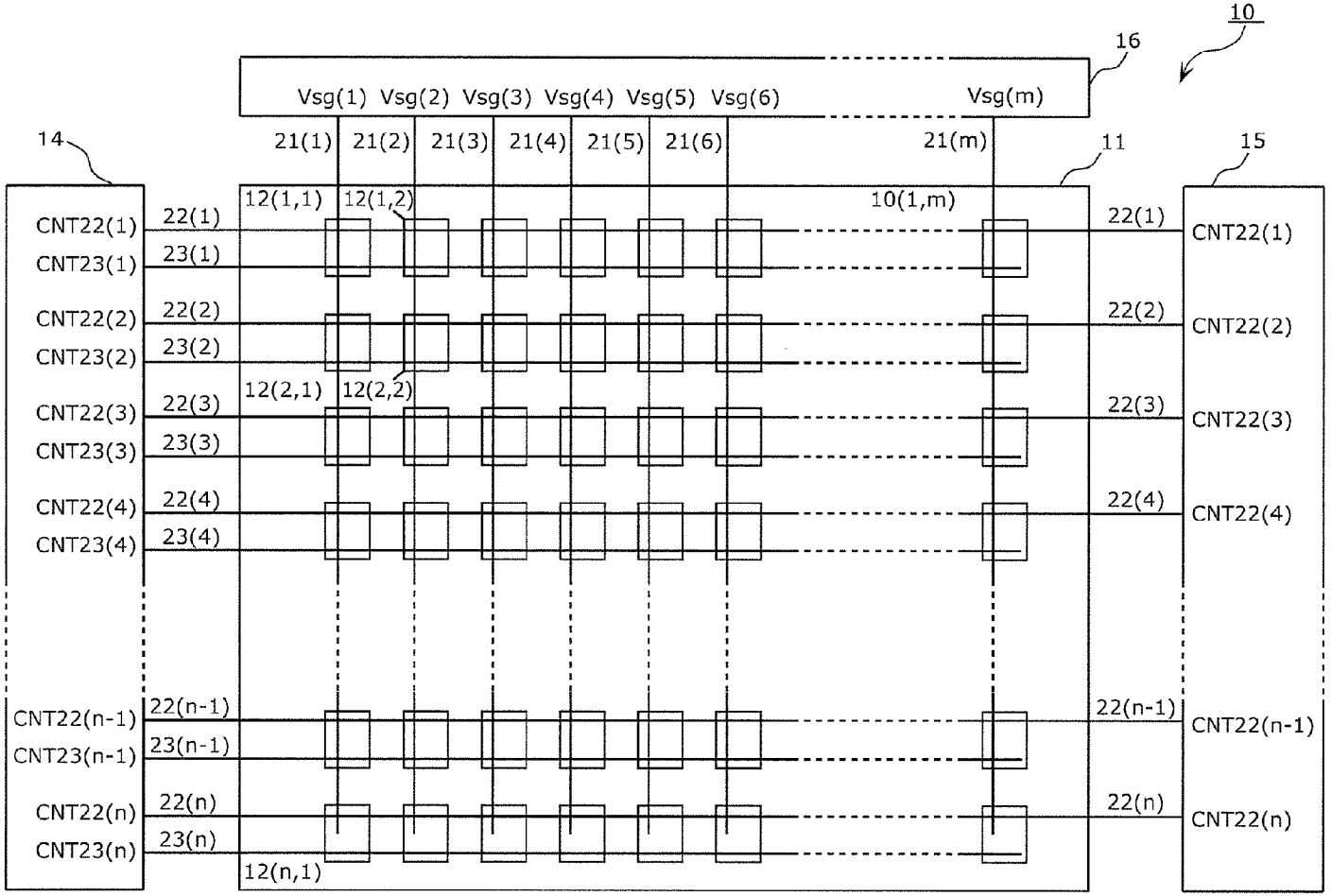
FIG. 17 is a schematic diagram illustrating a configuration of an image display apparatus according to a second modification example of Embodiment 1.

FIG. 17 is a schematic diagram illustrating a configuration of an image display apparatus according to a second modification example of Embodiment 1.

The gate signal lines 22(*i*) are each drawn from the left side of the image display panel 11 and connected to the first gate driving circuit 14, and also drawn from the right side of the image display panel 11 and connected to the second gate driving circuit 15, in FIG. 17. In contrast, the gate signal lines 23(*i*) are each drawn from the left side of the image display panel 11 and connected to the first gate driving circuit 14, in FIG. 17.

As described above, in the image display panel 11 according to the present embodiment, the gate signal lines 22(*i*) and the gate signal lines 23(*i*) are connected in common to the pixel circuits 12(*i*, 1) to 12(*i, m*) arranged in the row direction.

The gate signal lines 22(*i*) each are drawn from the both sides of the image display panel 11, have one end connected to the first gate driving circuit 14 and the other end connected to the second gate driving circuit 15. Accordingly, the bilateral driving is applied to the gate signal lines 22(*i*). The bilateral driving is applied to the gate signal lines 23(*i*).

Figure 18:
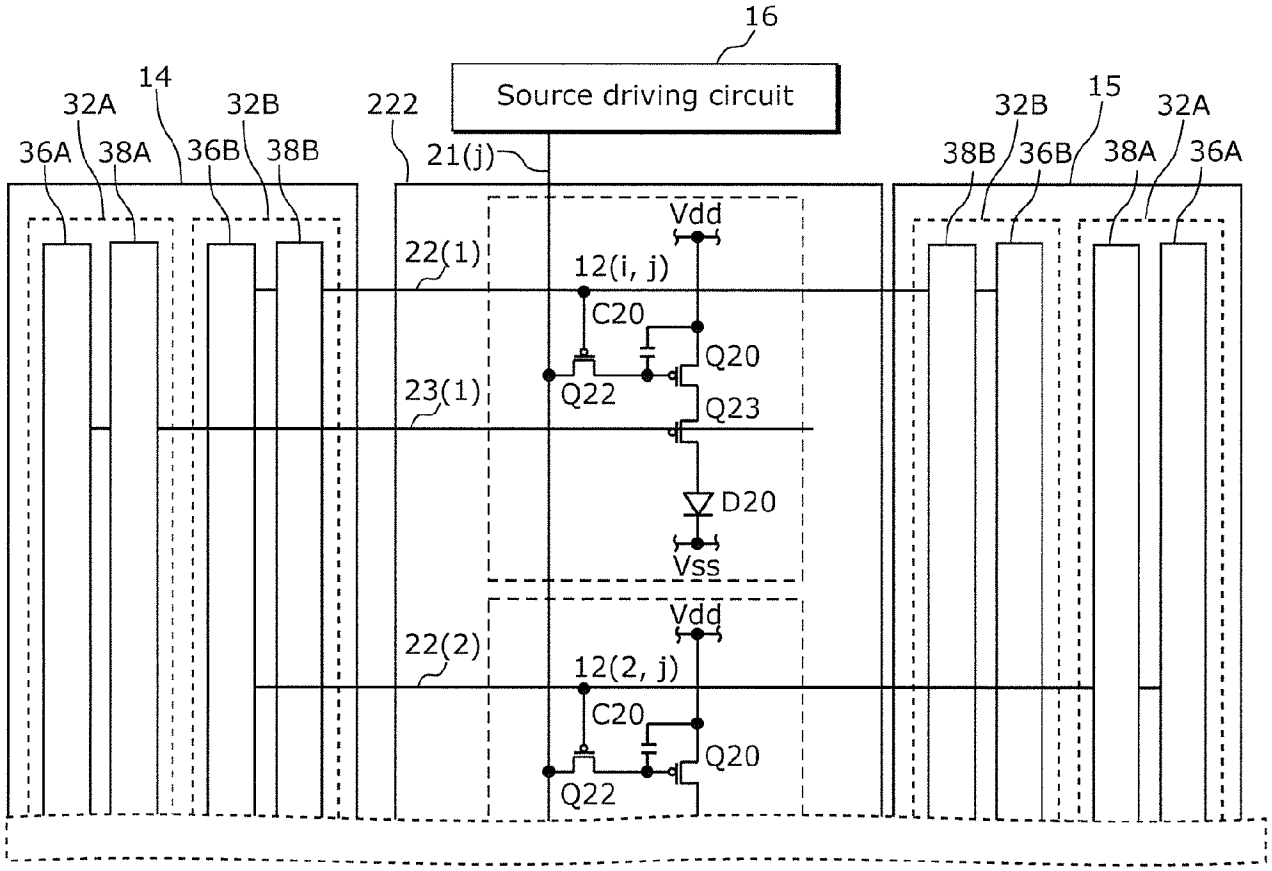
FIG. 18 is a diagram illustrating a connection state between the gate driving circuits and the pixel circuits according to the second modification example of Embodiment 1.

FIG. 18 is a diagram illustrating a connection state between the gate driving circuits and the pixel circuits according to the second modification example of Embodiment 1. FIG. 18 is a diagram illustrating a connection state between the gate driving circuits and the pixel circuit 12 as with FIG. 3. Each of the gate driving circuits includes two gate signal line driving units. The first gate driving circuit 14 and the second gate driving circuit 15 each drive the gate signal lines 22, and the first gate driving circuit 14 further drives the gate signal lines 23.

The gate signal line driving unit 32A of the first gate driving circuit 14 and the gate signal line driving unit 32A of the second gate driving circuit 15 drive the gate signal lines 23(*i*). The gate signal line driving unit 32B of the first gate driving circuit 14 drives the gate signal lines 22(*i*).

The gate signal lines 23(*i*) are each a signal line to which a signal for turning ON or OFF the switching transistor Q23 is applied. Accordingly, the switching transistor Q23 does not require a high slew rate operation. Thus, the gate signal lines 23(*i*) may be driven by the unilateral driving.

The first gate driving circuit 14 disposed on the left side drives all of the gate signal lines formed on the display panel 11, whereas the second gate driving circuit 15 disposed on the right side drives half of the gate signal lines disposed on the display panel 11. Accordingly, the number of the second gate driving circuits 15 disposed on the right side may be half the number of the first gate driving circuits 14 disposed on the left side. For the reasons described above, with the image display apparatus illustrated in FIG. 18, it is possible to realize more cost reduction compared to the image display apparatus illustrated in FIG. 1.

Figure 19:
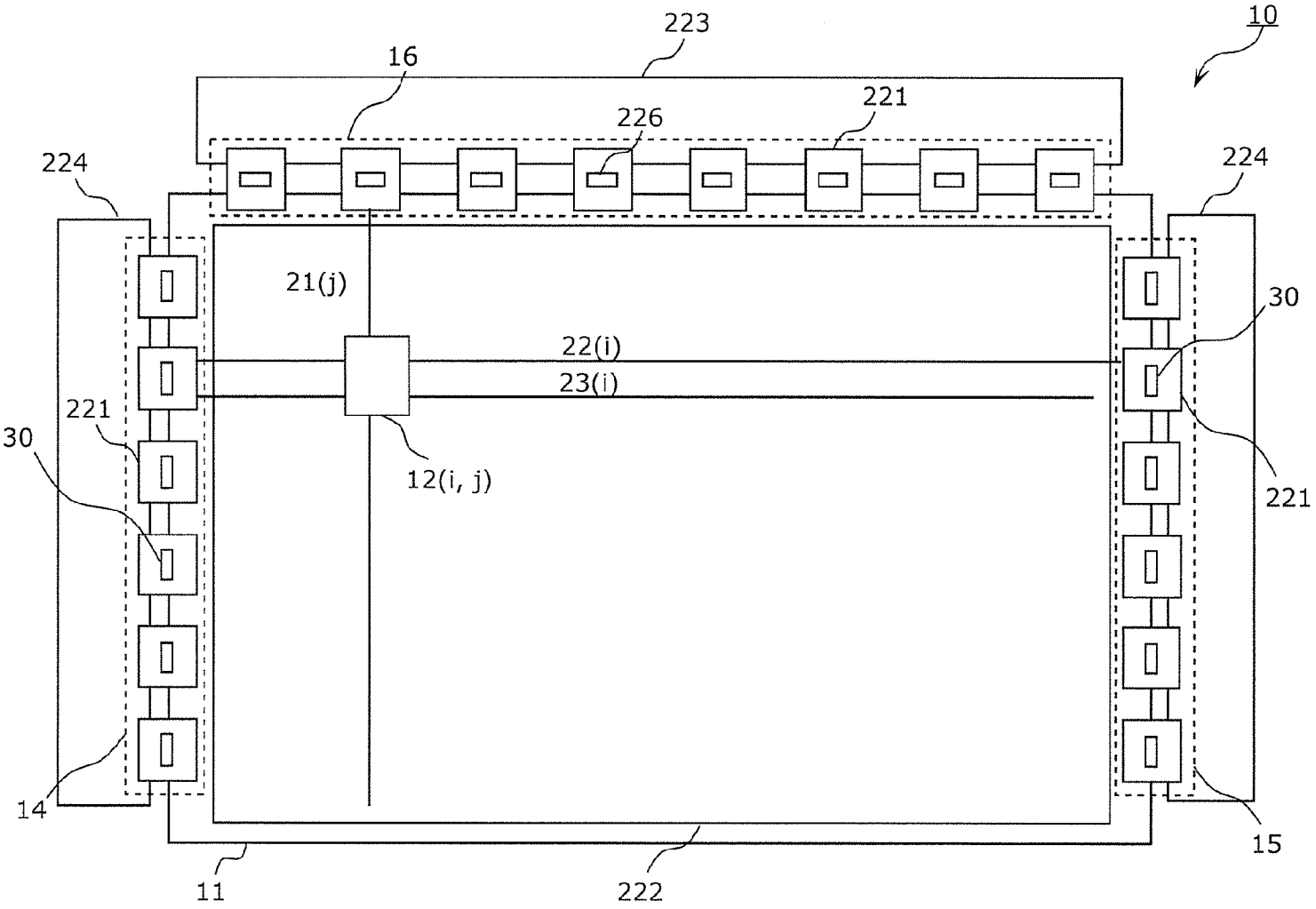
FIG. 19 is a diagram illustrating an arrangement relationship between an image display panel, the gate driving circuits, a source driving circuit, etc according to the second modification example of Embodiment 1.

FIG. 19 is a diagram showing an arrangement relationship between the image display panel, the gate driving circuits, the source driving circuit, etc. according to the second modification example. More specifically, FIG. 19 is a schematic diagram showing the image display panel in the case where the bilateral driving is applied to the gate signal lines 22(*i*), and the unilateral driving is applied to the gate signal lines 23(*i*). FIG. 19 is the same as FIG. 4 other than the connecting state of the gate signal lines, the number of the gate driver ICs disposed on the right and left sides, etc., and thus description will be omitted.

According to the present embodiment, the gate driving circuits are integrated as a single monolithic IC, by grouping, per plural outputs, circuits each including a combination of the shift register unit and the voltage outputting unit. In the following description, the IC is referred to as a gate driver integrated circuit or a gate driver IC. In addition, the circuit including the combination of the shift register unit and the voltage outputting unit is referred to as a gate signal line driving unit.

In the following description, it is assumed that the number of the pixels in the row direction of the image display panel 11 is n=128 for the purpose of illustration. It is also assumed that the gate signal line driving units each having 64-pixel outputs are integrated for two circuits in a single gate driver integrated circuit. However, the number of the pixels in the row direction of the image display panel 11, the number of the gate signal line driving units of the gate driving circuit, and the number of the outputs thereof, according to the present disclosure are not limited to those described above.

Figure 20:
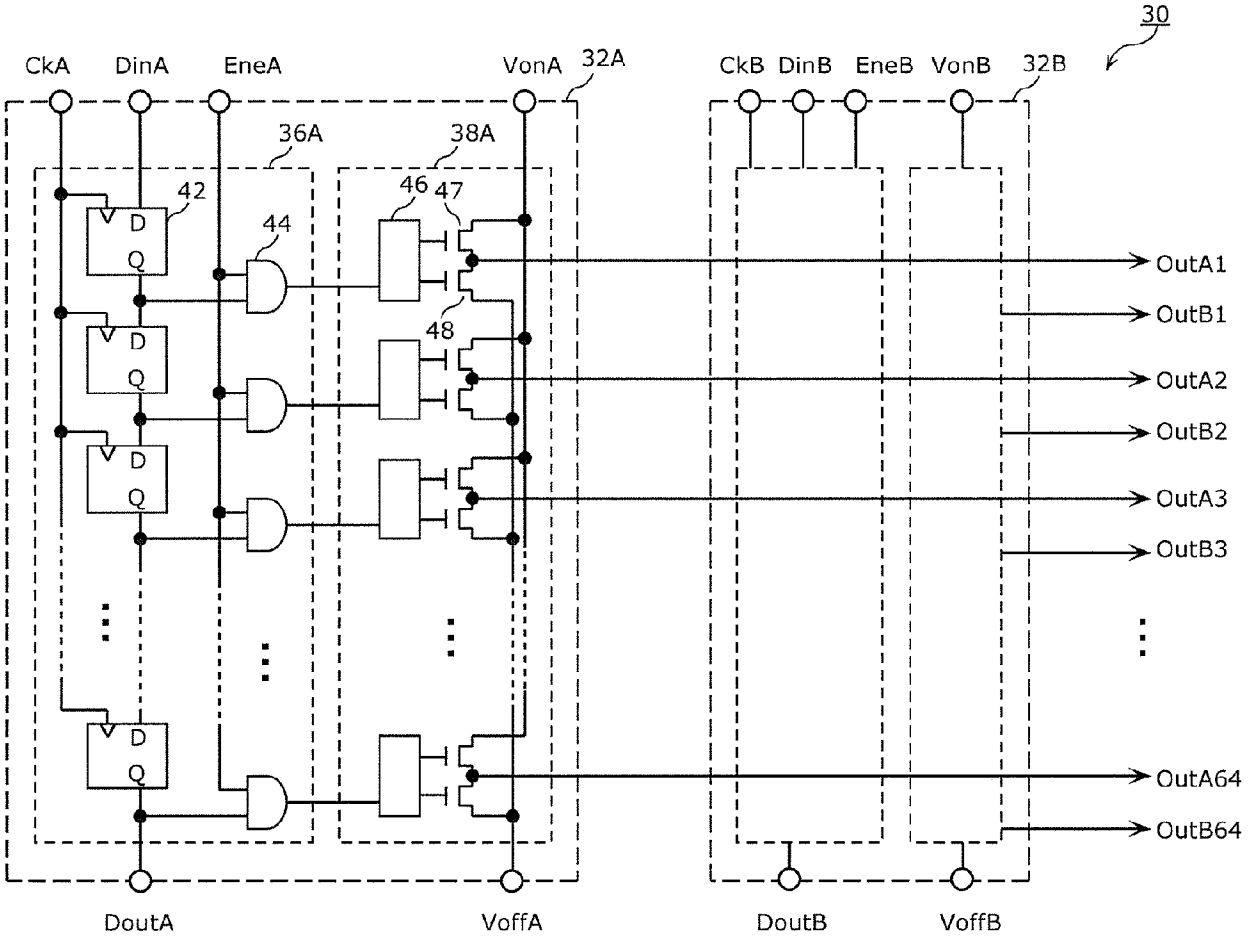
FIG. 20 is a circuit diagram of a gate driver integrated circuit of the image display apparatus according to Embodiment 1.

FIG. 20 is a circuit diagram of a gate driver integrated circuit 30 of the image display apparatus according to Embodiment 1. The gate driver integrated circuit 30 includes two gate signal line driving units 32A and 32B. The gate signal line driving unit 32A includes a shift register unit 36A and a voltage outputting unit 38A.

The shift register unit 36A includes 64 D-type flip-flops 42, and 64 AND gates 44 provided on a one-to-one basis to the outputs of the D-type flip-flops 42.

Each of the clock terminals of the D-type flip-flops 42 is connected to the clock input terminal CkA of the gate driver integrated circuit 30. The 64 D-type flip-flops 42 are connected in a cascade arrangement, a data terminal of the D-type flip-flop 42 at the top is connected to a data input terminal DinA of the gate driver integrated circuit 30, and an output terminal of the D-type flip-flops 42 at the end is connected to a data output terminal DoutA of the gate driver integrated circuit 30. One of the input terminals of each of the AND gates 44 is connected to the output terminal of a corresponding one of the D-type flip-flops 42, and the other is connected to an enable input terminal EneA of the gate driver integrated circuit 30.

The shift register unit 36A sequentially shifts, per clock, a digital signal supplied to the data input terminal DinA, and outputs the digital signal from the output terminal of each of the D-type flip-flops 42. At this time, when the enable input terminal EneA is at a high level, the output of each of the D-type flip-flops 42 is output from a corresponding one of the AND gates 44. In addition, when the enable input terminal EneA is at a low level, a low level voltage is output from all of the AND gates 44 irrespective of the output of the D-type flip-flops 42.

The voltage outputting unit 38A includes: 64 transistor control unit 46; 64 transistors 47; 64 transistors 48; and 64 transistors 49. The transistor control units 46 each generates a signal for turning ON or OFF the transistors 47 and 48 based on the output from a corresponding one of the AND gate outputs 44, and shifts a level of the generated signal to a voltage that matches each of the transistors 47 and 48. According to the present embodiment, the transistor 47 is the P-channel transistor and the transistor 48 is the N-channel transistor.

Figure 21:
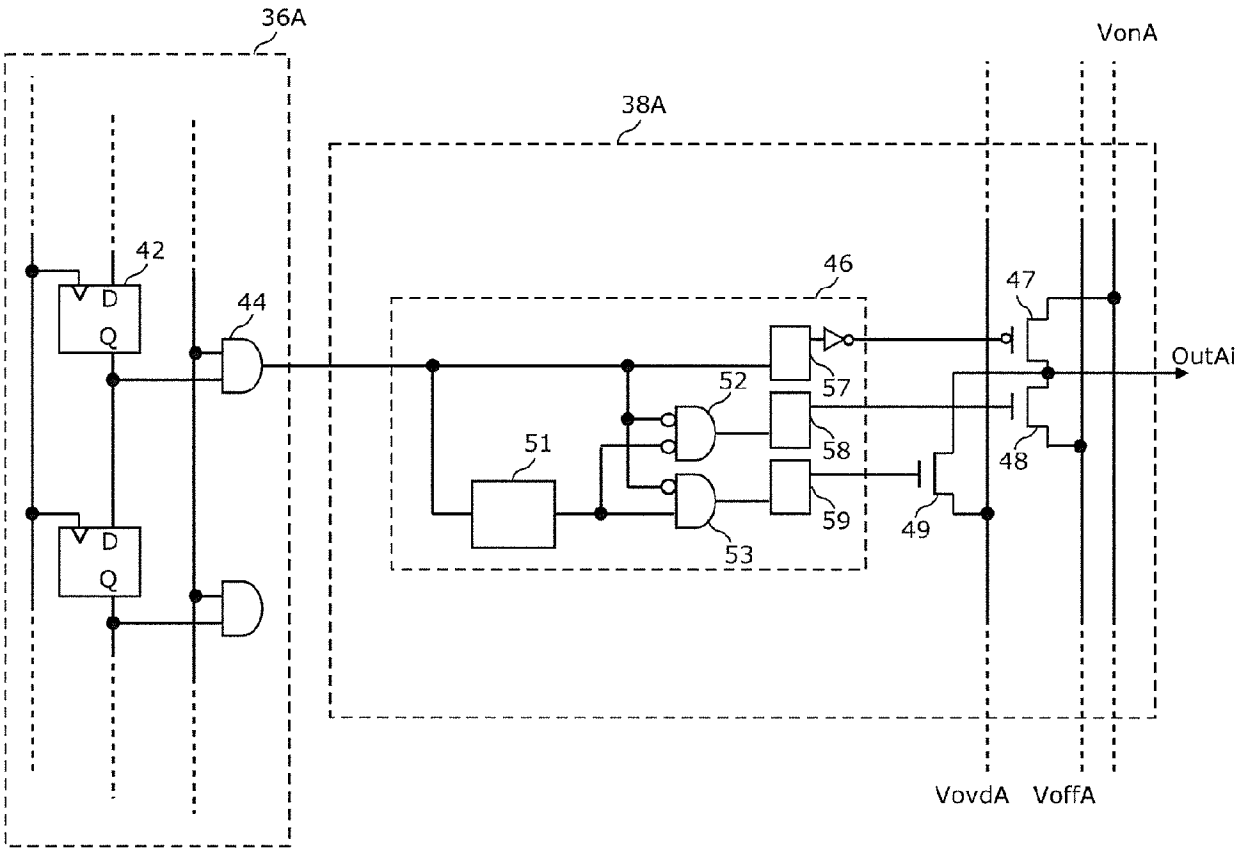
FIG. 21 is a circuit diagram of a transistor control unit of the image display apparatus according to Embodiment 1.
Figure 22:
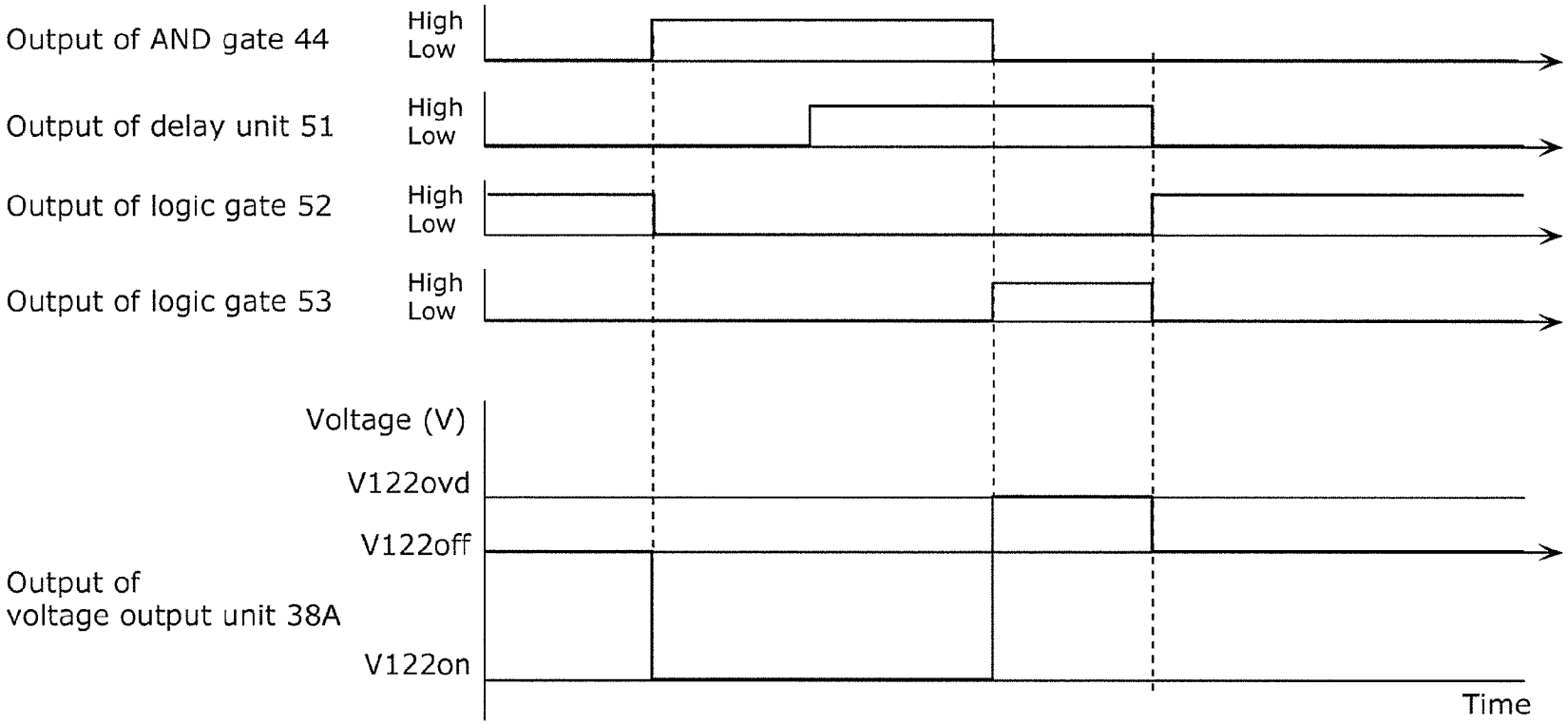
FIG. 22 is a timing chart showing an operation of the transistor control unit of the image display apparatus according to Embodiment 1.

FIG. 21 illustrates a circuit diagram of each of the transistor control units 46 of the image display apparatus 10 according to Embodiment 1. FIG. 22 is a timing chart illustrating an operation of the transistor control unit 46. The transistor control units 46 each include: a delay unit 51; a logic gate 52; a logic gate 53; and level shift units 57 to 59.

The delay unit 51 includes, for example, a D-type flip-flop, and delays an output of a corresponding one of the AND gates 44 by a predetermined time period based on a predetermined clock (not illustrated). The logic gate 52 outputs a high level voltage when the output of the corresponding one of the AND gates 44 and the output of the delay unit 51 are both at a low level. The logic gate 53 outputs a high level voltage when the output of the corresponding one of the AND gates 44 is at a low level and the output of the delay unit 51 is at a high level.

The level shift unit 57 shifts the level of the output of the corresponding AND gate 44 to a voltage that matches the transistor 47, the level shift unit 58 shifts the level of the output of the logic gate 52 to a voltage that matches the transistor 48, and the level shift unit 59 shifts the level of the output of the logic gate 53 to a voltage that matches the transistor 49. It is to be noted that, according to the present embodiment, the transistor 47 is the P-channel transistor, and thus the level shift unit 57 is a level shifter of an inverter type.

Transistor 47 is a transistor which operates as a switch and includes (i) one terminal connected to a power supply terminal VonA of the gate driver integrated circuit 30 and (ii) the other terminal connected to an output terminal OutAi ($1 \leq i \leq 64$) of the gate driver integrated circuit 30. The transistors 48 is also a transistor which operates as a switch and includes (i) one terminal connected to a power supply terminal VoffA of the gate driver integrated circuit 30 and (ii) the other terminal connected to an output terminal OutAi of the gate driver integrated circuit 30. The transistors 49 is also a transistor which operates as a switch and includes (i) one terminal connected to a power supply terminal VovdA of the gate driver integrated circuit 30 and (ii) the other terminal connected to an output terminal OutAi of the gate driver integrated circuit 30.

The transistor 47 is turned ON and the transistors 48 and 49 are turned OFF, thereby selecting and outputting a voltage of the power supply terminal VonA. The transistor 48 is turned ON and the transistors 47 and 49 are turned OFF, thereby selecting and outputting a voltage of the power supply terminal VoffA. The transistor 49 is turned ON and the transistors 47 and 48 are turned OFF, thereby selecting and outputting a voltage of the power supply terminal VovdA.

Accordingly, it is possible to perform the gate voltage ternary driving by setting the voltage of the power supply terminal VovdA at the voltage V22*ovd*. It is thus possible to apply, for a predetermined time period, the over-drive voltage V22*ovd* which has an amplitude exceeding the voltage (V22on−V22off) at rising or falling of the write controlling signal CNT22(*i*).

Meanwhile, it is possible to perform the gate voltage binary driving by setting the voltage of the power supply terminal VovdA to the same voltage as the power supply terminal VoffA. In other words, it is possible to generate a control signal which does not apply the over-drive voltage. Alternatively, the gate voltage ternary driving can also be performed by resetting the delay unit 51 to fix the output at the low level. Switching between the gate voltage ternary driving and the gate voltage binary driving may be, of course, performed by a dedicated control terminal.

The gate signal line driving unit 32B has the same configuration as the gate signal line driving unit 32A, and thus detailed description will be omitted. However, the gate signal line driving unit 32B includes: a clock input terminal CkB; a data input terminal DinB; a data output terminal DoutB; an enable input terminal EneB; a power supply terminal VonB; a power supply terminal VoffB; a power supply terminal VovdB; and output terminals OutB1 to OutB64, which respectively correspond to: the clock input terminal CkA; the data input terminal DinA; the data output terminal DoutA; the enable input terminal EneA; the power supply terminal VonA; the power supply terminal VoffA; the power supply terminal VovdA; and the output terminals OutA1 to OutA64, which are included in the gate signal line driving unit 32A.

As described above, the gate driver integrated circuit 30 according to the present embodiment includes: the clock input terminals CkA and CkB; the enable input terminals EneA and EneB; and the data input terminals DinA and DinB, which are independent of each other, and integrally includes the shift register units each having the length corresponding to half or smaller than the number of pixel circuit rows included in the image display panel, and the voltage output units each convert an output from each of the shift register units into a control signal having a predetermined voltage and an amplitude, and also apply, for a predetermined time period, an over-drive voltage which has an amplitude exceeding at least one of rising and falling of the control signal. The first gate driving circuit 14 and the second gate driving circuit 15 each include a plurality of the gate driver integrated circuits.

It is to be noted that the transistor control unit 46 illustrated in FIG. 21 generates the Vovd voltage using the delay unit 51. However, the circuit system for implementing the gate voltage ternary driving according to the present disclosure is not limited the one illustrated in FIG. 21. For example, FIG. 23 illustrates an example.

Figure 23:
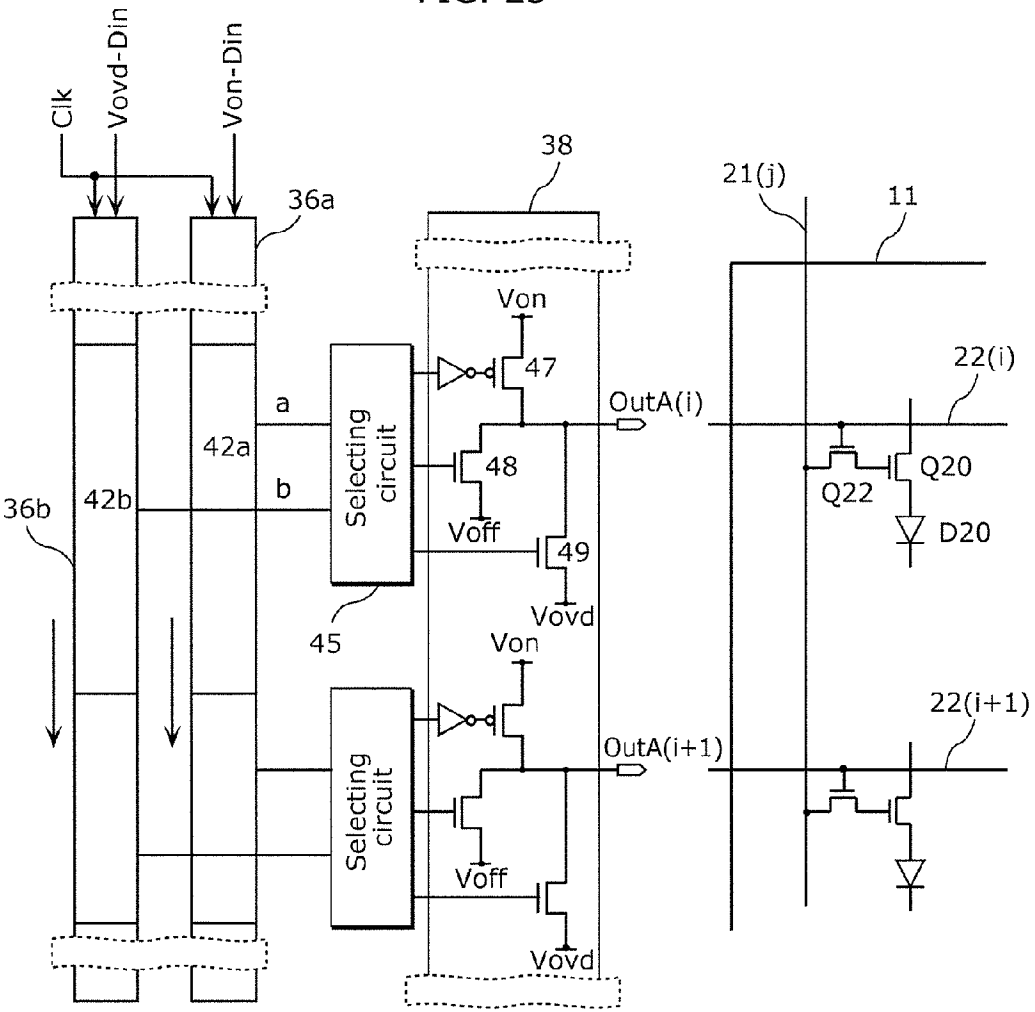
FIG. 23 is a circuit diagram of the transistor control unit of the image display apparatus according to a third modification example of Embodiment 1.

FIG. 23 illustrates a pixel circuit of a transistor control unit of an image display apparatus according to a third modification example of Embodiment 1. The shift register unit includes a shift register circuit 36*a* and a shift register circuit 36*b*. The shift register circuits 36*a* and 36*b* are supplied with the same clock Clk. The shift register circuit

36*a* is supplied with data Vovd-Din indicating the position of a pixel row to which an over-drive voltage Vovd is applied. The shift register circuit 36*b* is supplied with data Von-Din indicating the position of a pixel row to which an ON voltage Von is applied. Other elements have been described with reference to FIG. 1, FIG. 2, FIG. 4, FIG. 18, FIG. 20, FIG. 21, etc., and thus description will be omitted.

When an output of the D-type flip-flop 2*a* included in the shift register circuit 36*a* is a, and an output of the D-type flip-flop 42*b* included in the shift register circuit 36*b* is b, the selecting circuit 45 performs an operation illustrated in FIG. 24. FIG. 24 is a diagram showing voltages selected by the selecting circuit 45.

It is to be noted that the selecting circuit 45 is a logic circuit included in a 2-3 decoder. Three outputs are varied by the input a or b, to control ON or OFF of the transistors (47, 48, and 49) etc. connected to the outputs. One of the voltage Von, the voltage Voff, and the voltage Vovd is selected in response to the ON or OFF control on the transistors (46, 47, and 48), and the terminal OutA outputs a voltage to the gate signal line 22(23). As illustrated in FIG. 24, a voltage is selected according to the inputs a and b.

For example, when the input a=0 (low level) and the input b=0 (low level), the OFF voltage Voff is output from the terminal OutA. When the input a=0 (low level) and the input b=1 (high level), the OFF voltage Vovd is output from the terminal OutA. When the input a=1 (high level) and the input b=0 (low level), the ON voltage Von is output from the terminal OutA. When the input a=1 (high level) and the input b=1 (high level), the ON voltage Von is output from the terminal OutA.

With the configuration illustrated in FIG. 23, it is possible to perform the gate voltage ternary driving without the delay unit 51. In addition, the voltage Vovd can be set in synchronization with the clock Clk per 1H (the selecting period for one pixel row). In addition, the voltage Von and the voltage Voff can be set per 1H (one clock unit) according to the data supplied to the terminals Vovd-Din and Von-Din. For example, it is possible to easily set the voltage Von to nH (n is an integer not less than one).

Figure 25:
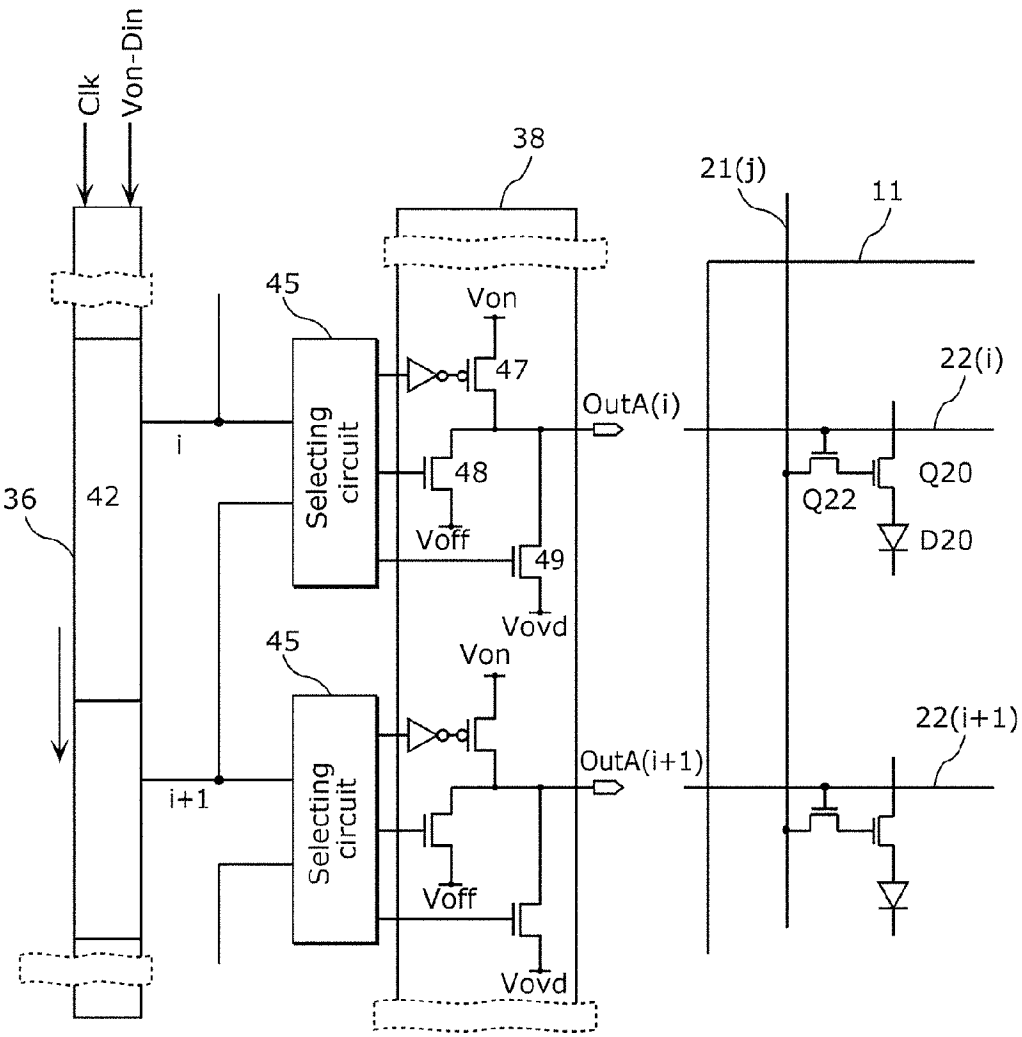
FIG. 25 is a circuit diagram of the transistor control unit including a single shift register circuit.

FIG. 25 is a circuit diagram of the transistor control unit including a single shift register circuit. The shift register unit includes a single shift register circuit 36 as illustrated in the diagram. The shift register circuit 36 is supplied with the clock Clk. The shift register circuit 36 is supplied with data Von-Din indicating the position of a pixel row to which an ON voltage Vovd is applied. Other elements have been described with reference to FIG. 1, FIG. 2, FIG. 4, FIG. 18, FIG. 20, FIG. 21, etc., and thus description will be omitted.

Figure 26:
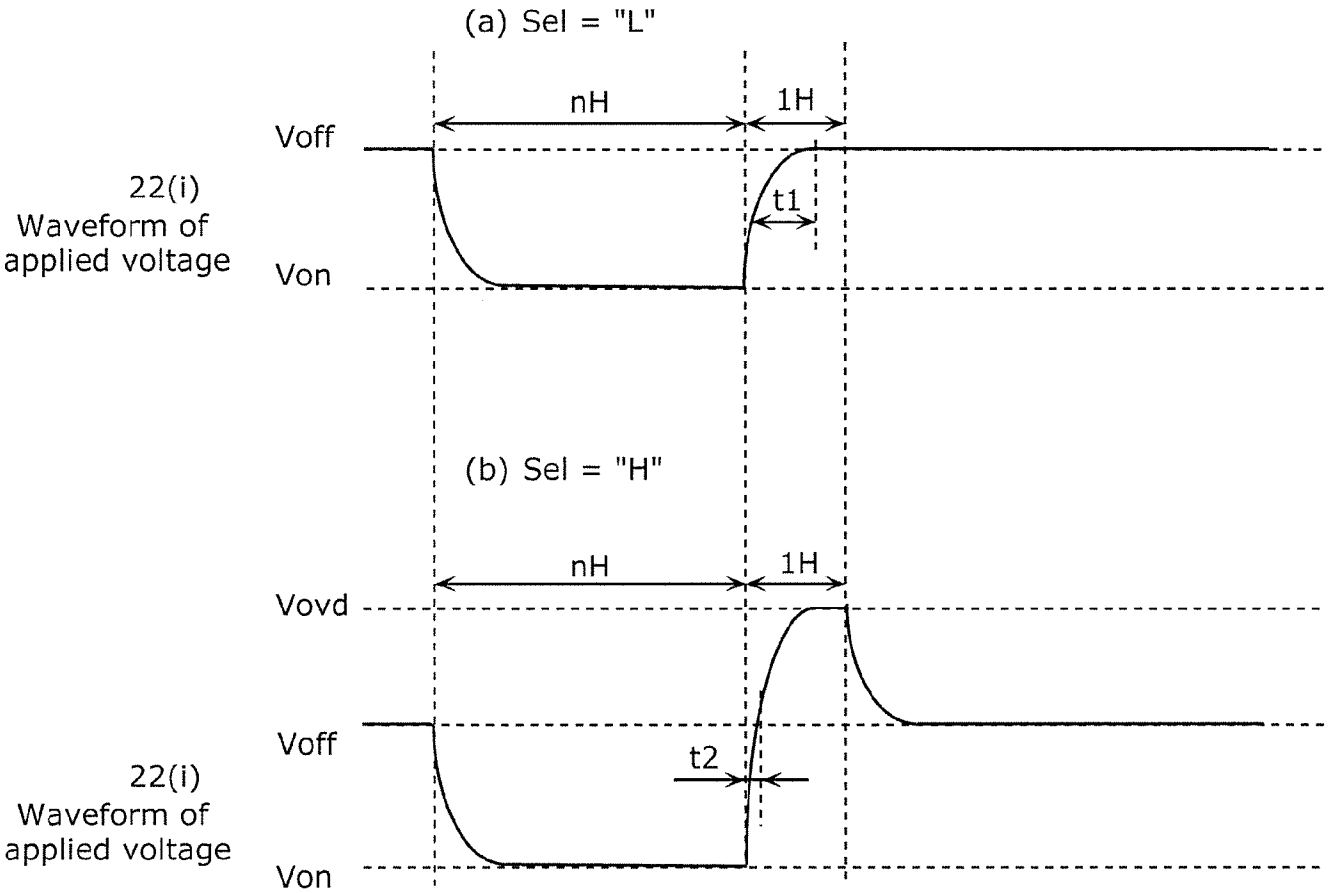
FIG. 26 is a driving waveform illustrating the details of a write controlling signal of the image display apparatus according to Embodiment 1.

FIG. 26 is a driving waveform diagram illustrating the details of a write controlling signal of the image display apparatus according to Embodiment 1. As illustrated in (b) in FIG. 26, in the gate voltage ternary driving, the voltage Vovd is applied to the terminal Out subsequent to applying the voltage Von, and then the voltage Voff is further applied after the period of 1H. In other words, in the gate voltage ternary driving, the voltage Vovd is always applied when shifting from the voltage Von to the voltage Voff.

When an output of one of the D-type flip-flops 42 included in the shift register circuit 36 is i and an output of the next D-type flip-flop is (i+1), the selecting circuit 45 performs an operation illustrated in FIG. 27. FIG. 27 is a diagram showing a second example of voltages selected by the selecting circuit 45. As illustrated in FIG. 27, a voltage is selected according to the inputs i and (i+1).

It is to be noted that the selecting circuit 45 is a logic circuit included in a 2-3 decoder with the inputs being i and (i+1). Three outputs are varied by the inputs i and (i+1), to control ON or OFF of the transistors (47, 48, and 19) etc. connected to the outputs. One of the voltage Von, the voltage Voff, and the voltage Vovd is selected in response to the ON or OFF control on the transistors (46, 47, and 48), and the terminal OutA outputs a voltage to the gate signal line 22(23).

For example, when the input i=0 (low level) and the input (i+1)=0 (low level), the OFF voltage Voff is output from the terminal OutA. When the input i=0 (low level) and the input (i+1)=1 (high level), the OFF voltage Vovd is output from the terminal OutA. When the input i=1 (high level) and the input (i+1)=0 (low level), the ON voltage Von is output from the terminal OutA. When the input i=1 (high level) and the input (i+1)=1 (high level), the ON voltage Von is output from the terminal OutA.

With the configuration illustrated in FIG. 25, it is possible to perform the gate voltage ternary driving without the delay unit 51. In addition, the voltage Vovd can be set in synchronization with the clock Clk per 1H (the selecting period for one pixel row). In addition, the voltage Von and the voltage Voff can be set per 1H (one clock unit) according to the data supplied to the terminal Von-Din. For example, it is possible to easily set the voltage Von to nH (n is an integer not less than one). With the configuration illustrated in FIG. 25, it is possible to perform the gate voltage ternary driving with a single shift register circuit 36.

Figure 28:
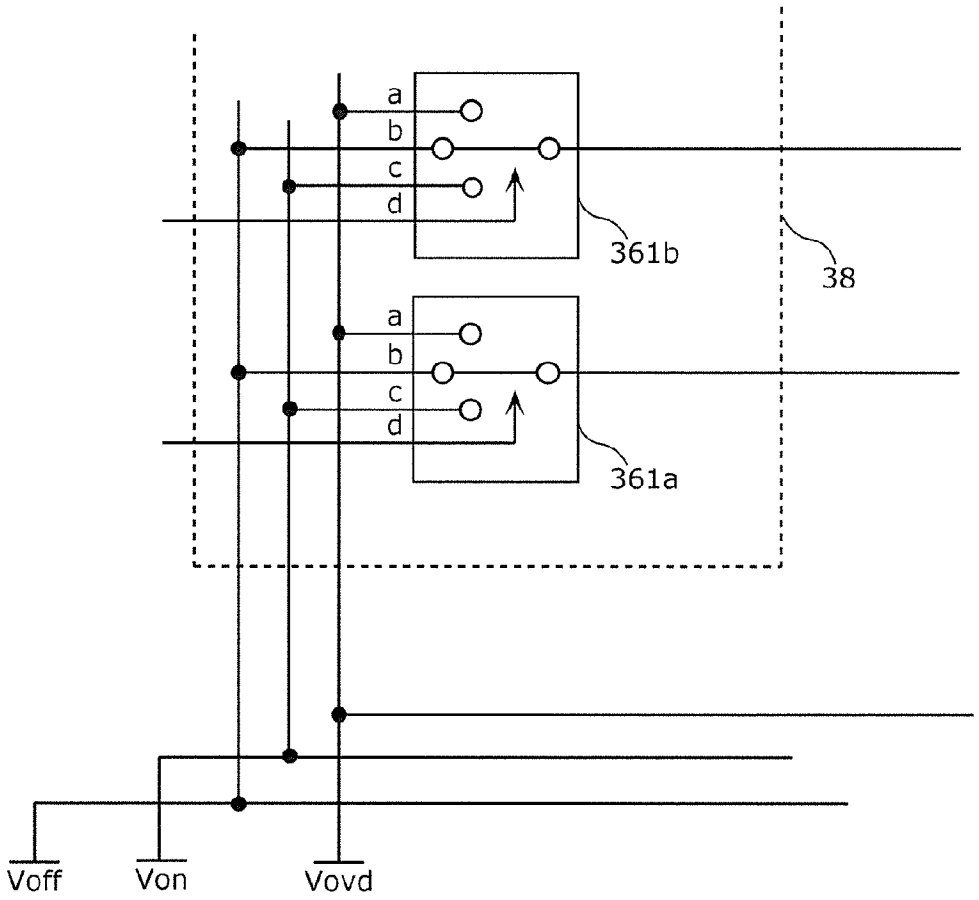
FIG. 28 is a diagram illustrating a switching circuit according to Embodiment 1.

FIG. 28 is a diagram illustrating a switching circuit according to Embodiment 1. The switching circuit 361*a* and 361*b* each have a function of selecting one of the voltage Voff, the voltage Vovd, and the voltage Von, and outputs the selected voltage to the gate signal line 22. As illustrated in FIG. 28, each of the switching circuits 361*a* and 361*b* includes: a terminal a to which the voltage Vovd is applied; a terminal b to which the voltage Voff is applied; and a terminal c to which the voltage Von is applied. According to a logic signal applied to a terminal d (two bits), one of the voltages Vovd, Voff, and Von is selected. The logic signal of the terminal d is based on data held in the shift register circuit 36.

The switching circuits 361*a* and 361*b* switch outputs from the voltage Von to the voltage Vovd, and then to the voltage Voff, thereby implementing the gate voltage ternary driving. In contrast, the switching circuits 361*a* and 361*b* switch outputs from the voltage Von to the voltage Voff, thereby implementing the gate voltage binary driving.

Figure 29:
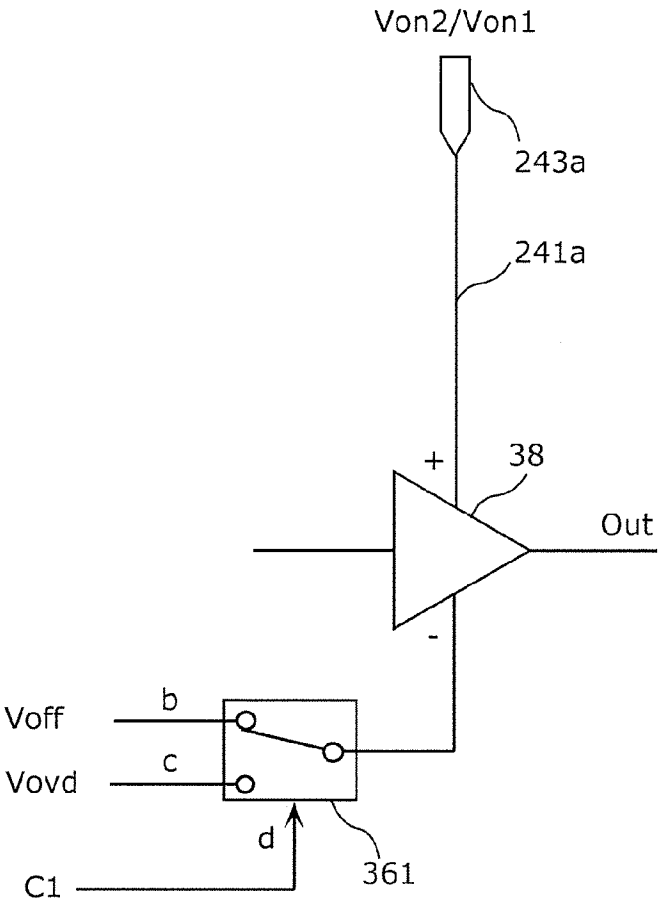
FIG. 29 is a diagram illustrating an example of a configuration of the gate driver circuit according to Embodiment 1.

FIG. 29 is a diagram illustrating an example of a configuration of the gate driver circuit according to Embodiment 1. As illustrated in FIG. 29, a voltage Von2 or a voltage Von1 is applied from the driver input terminal 243*a*. The voltage applied from the driver input terminal 243*a* is transmitted to the output circuit 38 through a COF line 241*a* formed on the COF 191.

The switching circuit 361 is connected to a minus power supply (− power supply) terminal of the output circuit 38. Meanwhile, an ON voltage is applied to a plus power supply (+ power supply) terminal of the output circuit 38.

It is possible to vary the ON voltage (voltage Von) to be output from the terminal Out, by varying the ON voltage to be applied to the driver input terminal 243*a*. In addition, one of the over-drive voltage Vovd and the OFF voltage Voff, which are supplied to the switching circuit 361, is selected according to the logic signal of the control terminal C1, and applied to the minus power supply (− power supply) terminal of the output circuit 38.

With the configuration described above, one of the voltage Von, the voltage Voff, and the voltage Vovd is output from the terminal Out, and the gate voltage ternary driving or the gate voltage binary driving is performed.

Figure 30:
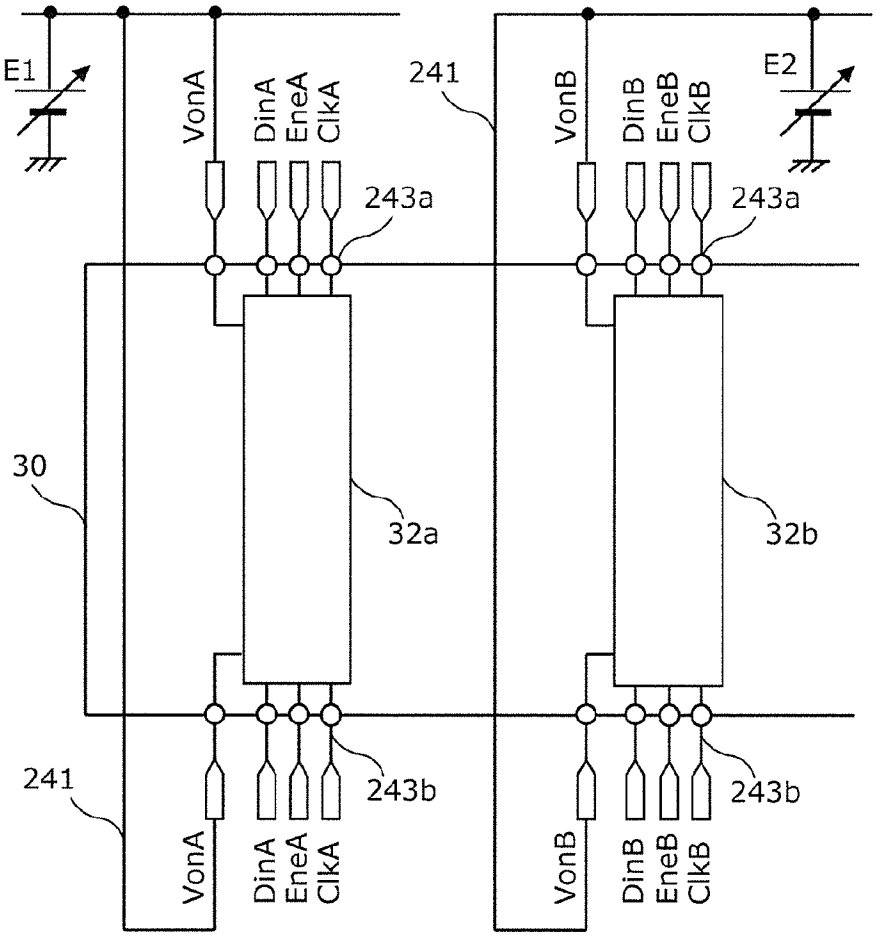
FIG. 30 is a diagram illustrating a variable control of an ON voltage of the gate signal line driving unit according to Embodiment 1.
Figure 31:
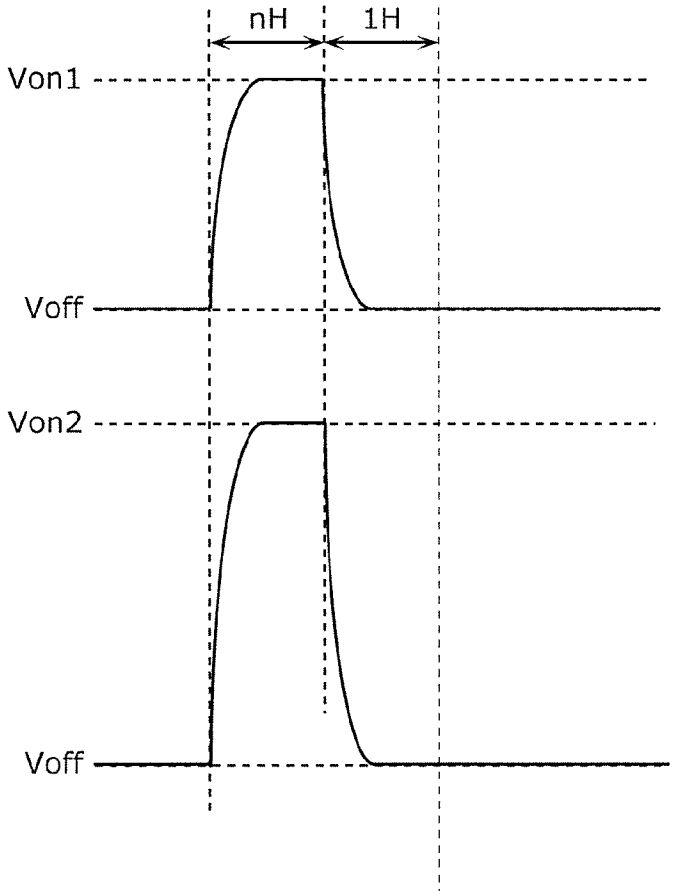
FIG. 31 is a diagram illustrating a waveform of the ON voltage of the gate signal line driving unit on which the variable control is performed.

FIG. 30 is a diagram explaining a variable control of an ON voltage of the gate signal line driving unit according to Embodiment 1. FIG. 31 is a diagram illustrating a waveform of the ON voltage of the gate signal line driving unit on which the variable control is performed. More specifically, the diagram illustrating a waveform in FIG. 31 exemplifies the gate voltage binary driving. As illustrated in FIG. 30, the ON voltage VonA of the gate signal line driving unit 32*a* is set by a voltage circuit E1 outside the COF. A switching power supply circuit, a regulator circuit, or the like corresponds to the voltage circuit E1. The voltage circuit E1 outputs the voltage Von of the gate signal line driving unit 32*a*.

The ON voltage VonB of the gate signal line driving unit 32*b* is set by a voltage circuit E2 outside the COF. A switching power supply circuit, a regulator circuit, or the like corresponds to the voltage circuit E2. The voltage circuit E2 outputs the voltage Von of the gate signal line driving unit 32*b*. The terminal Von is formed or disposed on at least two positions of the gate driver IC30.

As illustrated in FIG. 31, it is possible to vary the amplitude of the voltage to be applied to the gate signal line 22, by setting a magnitude of the voltage Von. In the diagram in the upper stage of FIG. 31, the ON voltage is a Von 1. In the diagram in the lower stage of FIG. 31, the ON voltage is a Von 2. It is indicated that Von 1<Von2. The above-described voltage settings can be carried out by the gate signal line driving units 32*a* and 32*b*. It is to be noted that a time period for applying the voltage Von is nH (n is an integer not less than one), and n can be varied by a controller (not illustrated).

As with the voltage Von, the voltages Voff and Vovd can be varied, adjusted, or set by the gate signal line driving units 32*a* and 32*b*. In addition, since these configurations are the same as those illustrated in FIG. 30 and FIG. 31, description shall be omitted.

FIG. 26 illustrates a voltage waveform of a voltage applied to the gate signal line 22 connected to a P-channel transistor Q (P-polarity). In FIG. 26, (a) illustrates a voltage waveform in the case of the gate voltage binary driving. In FIG. 26, (b) illustrates a voltage waveform in the case of the gate voltage ternary driving.

The gate voltage binary driving and the gate voltage ternary driving are determined by a logic voltage applied to the selecting signal line (the terminal SelA and the terminal SelB) in FIG. 10.

As illustrated in (a) in FIG. 26, a long period of time t1 is required for varying the voltage Von to the voltage Voff with the gate voltage binary driving. When t1 is long, a video signal written on a pixel in this time period might leak, and crosstalk or the like might occur between pixels adjacent above or below.

By executing the gate voltage ternary driving illustrated in (b) in FIG. 26, the period of time taken for varying the voltage Von is significantly reduced to t2 as in the diagram. Accordingly, leakage of a video signal written on a pixel or crosstalk or the like between pixels adjacent above or below does not occur.

With the gate voltage ternary driving, after an application period of the voltage Von, the voltage Vovd is applied during a period of 1H or during a period shorter than 1H. It is to be noted that, with the configuration illustrated in FIG. 23 and FIG. 25, the voltage Vovd is applied for a period of 1H or longer. It is to be noted that the period of 1H is one horizontal scanning period or a selecting period for one pixel row.

After the application period of the voltage Vovd, the voltage Voff is applied to the gate signal line 22(*i*) corresponding to a selected pixel row, and the gate signal line 22(*i*) is kept at the voltage Voff during a period before the voltage Von is applied in the next frame period.

When the logic voltages applied to the terminals Sel are set at "L", the driving mode is set as the gate voltage binary driving. When the logic voltages applied to the terminals Sel are set at "H", the driving mode is set as the gate voltage ternary driving.

It is preferable that the period during which the voltage Vovd is applied is set to the period of 1H or during a period shorter than 1H. The period during which the voltage Von is applied is set to nth (n is an integer not less than one) of the period of 1H and not less than the period of 1H, and the value of n is variable.

Figure 32:
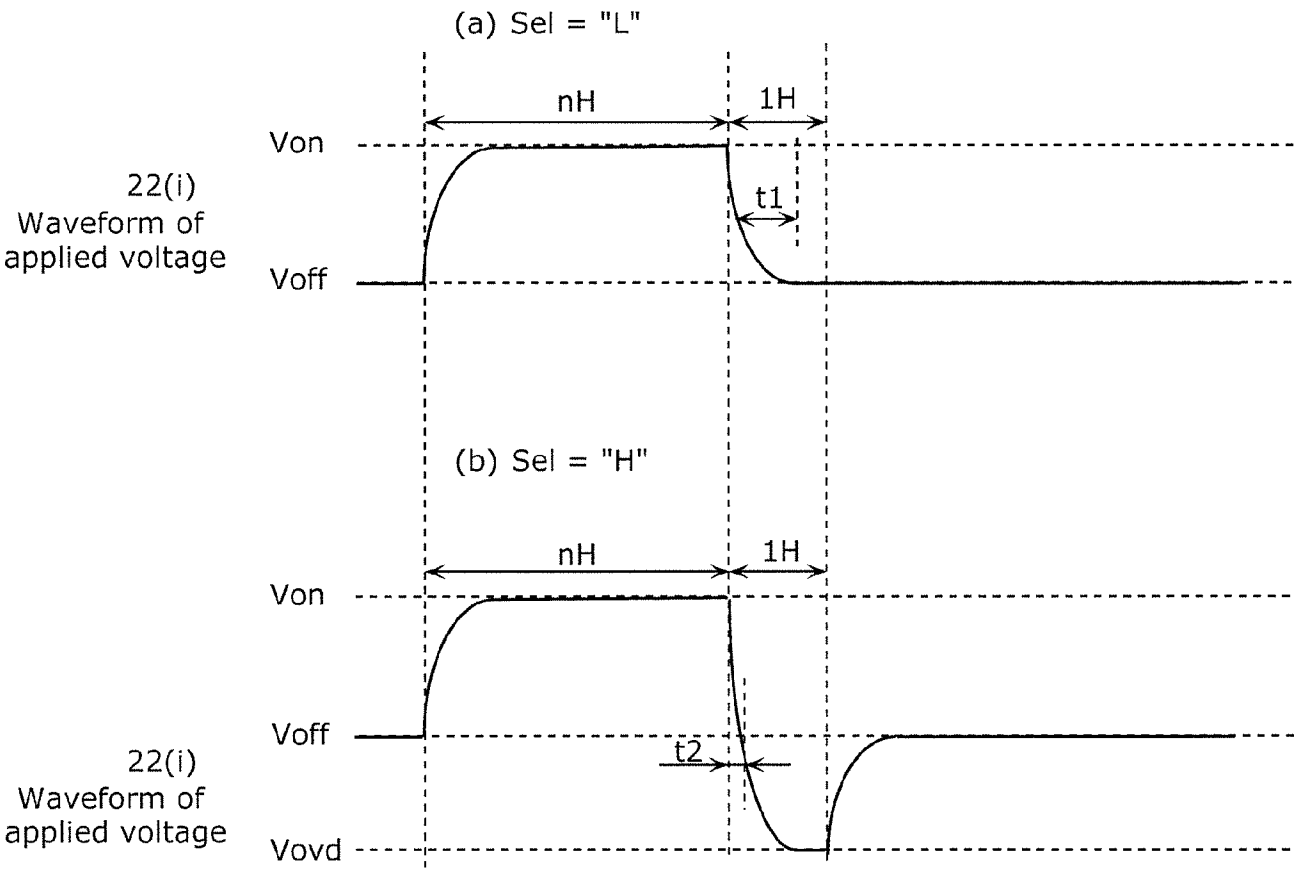
FIG. 32 is a driving waveform diagram illustrating the write controlling signal of the image display apparatus according to the first modification example of Embodiment 1.

FIG. 32 is a driving waveform diagram illustrating the write controlling signal of the image display apparatus according to the first modification example of Embodiment 1. Specifically, FIG. 32 is a waveform diagram of the gate voltage binary driving ((a) in FIG. 32) and the gate voltage ternary driving ((b) in FIG. 32) in the case where the transistor Q is the N-channel (N polarity) transistor. The pixel circuit corresponding to the pixel configuration of the P-channel transistor of FIG. 2 is illustrated in, for example, FIG. 12. FIG. 12 illustrates an example of the pixel circuit configured of N-channel transistor.

As illustrated in FIG. 32, the polarity of voltage waveforms is inverted between the case where the transistor Q is the N-channel transistor as in FIG. 32 and the case where the transistor Q is the P-channel transistor as in FIG. 26.

Figure 33:
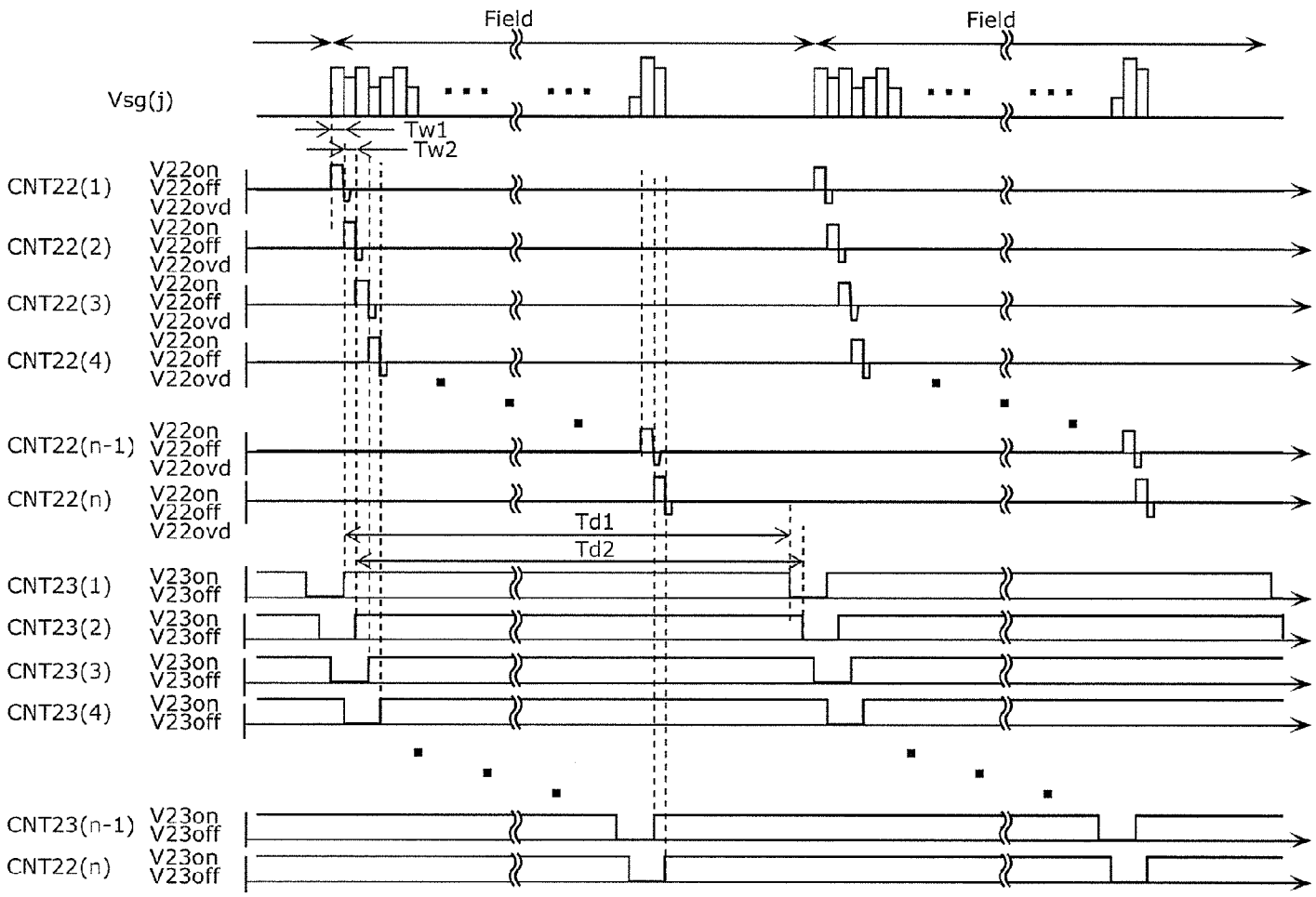
FIG. 33 is a timing chart of an image signal voltage, a write controlling signal, and a display controlling signal, of the image display apparatus according to the first modification example of Embodiment 1.

The voltage waveform of a voltage applied to the gate signal line 22 in the case of FIG. 12 shows a reverse polarity with respect to the voltage waveform in the case of FIG. 2. For example, in the case of the pixel configuration in FIG. 12, FIG. 33 corresponds to the timing chart in FIG. 8. FIG. 33 is a timing chart of an image signal voltage, a write controlling signal, and a display controlling signal, of the image display apparatus according to the first modification example of Embodiment 1.

Figure 34:
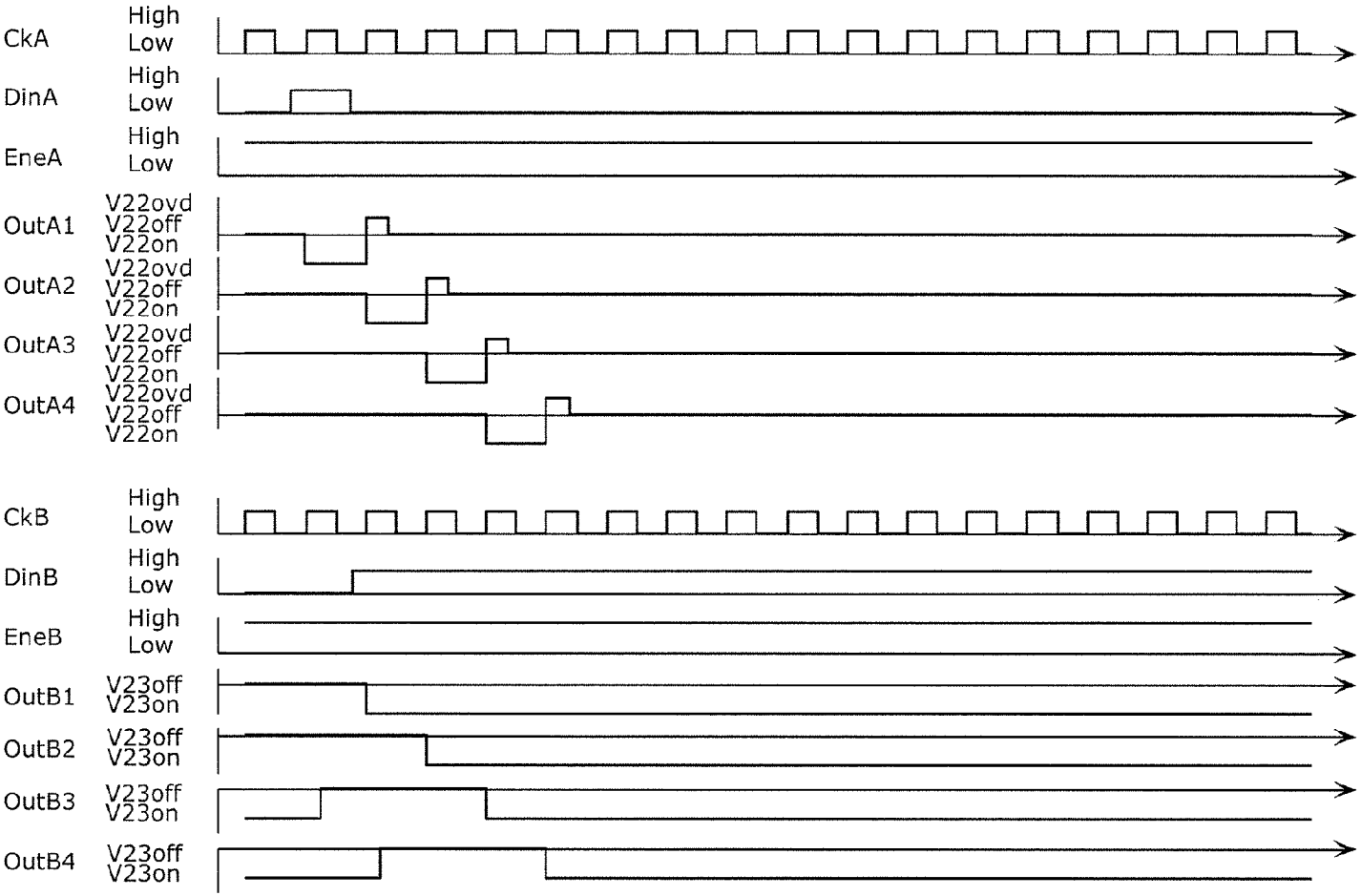
FIG. 34 is a timing chart illustrating an operation of the first gate driving circuit according to Embodiment 1.
Figure 35:
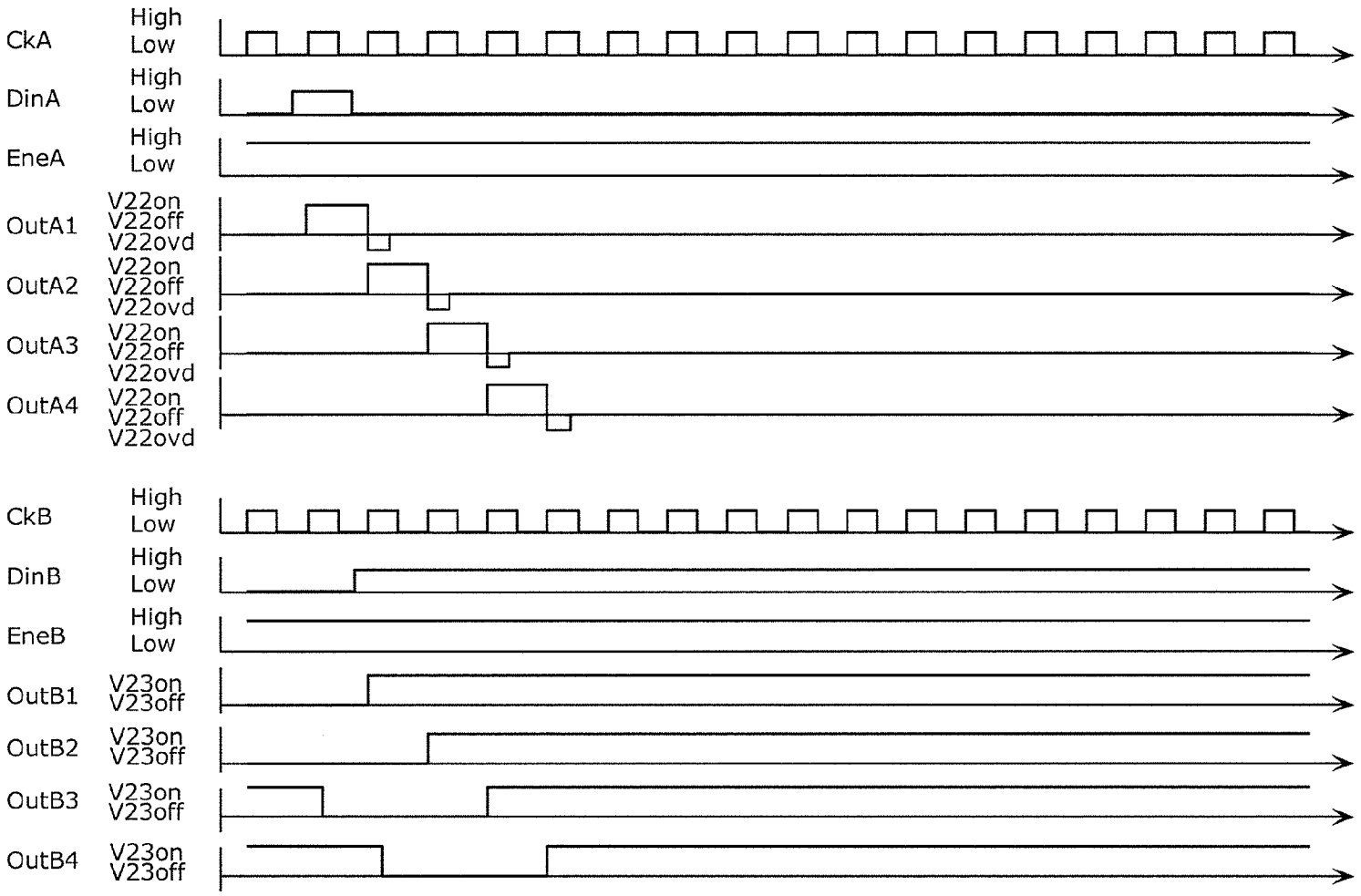
FIG. 35 is a timing chart illustrating an operation of the first gate driving circuit according to the first modification example of Embodiment 1.

Here, FIG. 34 is a timing chart illustrating an operation of the first gate driving circuit according to Embodiment 1. FIG. 35 is a timing chart illustrating an operation of the first gate driving circuit according to the first modification example of Embodiment 1. More specifically, FIG. 34 is a timing chart of the first gate driving circuit 14 in the case where the transistor Q is the P-channel transistor, and FIG. 35 is a timing chart of the first gate driving circuit 14 in the case where the transistor Q is the N-channel transistor.

Figure 36:
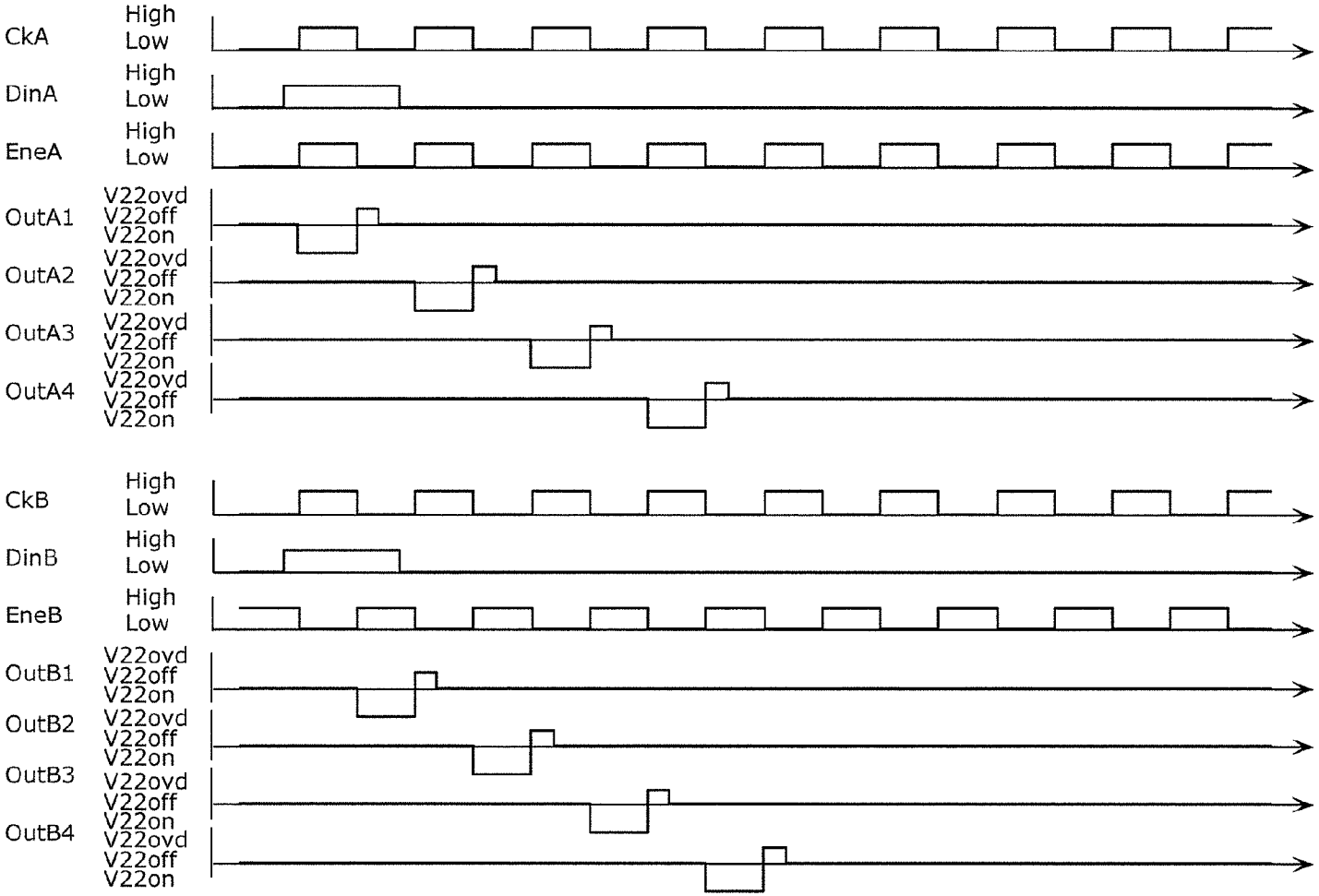
FIG. 36 is a first example of the timing chart illustrating an operation of a second gate driving circuit according to Embodiment 1.
Figure 37:
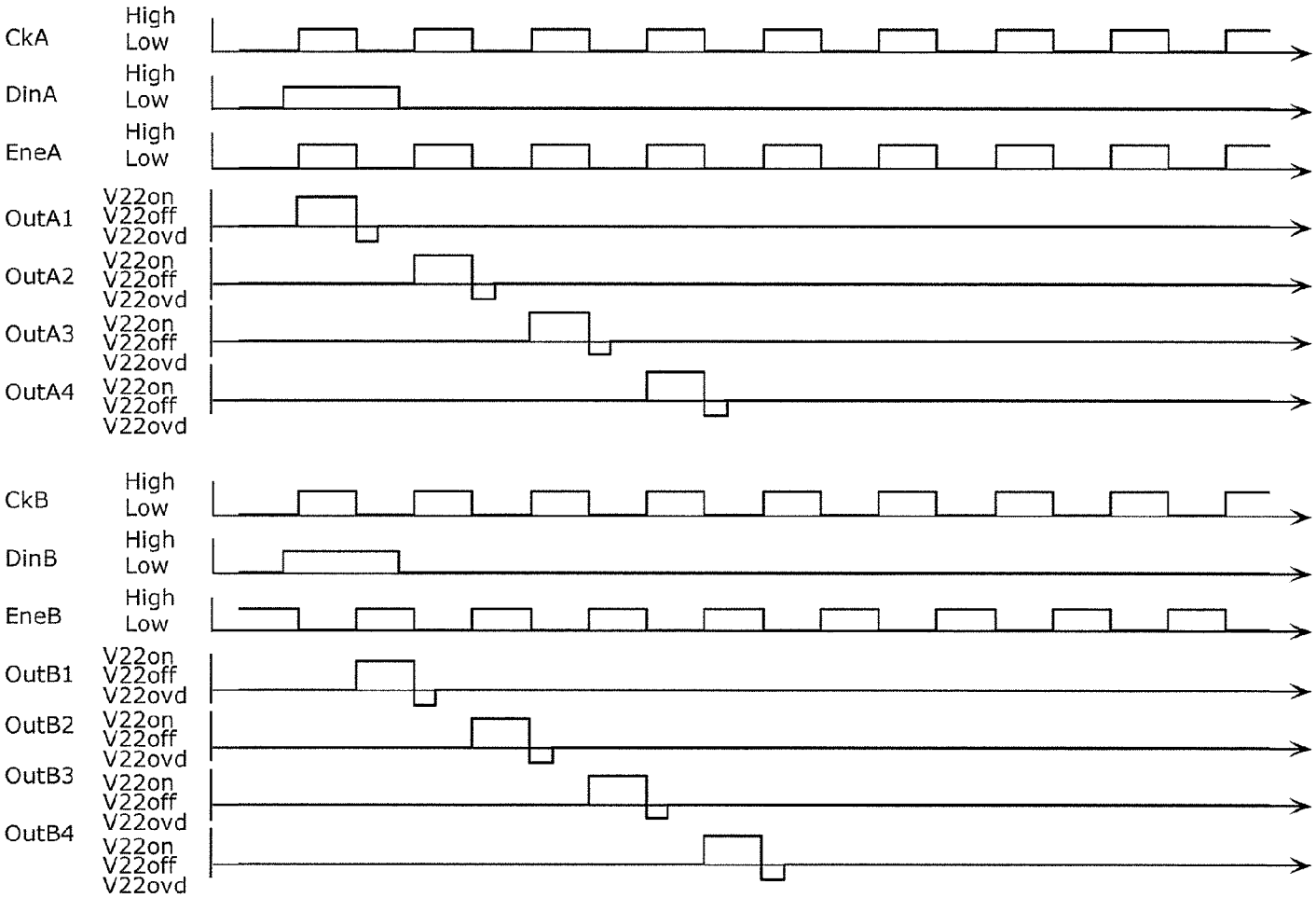
FIG. 37 is a first example of a timing chart illustrating an operation of the second gate driving circuit according to the first modification example of Embodiment 1.

In addition, FIG. 36 is a first example of the timing chart illustrating an operation of the second gate driving circuit according to Embodiment 1. FIG. 37 is a first example of a timing chart illustrating an operation of the second gate driving circuit according to the first modification example of Embodiment 1. More specifically, FIG. 36 is a timing chart of the second gate driving circuit 15 in the case where the transistor Q is the P-channel transistor, and FIG. 35 is a timing chart of the second gate driving circuit 15 in the case where the transistor Q is the N-channel transistor. Here, in the case of the pixel configuration in FIG. 12, FIG. 37 corresponds to the timing chart in FIG. 36.

Figure 38:
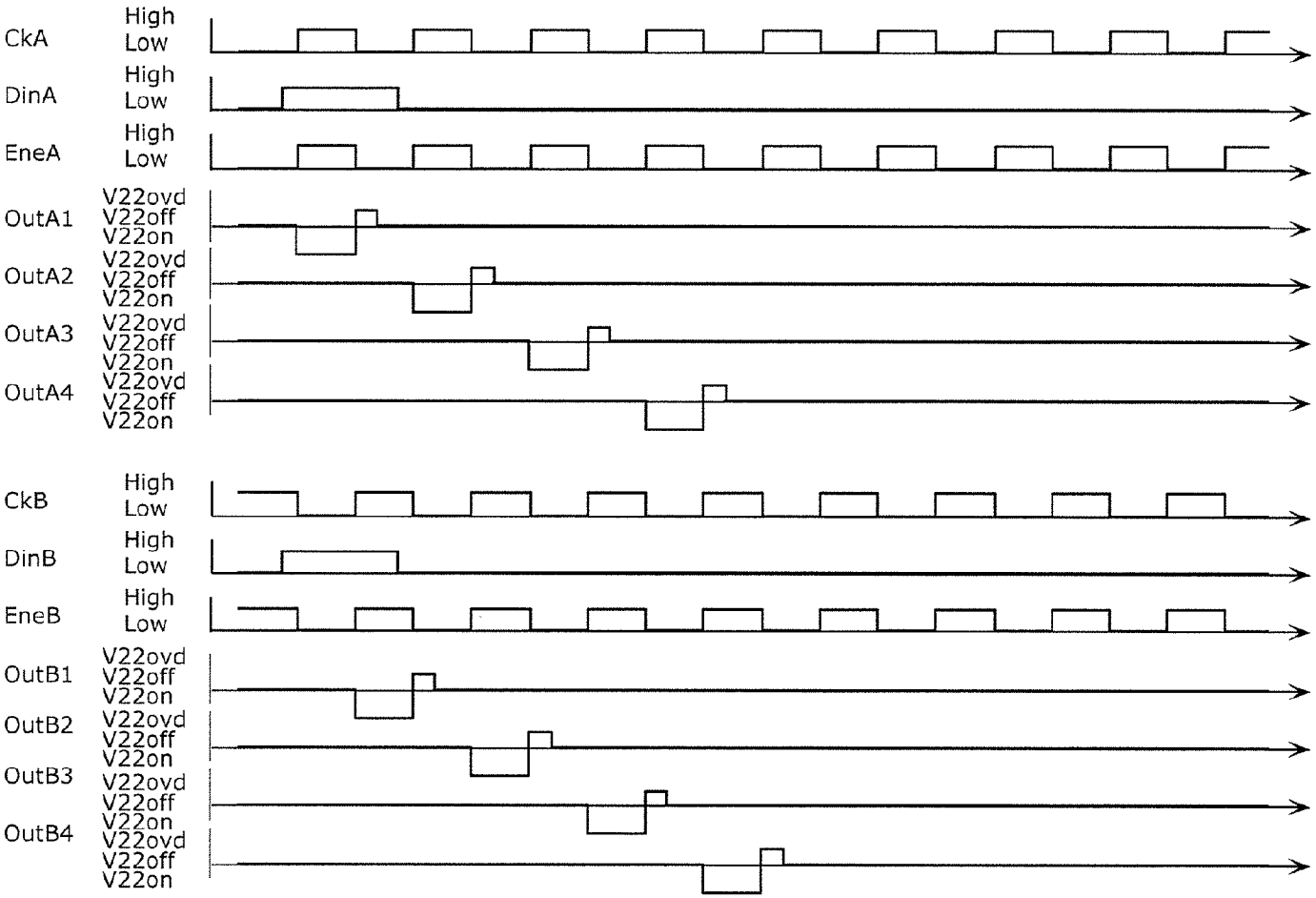
FIG. 38 is a second example of the timing chart illustrating an operation of the second gate driving circuit according to Embodiment 1.
Figure 39:
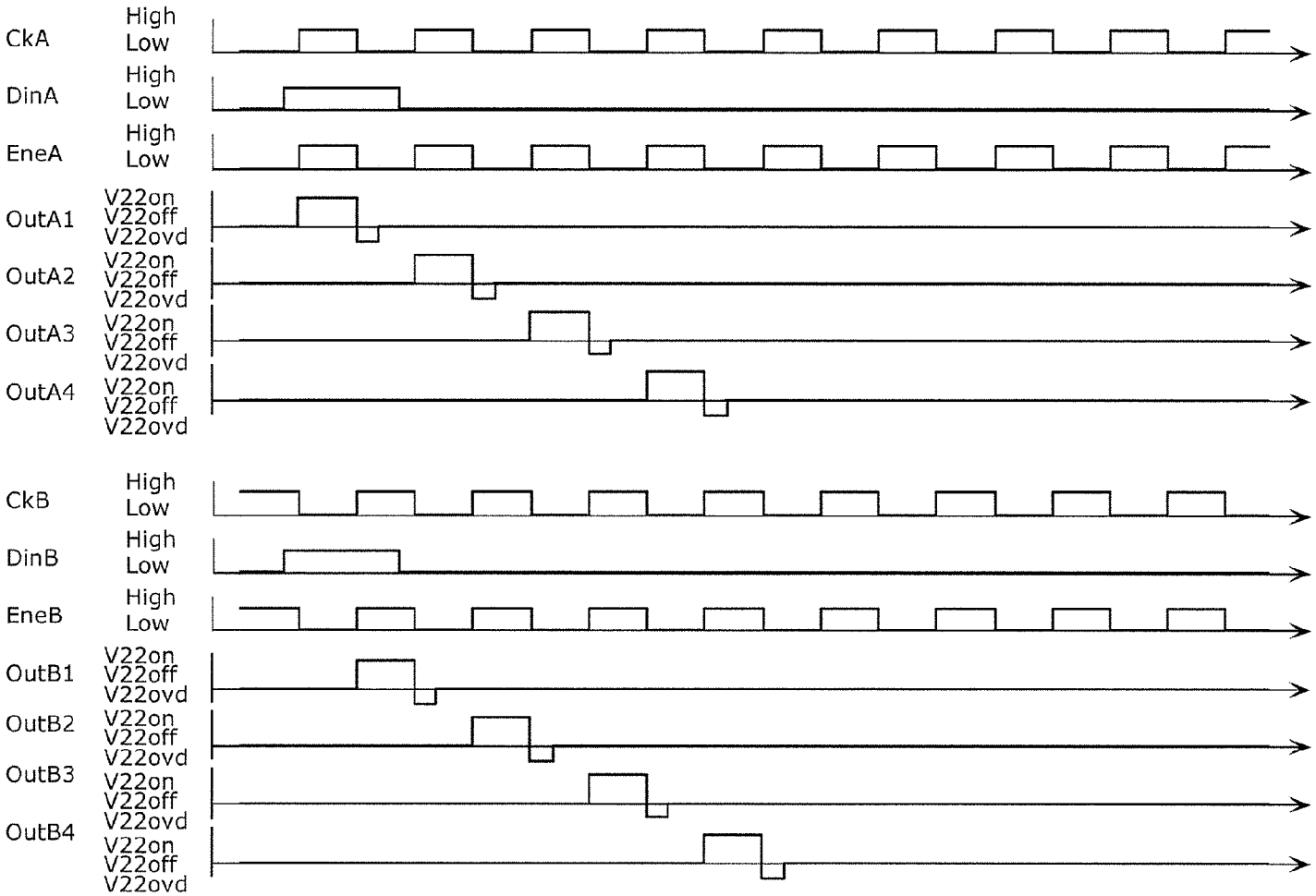
FIG. 39 is a second example of a timing chart illustrating an operation of the second gate driving circuit according to the first modification example of Embodiment 1.

In addition, FIG. 38 is a second example of the timing chart illustrating an operation of the second gate driving circuit according to Embodiment 1. FIG. 39 is a second example of a timing chart illustrating an operation of the second gate driving circuit according to the first modification example of Embodiment 1. More specifically, FIG. 38 is a timing chart of the second gate driving circuit 15 in the case where the transistor Q is the P-channel transistor, and FIG. 39 is a timing chart of the second gate driving circuit 15 in the case where the transistor Q is the N-channel transistor. Here, in the case of the pixel configuration in FIG. 12, FIG. 39 corresponds to the timing chart in FIG. 38.

The transistor Q included in the pixel circuit according to the present disclosure may either be the P-channel transistor or be the N-channel transistor. A gate voltage corresponding to the polarity of the transistor Q is applied to the gate signal line in the gate voltage binary driving and the gate voltage ternary driving.

In the manner as described above, with the gate driver circuit or the gate driver IC according to the present invention, it is possible to change the voltage signal applied to the gate signal line 22 according to the polarity of the transistor (P-channel or N-channel).

In the gate voltage ternary driving, a gate voltage is applied to the gate signal line 22(*i*) connected to the gate terminal of the transistor Q22 to which a video signal voltage is applied. In other words, the gate voltage ternary driving is performed on the gate signal line which requires the bilateral driving. In the gate voltage binary driving, a gate voltage is applied to the gate signal line 22(*i*) to which the gate terminal of the transistor Q23 is connected. In other words, the gate voltage binary driving is performed on the gate signal line which does not require a high slew rate and to which the unilateral driving is applied.

As described above, FIG. 10 is a diagram schematically illustrating the state in which the gate driver IC 30 is mounted on the COF 191.

The data input terminal (DinA) for inputting data to the shift register (not illustrated), the enable input terminal (EneA) for enabling (outputting an ON voltage to the gate signal line) or disabling (outputting an OFF voltage to the gate signal line) an output of the shift register (not illustrated), and the clock input terminal (ClkA) for inputting a clock that shifts data in the shift register (not illustrated), are connected to or disposed in the gate signal line driving unit 32*a*.

The data input terminal (DinB) for inputting data to the shift register (not illustrated), the enable input terminal (EneB) for enabling (outputting an ON voltage to the gate signal line) or disabling (outputting an OFF voltage to the gate signal line) an output of the shift register (not illustrated), and the clock input terminal (ClkB) for inputting a clock that shifts data in the shift register (not illustrated), are connected to or disposed in the gate signal line driving unit 32*b*.

COF lines 241*a* to 241*e* are formed on a flexible substrate (COF) 191, and a signal or a voltage is applied from each terminal to the gate driver IC 30, via the COF lines 241*a* to 241*e* and a driver input terminal 243*a* and a driver input terminal 243*b*.

An output of the gate driver IC 30 is connected to an output terminal 245 via a driver output terminal 246 and a COF line 241*e*. The gate signal line 22 is connected to the output terminal 245.

As illustrated in FIG. 10, the driver input terminal 243*a* or 243*b* is disposed at one or more positions on each longitudinal side of the chip of the driver IC. With the above-described configuration, the effect of potential drop of a voltage is reduced, and an operation of the driver IC is not affected when one of the driver input terminals (243*a* and 243*b*) becomes disconnected.

As illustrated in FIG. 10, the terminals Sel and the terminals Voff are disposed between the input terminals Von (VonA and VonB) and the gate output terminals 246. The control terminals such as DinA, EneA, ClkA, DinB, and ClkB are each formed or disposed at two or more positions of the gate driver IC 30. It is preferable that the above-described two or more positions may be arranged so as to be line symmetric with respect to a center line of the short side of the gate driver IC.

In an input stage of each of the control terminals such as DinA, EneA, ClkA, DinB, EneB, and ClkB, an input stage circuit, for example, Schmitt circuit or a hysteresis circuit is formed. In addition, the gate signal line driving unit 32 is configured so as to latch an input signal.

For example, a clock which is supplied to the connecting terminal 244*a* at ClkB is applied to the driver input terminal 243*a* via the COF line 241*a*. A noise component of the clock signal applied to the driver input terminal 243*a* is removed in the Schmitt circuit of the gate signal line driving unit 32*b* and the clock signal is latched by the latch circuit (not illustrated). Clock data that is latched is output to the driver input terminal 243*b* via a line (not illustrated) formed inside the gate signal line driving unit 32*a*. The clock data ClkB output from the driver input terminal 243*b* is output from the connecting terminal 244*b* via the COF line 241*c*.

It is to be noted that a COF line (not illustrated) may be formed between the driver input terminal 243*a* and the driver input terminal 243*b*. With the COF line, it is possible to stabilize transmission of control data.

A plurality of input terminals for the ON voltages Von (VonA and VonB) are disposed or formed.

According to the configuration illustrated in FIG. 10, the gate signal line driving unit 32*a* and the gate signal line driving unit 32*b* are formed or disposed on the gate driver IC 30. Selecting terminals (SelA and SelB) and Two OFF voltage input terminals (Voff and Vovd) and one ON voltage input terminal (VonA for the gate signal line driving unit 32*a*, and VonB for the gate signal line driving unit 32*b*) are connected to the gate signal line driving units 32*a* and 32*b*.

The terminals Sel (SelA and SelB) are pulled down. The terminals Sel are logic terminals for switching between the gate voltage ternary driving and the gate voltage binary driving.

The gate driver IC 30 outputs from the driver output terminal 246 an ON voltage and an OFF voltage to be applied to the gate signal line 22. The driver output terminal 246 and the output terminal 245 are electrically connected by the COF line 241*e* formed on the COF 191.

The driver input terminal 243*a* and the connecting terminal 244*a* are electrically connected by the COF line 241*a* formed on the COF 191. In addition, the driver input terminal 243*b* and the connecting terminal 244*b* are electrically connected by the COF line 241*c* formed on the COF 191.

A predetermined voltage such as a logic voltage is applied to the logic terminal such as Sel from the connecting terminal 244*c* of a panel. The above-described predetermined voltage is applied to an operating terminal 234*c* of the gate driver IC 30 via a line 241*d* which is formed on the COF 191 and connects one point in the COF and a connecting terminal.

An operating terminal 247 of the gate driver IC 30 is disposed or formed: between the driver output terminal 246 and the driver input terminal 243*a* or between the driver output terminal 246 and the driver input terminal 243*b*; or between the driver output terminal 246 and the driver input terminal 243*a* and between the driver output terminal 246 and the driver input terminal 243*b*. As described above, FIG. 17 is a schematic diagram illustrating a configuration of the image display apparatus 10 according to a second modification example of Embodiment 1. The configuration illustrated in FIG. 17 differs from the configuration illustrated in FIG. 1 in that one end of the gate signal line 22(*i*) is connected to the first gate driving circuit 14, and the other end of the gate signal line 22(*i*) is connected to the second gate driving circuit 15, and that the one end of the gate signal line 23(*i*) is connected to the first gate driving circuit 14. Accordingly, the bilateral driving is applied to the gate signal line 22(*i*), and the unilateral driving is applied to the gate signal line 23(*i*).

Figure 40:
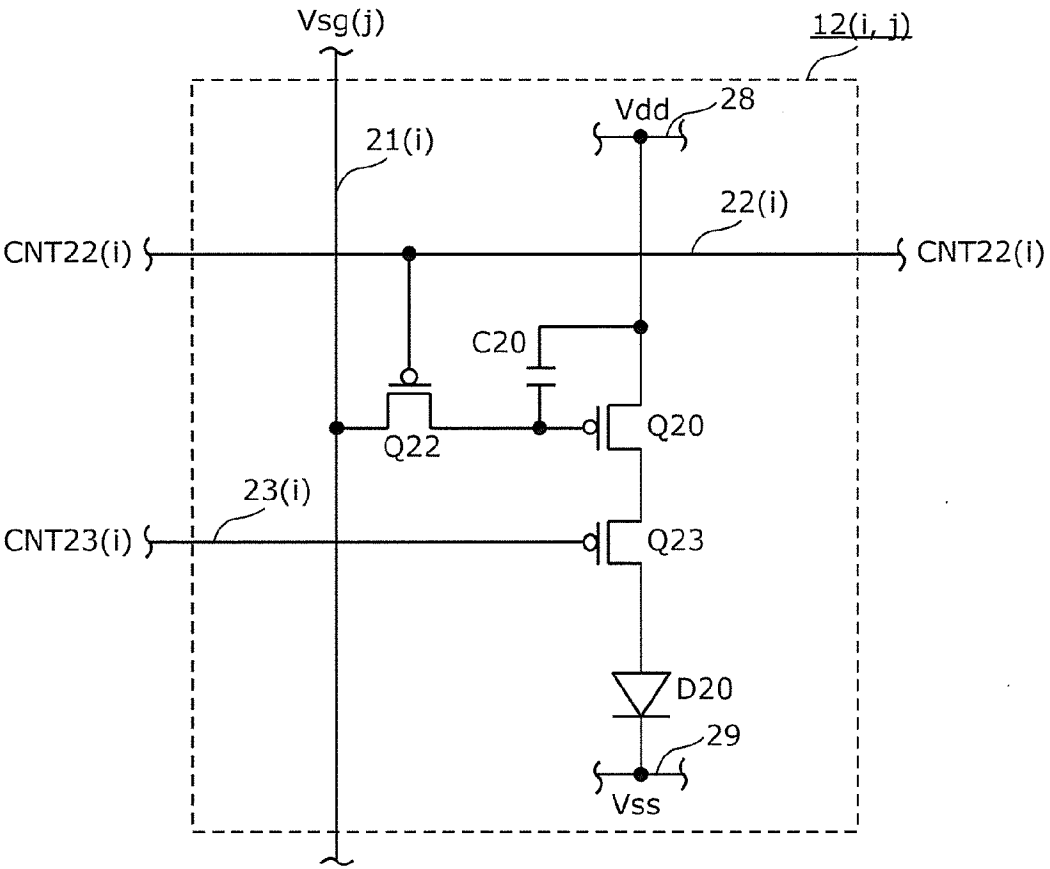
FIG. 40 is a circuit diagram illustrating a pixel circuit of an image display apparatus according to the second modification example of Embodiment 1.

FIG. 40 is a circuit diagram illustrating a pixel circuit of the image display apparatus according to the second modification example of Embodiment 1. The source signal lines 21(*j*) are each drawn from an upper side of the image display panel 11, and connected to the source driving circuit 16 in FIG. 17. The gate signal lines 22(*i*) are each drawn from the left side of the display panel 11 and connected to the first gate driving circuit 14, and also drawn from the right side of the display panel 11 and connected to the second gate driving circuit 15, in FIG. 17. The gate signal lines 23(*i*) are each drawn from the left side of the image display panel 11 and connected to the first gate driving circuit 14 in FIG. 17.

The following describes the image display apparatus according to the second modification example, focusing on differences from the image display apparatus according to Embodiment 1 illustrated in FIG. 1 and FIG. 2.

As described above, in the image display panel 11 according to the second modification example of the present embodiment, the gate signal line 22(*i*) and the gate signal line 23(*i*) are connected in common to the pixel circuits 12(*i*, 1) to 12(*i, m*) arranged in the row direction.

The first gate driving circuit 14 supplies each of the gate signal lines 22(*i*) with a write controlling signal CNT22(*i*) that is a first controlling signal, and supplies each of the gate signal lines 23(*i*) with a display controlling signal CNT23(*i*) that is a second controlling signal. In addition, the second gate driving circuit 15 supplies each of the gate signal lines 22(*i*) with the write controlling signal CNT22(*i*).

The gate signal line driving unit 32A of the first gate driving circuit 14 and the gate signal line driving unit 32A of the second gate driving circuit 15 drive the gate signal line 23(*i*). The gate signal line driving unit 32B of the first gate driving circuit 14 drives the gate signal line 22(*i*).

The gate signal line 23(*i*) is a signal line to which a signal for turning ON or OFF the switching transistor Q23 is applied. Accordingly, the transistor Q23 does not require a high slew rate operation. Thus, the gate signal line 23(*i*) may be driven by the unilateral driving.

The first gate driving circuit 14 disposed on the left side drives all of the gate signal lines formed on the image display panel, whereas the second gate driving circuit 15 disposed on the right side drives half of the gate signal lines disposed on the image display panel. Accordingly, the number of the second gate driving circuits 15 disposed on the right side may be half the number of the first gate driving circuits 14 disposed on the left side. For the reasons described above, it is possible to realize more cost reduction with the configuration illustrated in FIG. 17 compared to the configuration illustrated in FIG. 1.

Other matters have been described with reference to FIG. 1, FIG. 2, etc., and thus description will be omitted.

Figure 41:
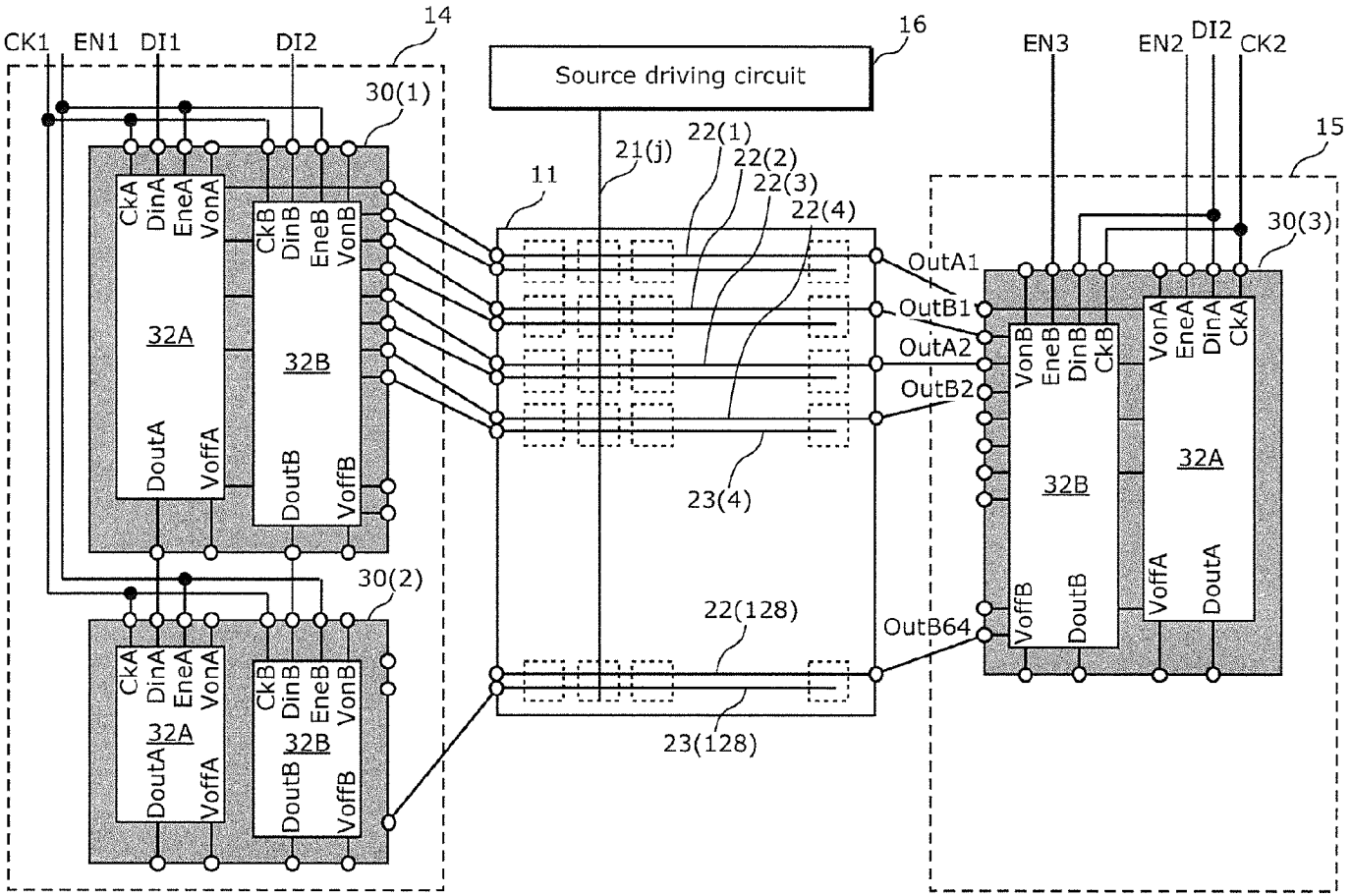
FIG. 41 is a diagram illustrating an example of the configuration of a gate driving circuit according to the second modification example of Embodiment 1.

FIG. 41 is a diagram illustrating an example of a configuration of the gate driving circuit of the image display apparatus according to the second modification example of Embodiment 1.

The first gate driving circuit 14 includes two gate driver integrated circuits 30(1) and 30(2), and the second gate driving circuit 15 includes one gate driver integrated circuit 30(3). Here, each of the gate driver integrated circuits 30(1) to 30(3) has the same circuit configuration as the circuit configuration of the gate driver integrated circuit 30 illustrated in FIG. 20.

Output terminals of the gate driver integrated circuit 30(1) and the gate driver integrated circuit 30(2) mounted on the first gate driving circuit 14 are connected to the gate signal lines 22(1) to 22(128) and the gate signal lines 23(1) to 23(128) which are drawn to the left side of the image display panel 11. According to the present modification example, the gate signal line 22(1) is connected to the output terminal OutA1 of the gate driver integrated circuit 30(1), the gate signal line 22(2) is connected to the output terminal OutA2 of the gate driver integrated circuit 30(1), the gate signal line 22(3) is connected to the output terminal OutA3 of the gate driver integrated circuit 30(1), . . . , and the gate signal line 22(64) is connected to the output terminal OutA64 of the gate driver integrated circuit 30(1).

In addition, the gate signal line 23(1) is connected to the output terminal OutB1 of the gate driver integrated circuit 30(1), the gate signal line 23(2) is connected to the output terminal OutB2 of the gate driver integrated circuit 30(1), . . . , and the gate signal line 23(64) is connected to the output terminal OutB64 of the gate driver integrated circuit 30(1).

In addition, the gate signal line 22(65) is connected to the output terminal OutA1 of the gate driver integrated circuit 30(2), the gate signal line 22(66) is connected to the output terminal OutA2 of the gate driver integrated circuit 30(2), the gate signal line 22(67) is connected to the output terminal OutA3 of the gate driver integrated circuit 30(2), . . . , and the gate signal line 22(128) is connected to the output terminal OutA64 of the gate driver integrated circuit 30(2).

In addition, the gate signal line 23(65) is connected to the output terminal OutB1 of the gate driver integrated circuit 30(2), the gate signal line 23(66) is connected to the output terminal OutB2 of the gate driver integrated circuit 30(2), . . . , and the gate signal line 23(128) is connected to the output terminal OutB64 of the gate driver integrated circuit 30(2).

The clock input terminal CkA and the clock input terminal CkB of the gate driver integrated circuit 30(1), and the clock input terminal CkA and the clock input terminal CkB of the gate driver integrated circuit 30(2), are connected to each other, and a first clock CK1 is supplied. In addition, the enable input terminal EneA and the enable input terminal EneB of the gate driver integrated circuit 30(1), and the enable input terminal EneA and the enable input terminal EneB of the gate driver integrated circuit 30(2), are connected to each other, and an enable signal EN1 is supplied.

The data output terminal DoutA of the gate driver integrated circuit 30(1) is connected to the data input terminal DinA of the gate driver integrated circuit 30(2), and the data output terminal DoutB of the gate driver integrated circuit 30(1) is connected to the data input terminal DinB of the gate driver integrated circuit 30(2). In the above-described manner, the gate driver integrated circuit 30(1) and the gate driver integrated circuit 30(2) are connected in the cascade arrangement.

The data input terminal DinA of the gate driver integrated circuit 30(1) is supplied with a signal DI1 for generating the write controlling signals 22(1) to 22(128), and the data input terminal DinB of the gate driver integrated circuit 30(1) is supplied with a signal DI2 for generating the display controlling signals 23(1) to 23(128).

The power supply terminal VonA of the gate driver integrated circuit 30(1) is connected to the power supply terminal VonA of the gate driver integrated circuit 30(2) and the voltage V22on is applied, the power supply terminal VoffA of the gate driver integrated circuit 30(1) is connected to the power supply terminal VoffA of the gate driver integrated circuit 30(2) and the voltage V22off is applied, and the power supply terminal VovdA of the gate driver integrated circuit 30(1) is connected to the power supply terminal VovdA of the gate driver integrated circuit 30(2) and the voltage V22*ovd* is applied.

Furthermore, the power supply terminal VonB of the gate driver integrated circuit 30(1) is connected to the power supply terminal VonB of the gate driver integrated circuit 30(2) and the voltage V23on is applied, and the power supply terminal VoffB of the gate driver integrated circuit 30(1) is connected to the power supply terminal VoffB of the gate driver integrated circuit 30(2) and the voltage V23off is applied.

Meanwhile, output terminals of the gate driver integrated circuit 30(3) mounted on the second gate driving circuit 15 are connected to the gate signal lines 22(1) to 22(128) which are drawn to the right side of the image display panel 11. According to the present modification example, among the gate signal lines 22(1) to 22(128), the gate signal line 22(1), the gate signal line 22(3), the gate signal line 22(5), . . . , and the gate signal line 22(127), which are the odd-numbered gate signal lines, are connected respectively to the output terminal OutA1 of the gate driver integrated circuit 30(3), the output terminal OutA2 of the gate driver integrated circuit 30(3), the output terminal OutA3 of the gate driver integrated circuit 30(3), . . . , and the output terminal OutA64 of the gate driver integrated circuit 30(3).

In addition, the gate signal line 22(2), the gate signal line 22(4), the gate signal line 22(6), . . . , and the gate signal line 22(128), which are the even-numbered gate signal lines, are connected respectively to the output terminal OutB1 of the gate driver integrated circuit 30(3), the output terminal OutB2 of the gate driver integrated circuit 30(3), the output terminal OutB3 of the gate driver integrated circuit 30(3), . . . , and the output terminal OutB64 of the gate driver integrated circuit 30(3).

The clock input terminal CkA and the clock input terminal CkB of the gate driver integrated circuit 30(3) are connected to each other and a second clock CK2 is supplied. Furthermore, the enable input terminal EneA and the enable input terminal EneB of the gate driver integrated circuit 30(3) are supplied with an enable signal EN2 and an enable signal EN3, respectively. The data input terminal DinA and the data input terminal DinB of the gate driver integrated circuit 30(3) are connected to each other, and the signal DI2 for generating the write controlling signals 22(1) to 22(128) are supplied.

Furthermore, the power supply terminal VonA and the power supply terminal VonB of the gate driver integrated circuit 30(3) are connected to each other and the voltage V22on is applied. The power supply terminal VoffA and the power supply terminal VoffB of the gate driver integrated circuit 30(3) are connected to each other and the voltage V22off is applied. The power supply terminal VovdA and the power supply terminal VovdB of the gate driver integrated circuit 30(3) are connected to each other and the voltage V22*ovd* is applied.

FIG. 34 described above is also a timing chart illustrating an operation of the first gate driving circuit according to the second modification example of Embodiment 1.

The first clock CK1 having a cycle of 3.5 μs is supplied to the clock input terminal CkA of the gate signal line driving unit 32A of each of the gate driver integrated circuit 30(1) and the gate driver integrated circuit 30(2), and the enable input terminal EneA is fixed to the high level. The signal DI1 having a pulse width of approximately 7.0 μs is supplied to the data input terminal DinA of the gate driver integrated circuit 30(1).

The shift register unit 36A shifts and outputs the signal DI1 for each input of the clock CK1. The voltage outputting unit 38A outputs the voltage V22on when the output of the shift register unit 36A is at a high level, outputs the overdrive voltage V22*ovd* for a predetermined time period immediately after the output of the shift register unit 36A shifted from the high level to a low level, and then outputs the voltage V22off. In such a manner as described above, the output terminal OutA1 of the gate driver integrated circuit 30(1) outputs the write controlling signal CNT22(1), the output terminal OutA2 outputs the write controlling signal CNT22(2), . . . , and the output terminal OutA64 outputs the write controlling signal CNT22(64).

In addition, since the gate driver integrated circuit 30(1) and the gate driver integrated circuit 30(2) are connected in the cascade arrangement, the output terminal OutA1 of the gate driver integrated circuit 30(2) outputs the write controlling signal CNT22(65), the output terminal OutA2 outputs the write controlling signal CNT22(66), . . . , and the output terminal OutA64 outputs the write controlling signal CNT22(128).

The first clock CK1 having a cycle of 3.5 μs is supplied to the clock input terminal CkB of the gate signal line driving unit 32B of each of the gate driver integrated circuit 30(1) and the gate driver integrated circuit 30(2), and the enable input terminal EneB is fixed to the high level. The signal DI2 which stays at a high level during most of the one field period other than the high level period of the signal DI1 is supplied to the data input terminal DinB of the gate driver integrated circuit 30(1).

The shift register unit 36B shifts and outputs the signal DI2 for each input of the clock CK1. The voltage outputting unit 38B outputs the voltage V23off when the output of the shift register unit 36B is at a low level, and the outputs the voltage V23on when the output of the shift register unit 36B is at a high level. In such a manner as described above, the output terminal OutB1 of the gate driver integrated circuit 30(1) outputs the display controlling signal CNT23(1), the output terminal OutB2 outputs the display controlling signal CNT23(2), . . . , and the output terminal OutB64 outputs the display controlling signal CNT23(64).

In addition, the output terminal OutB1 of the gate driver integrated circuit 30(2) outputs the display controlling signal CNT23(65), the output terminal OutB2 outputs the display controlling signal CNT23(66), . . . , and the output terminal OutB64 outputs the display controlling signal CNT23(128).

FIG. 36 described above is also a timing chart illustrating an operation of the second gate driving circuit according to the second modification example of Embodiment 1.

The second clock CK2 having a cycle of 7.0 μs that is twice as long as the cycle of the first clock CK1 is supplied to the clock input terminal CkA of the gate signal line driving unit 32A of the gate driver integrated circuit 30(3), and the enable signal EN2 having the same shape as the second clock CK2 is supplied to the enable input terminal EneA. The signal DI2 having a pulse width of approximately 14 μs is supplied to the data input terminal DinA.

The shift register unit 36A shifts the signal DI2 for each input of the clock CK2 and outputs a logical AND with the enable signal EN2. The voltage outputting unit 38A outputs the voltage V22on when the output of the shift register unit 36A is at a high level, outputs the over-drive voltage V22*ovd* for a predetermined time period immediately after the output of the shift register unit 36A shifted from the high level to a low level, and then outputs the voltage V22off. In such a manner as described above, the gate signal line driving unit 32A outputs the write controlling signals for odd-numbered lines. In other words, the output terminal OutA1 outputs the write controlling signal CNT22(1), the output terminal OutA2 outputs the write controlling signal CNT22(3), . . . , and the output terminal OutA64 outputs the write controlling signal CNT22(127).

Meanwhile, although the second clock CK2 is supplied to the clock input terminal CkB of the gate signal line driving unit 32B of the gate driver integrated circuit 30(3), the enable signal EN3 having the same cycle as the second clock CK2 and a shape with a phase being different hundred-and-eighty-degree from the second clock CK2 is supplied to the enable input terminal EneB. The signal DI2 is supplied to the data input terminal DinB.

The shift register unit 36B shifts the signal DI2 for each input of the clock CK2 and outputs a logical AND with the enable signal EN3. The voltage outputting unit 38B outputs the voltage V22on when the output of the shift register unit 36B is at a high level, outputs the over-drive voltage V22*ovd* for a predetermined time period immediately after the output of the shift register unit 36B shifted from the high level to a low level, and then outputs the voltage V22off. In such a manner as described above, the gate signal line driving unit 32B outputs the write controlling signals for even-numbered lines. In other words, the output terminal OutB1 outputs the write controlling signal CNT22(2), the output terminal OutB2 outputs the write controlling signal CNT22(4), . . . , and the output terminal OutB64 outputs the write controlling signal CNT22(128).

As described above, according to the present modification example, the first gate driving circuit 14 and the second gate driving circuit 15 are configured using the gate driver integrated circuit 30 which includes circuits that each include a combination of the shift register units 36A and 36B and the voltage outputting units 38A and 38B, and are grouped per plural outputs and integrated as a single monolithic IC. It is possible to make the gate driving circuit compact by integration of the gate driving circuits, thereby reducing area for mounting and costs.

The first gate driving circuit 14: includes the gate driver integrated circuit 30(1) and the gate driver integrated circuit 30(2) which are connected in the cascade arrangement, and thereby includes (i) a first shift register unit (i.e., the shift register unit 36A of the gate driver integrated circuit 30(1) and the shift register unit 36A of the gate driver integrated circuit 30(2) which are connected in the cascade arrangement) having a length corresponding to at least the same number of the pixel circuit rows included in the image display panel (ii) and a first voltage outputting unit capable of converting each of the outputs of the first shift register unit into a control signal having a predetermined voltage and amplitude and applying, for a predetermined time period, an over-drive voltage which has an amplitude exceeding at least one of rising and falling of the control signal; and supplies, from one side of the pixel circuit rows, each of the first gate signal lines (gate signal lines 22(*i*)) with the first control signal (write controlling signal CNT22(*i*)) generated by the first shift register unit and the first voltage outputting unit, using the first clock CK1.

In addition, the second gate driving circuit 15: includes (i) N (N=2, in the present embodiment) second shift register units each having the length corresponding to at least 1/N of the number of the pixel circuit rows included in the image display panel (ii) and N second voltage outputting units capable of converting each of the outputs of the second shift register units into a control signal having a predetermined voltage and an amplitude, and applying, for a predetermined time period, an over-drive voltage which has an amplitude exceeding at least one of rising and falling of the control signal (i.e., the second gate driving circuit 15: includes the shift register unit 36A and the shift register unit 36B of the gate driver integrated circuit 30(3)); and supplies, from the other side of the pixel circuit rows, each of the first gate signal lines (gate signal lines 22(*i*)) with the first control signal (write controlling signal CNT22(*i*)) generated by each of the second shift register unit and the second voltage outputting unit, using the second clock CK2 having the Nth cycle of the first clock CK1.

It is to be noted that the various signals supplied to the gate driver integrated circuits 30(1) to 30(3) are not limited to those described above. In addition, FIG. 38 is a second example of the timing chart illustrating an operation of the second gate driving circuit according to Embodiment 1.

The second clock CK2 is supplied to the clock input terminal CkA of the gate signal line driving unit 32A of the gate driver integrated circuit 30(3), the enable signal EN2 having the same shape as the clock CK2 is supplied to the enable input terminal EneA, and the signal DI2 is supplied to the data input terminal DinA.

The clock CK3 having the same cycle as the second clock CK2 and a phase that is different hundred-and-eighty-degree from the second clock CK2 is supplied to the clock input terminal CkB of the gate signal line driving unit 32B of the gate driver integrated circuit 30(3). The enable signal EN3 having the same shape as the clock CK3 is supplied to the enable input terminal EneB. The signal DI2 is supplied to the data input terminal DinB.

In the above-described manner, it is also possible to output the write controlling signals for odd-numbered lines from the gate signal line driving unit 32A, and to output the write controlling signals for even-numbered lines from the gate signal line driving unit 32B.

It is to be noted that the gate driver integrated circuit 30(3), the gate driver integrated circuit 30(1), and the gate driver integrated circuit 30(2) are integrated circuits configured according to the same specification, and thus the package and the arrangement of the input and output terminals are the same among the integrated circuits. For that reason, the gate driver integrated circuit 30 of the first gate driving circuit 14 and the gate driver integrated circuit 30 of the second gate driving circuit 15 need to be mounted so as to be opposite to each other with respect to the image display surface. For example, when the gate driver integrated circuit 30(1) and the gate driver integrated circuit 30(2) are mounted on the front surface side of FIG. 41, the gate driver integrated circuit 30(3) needs to be mounted on the rear surface side of FIG. 41.

However, by adding a function of inverting a signal to be supplied to the output terminals OutA1 to OutA64 and the output terminals OutB1 to OutB64 of the gate driver integrated circuits 30(1) to 30(3), it is possible to mount, on the same surface side, the gate driver integrated circuit 30(1) and the gate driver integrated circuit 30(2) of the first gate driving circuit 14, and the gate driver integrated circuit 30(3) of the second gate driving circuit 15.

Figure 42:
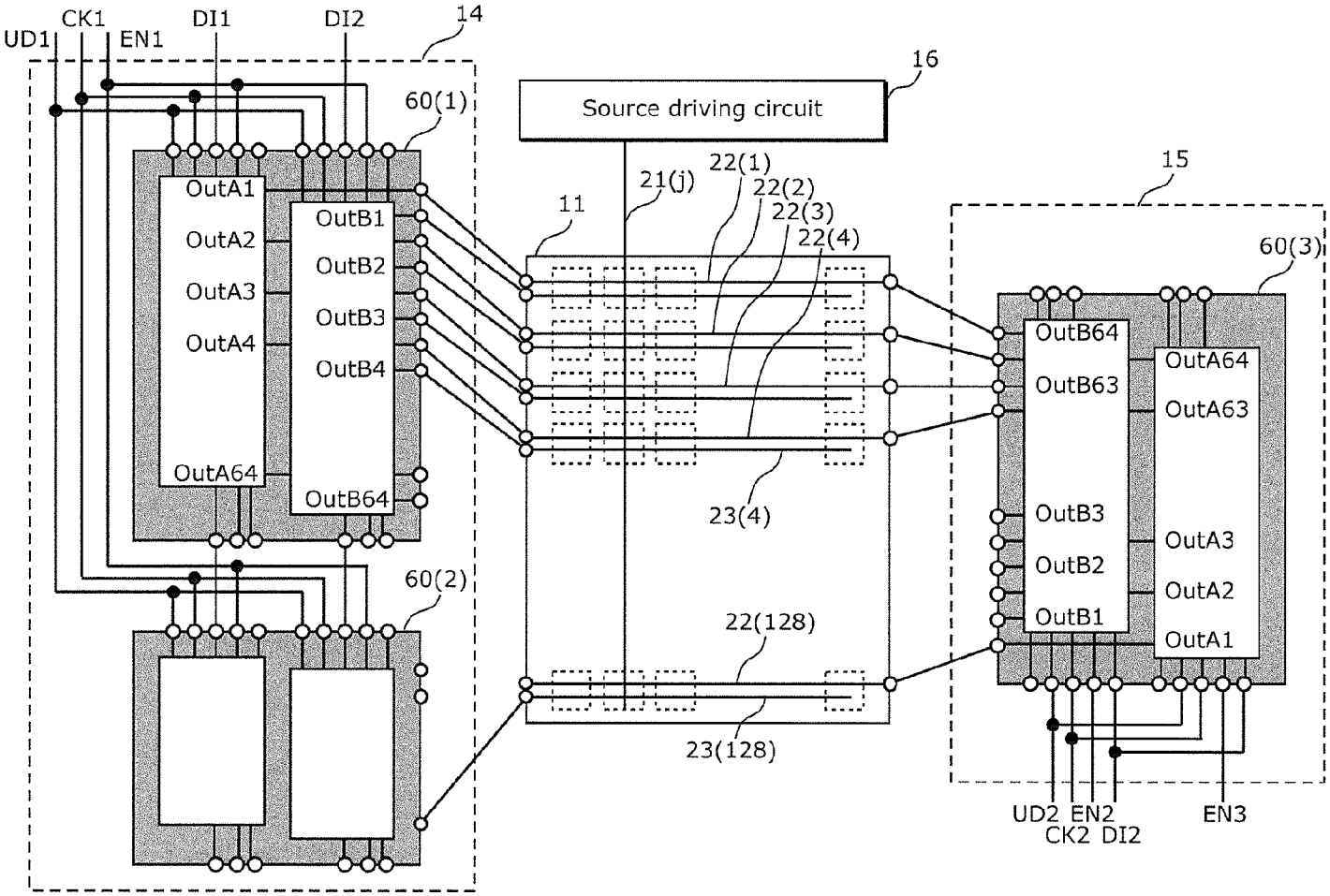
FIG. 42 is a diagram illustrating another example of the configuration of the gate driving circuit according to the second modification example of Embodiment 1.

FIG. 42 is a diagram illustrating another example of the configuration of the gate driving circuit of the image display apparatus according to the second modification example of Embodiment 1. More specifically, FIG. 42 is a configuration diagram illustrating a configuration including a gate driver integrated circuit 60 to which a function of inverting an order of signals to be output to the output terminals OutA1 to OutA64 and the output terminals OutB1 to OutB64 is added.

By inverting the order of signals to be output from the gate driver integrated circuit 60(3) of the second gate driving circuit 15, it is possible to mount the gate driver integrated circuit 60(3) of the second gate driving circuit 15 on the same surface side as the gate driver integrated circuit 60(1) and the gate driver integrated circuit 60(2) of the first gate driving circuit 14.

Figure 43:
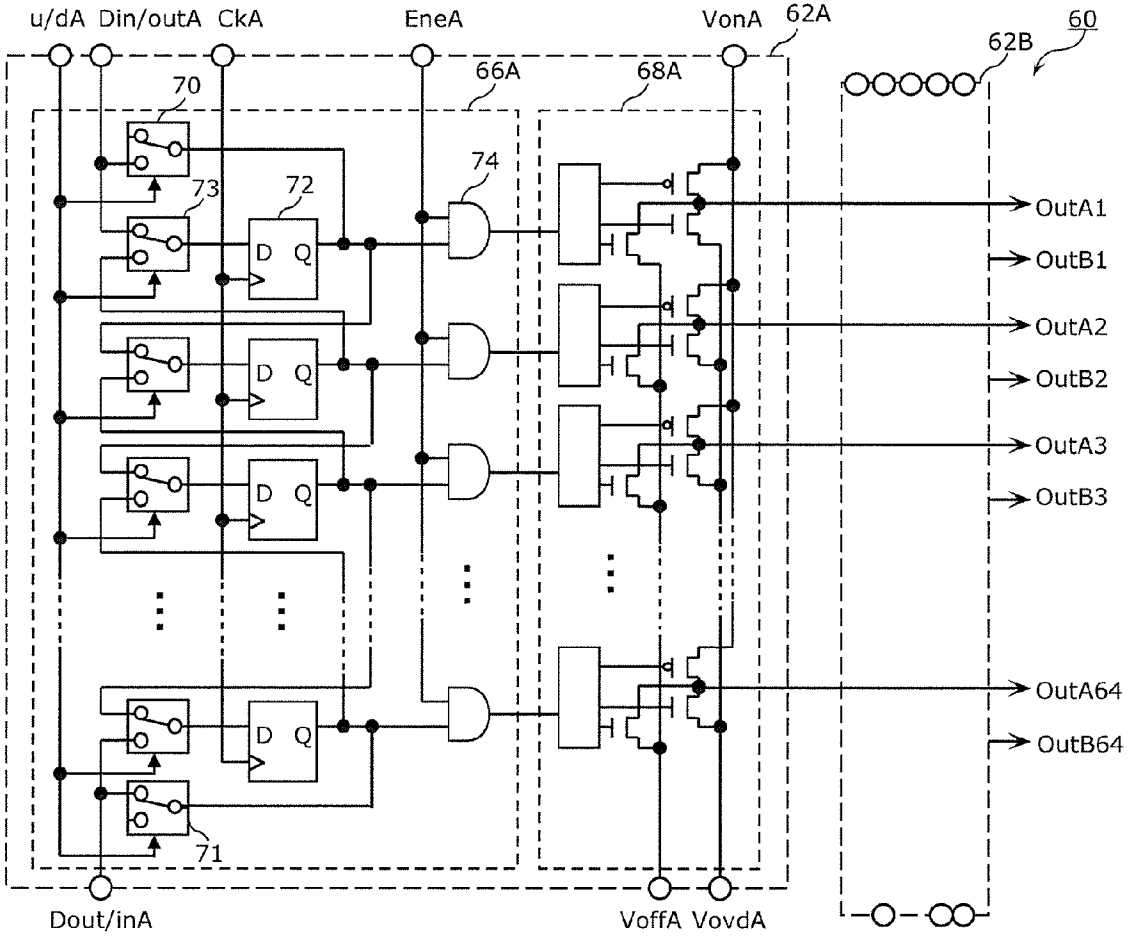
FIG. 43 is a circuit diagram of another gate driver integrated circuit of the image display apparatus according to the second modification example of Embodiment 1.

FIG. 43 is a circuit diagram illustrating another gate driver integrated circuit of the image display apparatus according to the second modification example of Embodiment 1. More specifically, FIG. 43 is a circuit diagram of the gate driver integrated circuit 60 to which the function of inverting the order of signals to be output to the output terminals is added.

The gate driver integrated circuit 60 includes two gate signal line driving units; that is, the gate signal line driving units 62A and 62B. The gate signal line driving unit 62A includes a shift register unit 66A and a voltage outputting unit 68A. The gate signal line driving unit 62B has the same circuit configuration as that of the gate signal line driving unit 62A. In addition, the voltage outputting unit 68A has the same circuit configuration as that of the voltage outputting unit 38A of the gate driver integrated circuit 30. Thus, the following described in detail the shift register unit 66A.

The shift register unit 66A includes 64 D-type flip-flops 72, a selector 73 provided for the input of each of the D-type flip-flops 72, and 64 AND gates 74 each provided for a corresponding one of the outputs of the D-type flip-flops 72.

Each of the clock terminals of the D-type flip-flops 72 is connected to the clock input terminal CkA of the gate driver integrated circuit 60. 64 D-type flip-flops 72 are connected in the cascade arrangement via the selectors 73 so that the shift direction of the shift registers is inverted by selection of the selectors 73. The selectors 70 and 71 each switch input and output of a corresponding one of the data input and output terminals Din/outA and Dout/inA of the shift register unit 66A.

One of the input terminals of each of the AND gates 74 is connected to the output terminal of a corresponding one of the D-type flip-flops 72, and the other is connected to an enable input terminal EneA of the gate driver integrated circuit 60.

When the control terminals u/dA of the selectors 70, 71, and 73 are each at a high level, the shift register unit 66A sequentially shifts in the forward direction, per clock, a digital signal supplied to the data input and output terminal Din/outA, and outputs the digital signal from the output terminal of each of the D-type flip-flops 42. In addition, when the control terminals u/dA are each at a low level, the shift register unit 66A sequentially shifts in the opposite direction, per clock, a digital signal supplied to the data input and output terminal Dout/outA, and outputs the digital signal from the output terminal of each of the D-type flip-flops 42.

At this time, when the enable input terminal EneA is at a high level, the output of each of the D-type flip-flops 72 is output from a corresponding one of the AND gates 74. When the enable input terminal EneA is at a low level, all of the AND gates 74 output a low level voltage irrespective of the output of the D-type flip-flop 72.

According to the configuration described above, it is possible to add the function of inverting the order of signals to be output to the output terminals OutA1 to OutA64 of the gate signal line driving unit 62A.

It is to be noted that, in the present embodiment, the image display panel 11 is exemplified which includes the pixel circuits 12(*i, j*) arranged in a matrix each of which includes one of the gate signal lines 22(*j*) on which the bilateral driving is performed, and one of the gate signal lines 23(*j*) on which the unilateral driving is performed, in order to simplify the description. However, the number of the gate signal lines of the pixel circuit is generally not limited to the number described above, and the number of the gate signal lines on which the bilateral driving is performed and the number of the gate signal lines on which the unilateral driving is performed are optimally determined according to the configuration of the pixel circuit.

Embodiment 2

The following describes an example of an image display apparatus including an image display panel 111 in which a plurality of pixel circuits are disposed each of which includes one gate signal line to which the bilateral driving and the gate voltage ternary driving are applied, and three gate signal lines to which the unilateral driving and the gate voltage binary driving is applied.

It is to be noted that, it is assumed that the number of pixels in the row direction of the image display panel 111 is n=256 for the purpose of illustration. It is also assumed that the gate signal line driving units each having 64-pixel outputs are integrated for four circuits in a single gate driver integrated circuit. However, the number of pixels in the row direction of the image display panel 111, and the number of the gate signal line driving units of the gate driving circuit and the number of the outputs thereof, according to the present invention, are not limited to those described above.

Figure 44:
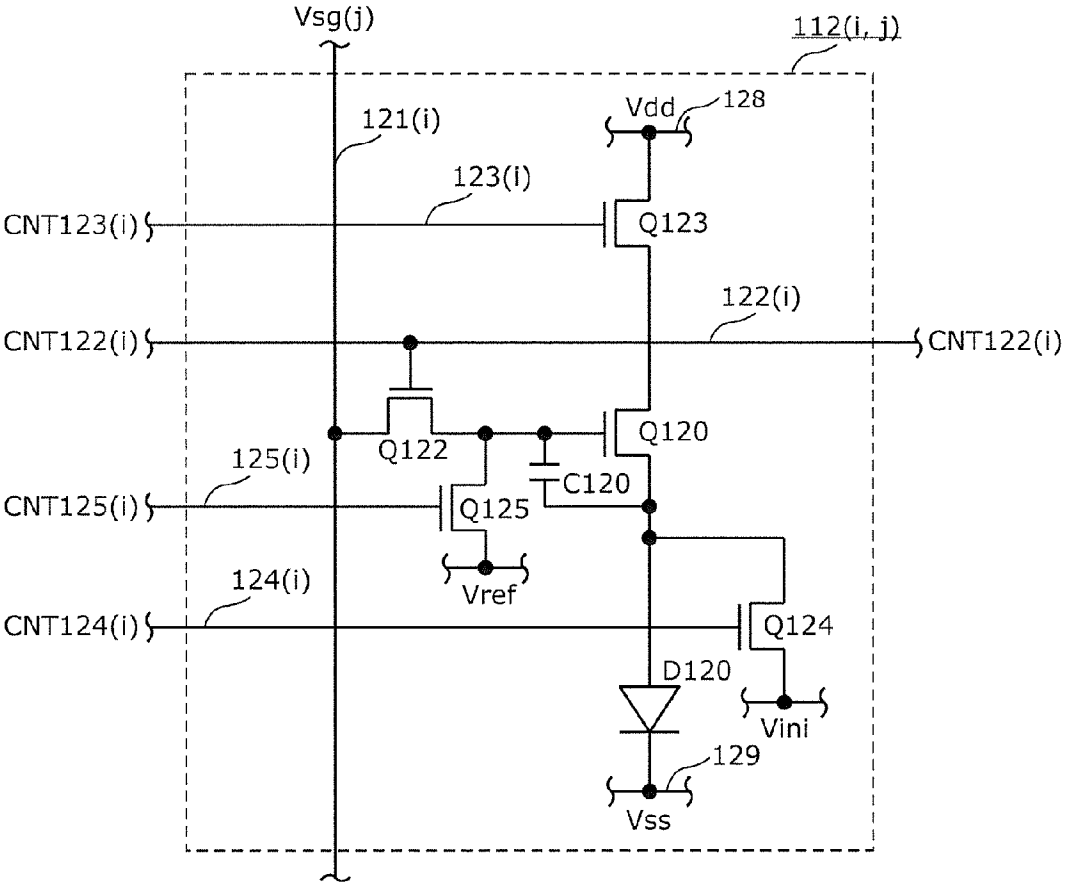
FIG. 44 is a circuit diagram illustrating a pixel circuit of an image display apparatus according to Embodiment 2.

FIG. 44 is a circuit diagram illustrating a pixel circuit of the image display apparatus according to Embodiment 2. The pixel circuit 112(*i, j*) according to the present embodiment includes: an EL element D120; a driving transistor Q120; a capacitor C120; and transistors Q122, Q123, Q124, and Q125 each operating as a switch.

The driving transistor Q120 supplies the EL element D120 with a current according to an image signal voltage Vsg(j). The capacitor C120 holds the image signal voltage Vsg(j). The transistor Q122 is a switch for writing the image signal voltage Vsg(j) to the capacitor C120. The transistor Q123 is a switch which supplies the EL element D120 with a current to cause the EL element D120 to emit light. The transistor Q124 is a switch which applies a voltage Vini to the source of the driving transistor Q120, and the transistor Q125 is a switch which applies a voltage Vref to the gate terminal of the driving transistor Q120.

The pixel circuit 112(*i, j*) includes an anode power line 128 on the high-voltage side and a cathode power line 129 on the low-voltage side. The anode power line 128 is supplied with a voltage Vdd from the power supply circuit. The cathode power line 129 is supplied with a voltage Vss from the power supply circuit. The drain of the transistor Q123 is connected to the anode power line 128 on the high-voltage side, and the source of the transistor Q123 is connected to the drain of the driving transistor Q120. The source of the driving transistor Q120 is connected to the anode of the EL element D120, and the cathode of the EL element D120 is connected to the cathode power line 129 on the low-voltage side.

The capacitor C120 is connected between the gate and the source of the driving transistor Q120. The drain (or source) of the transistor Q124 is connected to the source of the driving transistor Q120, and the source (or drain) of the transistor Q124 is connected to a power line of the voltage Vini. The drain (or source) of the transistor Q125 is connected to the gate of the driving transistor Q120, and the source (or drain) of the transistor Q125 is connected to a power line of the voltage Vref.

The source (or drain) of the transistor Q122 is connected to the source signal line 121(*j*) that supplies the image signal voltage Vsg (j), and the drain (or source) of the transistor Q122 is connected to a gate terminal of the driving transistor Q120.

In addition, the gate of the transistor Q122 is connected to the gate signal line 122(*i*), the gate of the transistor Q123 is connected to the gate signal line 123(*i*), the gate of the transistor Q124 is connected to the gate signal line 124(*i*), and the gate of the transistor Q125 is connected to the gate signal line 125(*i*).

Here, the gate signal line 122(*i*) is drawn from the left side of the image display panel 111 and connected to the first gate driving circuit 114, and also drawn from the right side of the image display panel 111 and connected to the second gate driving circuit 115. In addition, the gate signal lines 123(*i*), 124(*i*), and 125(*i*) are drawn from the left side of the image display panel 111 and connected to the first gate driving circuit 114.

According to the present embodiment as described above, the gate signal line 122(*i*) is the first gate signal line to which the bilateral driving is applied, and the gate signal lines 123(*i*), 124(*i*), and 125(*i*) are each the second gate signal line to which the unilateral driving is applied.

It is to be noted that, although it has been described that each of the driving transistor Q120, the transistors Q122, Q123, Q124, and Q125 is an N-channel thin-film transistor according to the present embodiment, the present invention is not limited to this.

The following describes an operation of the pixel circuit 112(*i, j*).

Figure 45:
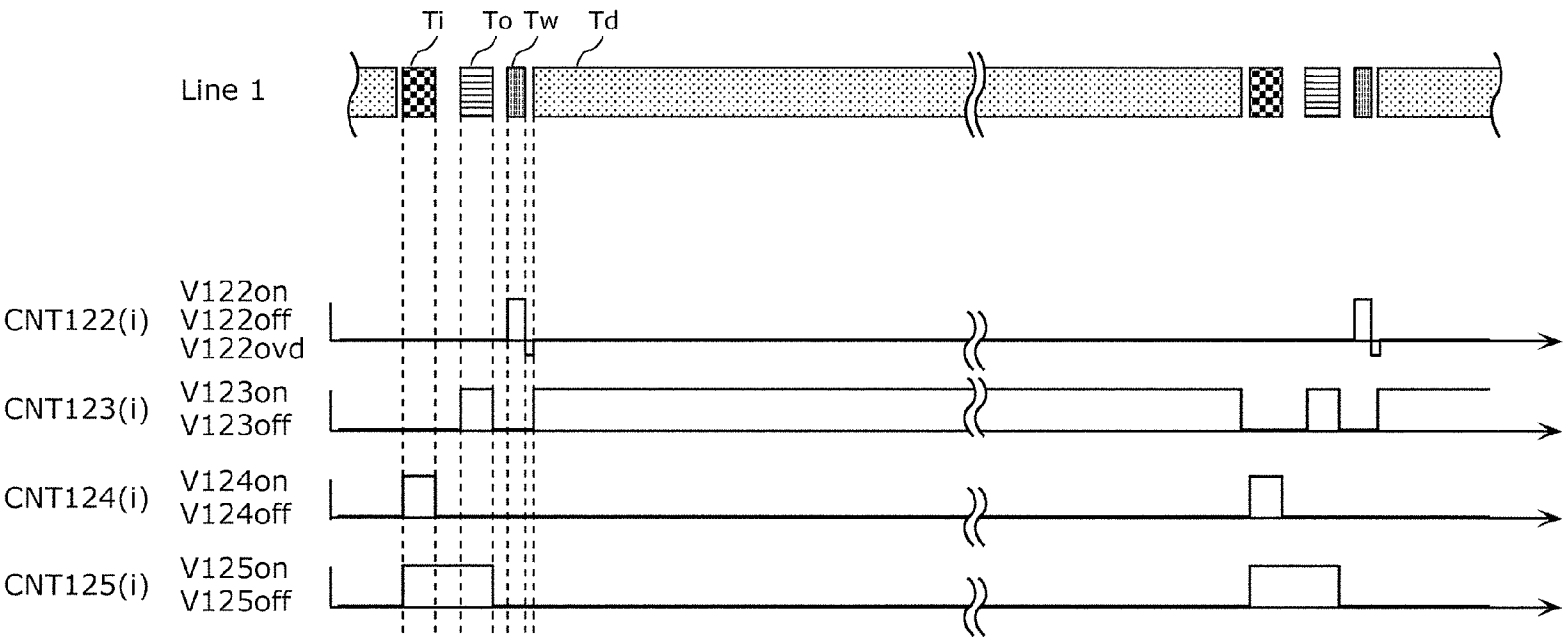
FIG. 45 is a timing chart for explaining an operation of the pixel circuit of the image display apparatus according to Embodiment 2.

FIG. 45 is a timing chart for explaining an operation of the pixel circuit of the image display apparatus according to Embodiment 2. More specifically, FIG. 41 is a timing chart for the pixel circuits 112(*i*, 1) to 112(*i, m*) in the line i.

Each of the pixel circuits 112(*i*, 1) divides one field period into a plurality of periods including: an initialization period Ti; a detecting period To; a writing period Tw; and a display period Td. In the initialization period Ti, a voltage between the terminals of the capacitor C120 is initialized. In the detecting period To, an offset voltage Vos of the driving transistor Q120 is detected. In the writing period Tw, an operation of writing the image signal voltage Vsg(j) to be displayed is performed by the pixel circuit 112(*i, j*). In the display period Td, the EL element D120 is caused to emit light based on the image signal voltage Vsg(j) which has been written.

(Initialization Period Ti)

For performing initialization, the control signal CNT124 (*i*) is set at the voltage V124on to turn ON the transistor Q124, and the control signal CNT125 is set at the voltage V125on to turn ON the transistor Q125. In addition, the write controlling signal 122(*i*) is set at the voltage V122off to turn OFF the transistor Q122, and the display controlling signal CNT123 is set at the voltage V123off to turn OFF the transistor Q123. Then, the source of the driving transistor Q120 is supplied with the voltage Vini, and the gate of the driving transistor Q120 is supplied with the voltage Vref. In such a manner as described above, the voltage between the terminals of the capacitor C120 is set at a voltage (Vref−Vini). Since the voltage Vini is set at a voltage lower than or equal to the voltage Vss, the EL element D120 does not emit light.

Subsequently, the control signal CNT124 is set at the voltage V124off to turn OFF the transistor Q124.

(Detecting Period To)

Next, the display controlling signal CNT 123(*i*) is set at the voltage V123on to turn ON the transistor Q123. Then, since the voltage (Vref−Vini) of the capacitor C120 is applied between the gate and the source of the driving transistor Q120, a current starts to flow from the anode power line 128 on the high-voltage side via the transistor Q123 and the driving transistor Q120, and the capacitor C120 starts to discharge. Then, the voltage between the terminals of the capacitor C120 is set at the offset voltage Vos of the driving transistor Q120, and the current stops flowing. At this time, the voltage at the anode of the EL element D120 increases to a voltage (Vref−Vos). However, since the voltage (Vref−Vos) is lower than the voltage between the anode and the cathode when a current starts to flow through the EL element D120, the EL element D120 does not emit light. It is to be noted that, when a current does not flow through the EL element D120, the EL element D120 operates as a capacitor having a large capacitance between the anode and the cathode.

Subsequently, the control signal CNT125 is set at the voltage V125off to turn OFF the transistor Q125, and the control signal CNT123 is set at the voltage V123off to turn OFF the transistor Q123.

(Writing Period Tw)

For performing the writing operation, the write controlling signal CNT122(*i*) is set at the voltage V122on to turn ON the transistor Q122 while the transistor Q123, the transistor Q124, and the transistor Q125 are kept in the OFF state. Then, the voltage at the gate of the driving transistor Q120 is set at the image signal voltage Vsg(j). At this time, since the EL element D120 operates as a capacitor having a sufficiently large capacitance compared to the capacitor C120, the voltage at the anode of the EL element D120 is maintained at the voltage (Vref−Vos). Accordingly, the capacitor C120 is charged to have a voltage (Vsg(j)−(Vref−Vos)); that is, a voltage ((Vsg(j)+Vos)−(Vref), between the terminals.

Subsequent to the writing operation, the write controlling signal CNT122(*i*) is set at the voltage V122off to turn OFF the transistor Q122.

According to the present embodiment as well, an overdrive voltage V122*ovd* is applied for a predetermined time period so that an amplitude exceeds an absolute value of the voltage (V122on−V122off) at falling of the write controlling signal CNT122(*i*) when switching the transistor Q122 from the ON state to the OFF state. Subsequently, the voltage V122off is applied to keep the transistor Q122 in the OFF state.

(Display Period Td)

The display controlling signal CNT123(*i*) is set at the voltage V123on to turn ON the transistor Q123 while each of the transistor Q122, the transistor Q124, and the transistor Q125 is kept in the OFF state. Then, a current according to the voltage between the gate and the source (Vsg(j)+Vos) flows through the EL element D120.

Here, the voltage Vos is an offset voltage Vos of the driving transistor Q120. Accordingly, the current that flows through the EL element D120 depends on the voltage Vsg(j) that results from subtracting the offset voltage Vos from the voltage between the gate and source of the driving transistor Q120 (Vsg(j)+Vos). In such a manner as described above, in the display period Td, the EL element D120 is caused to emit light with a luminance depending on the image signal voltage Vsg(j) which has been written in the writing period Tw. In general, the offset voltage Vos of the driving transistor Q120 has large variation in its value. However, according to the present embodiment, it is possible to display an image while suppressing the effect of variation in the value of the offset voltage Vos.

It is to be noted that, in the present embodiment, the initialization period Ti and the detecting period To are each set as one horizontal retrace period, and for further stabilization of the operation, a period between the initialization period Ti and the detecting period To is also set as one horizontal retrace period. In addition, in order to improve the luminance of the image display apparatus 110, most part of the one field period other than the initialization period Ti, the detecting period To, and the writing period Tw is the display period Td, according to the present embodiment. In addition, the time period of the writing period Tw is 3.5 μs as with Embodiment 1.

Next, an operation of the image display apparatus 110 according to the present embodiment will be described.

Figure 46:
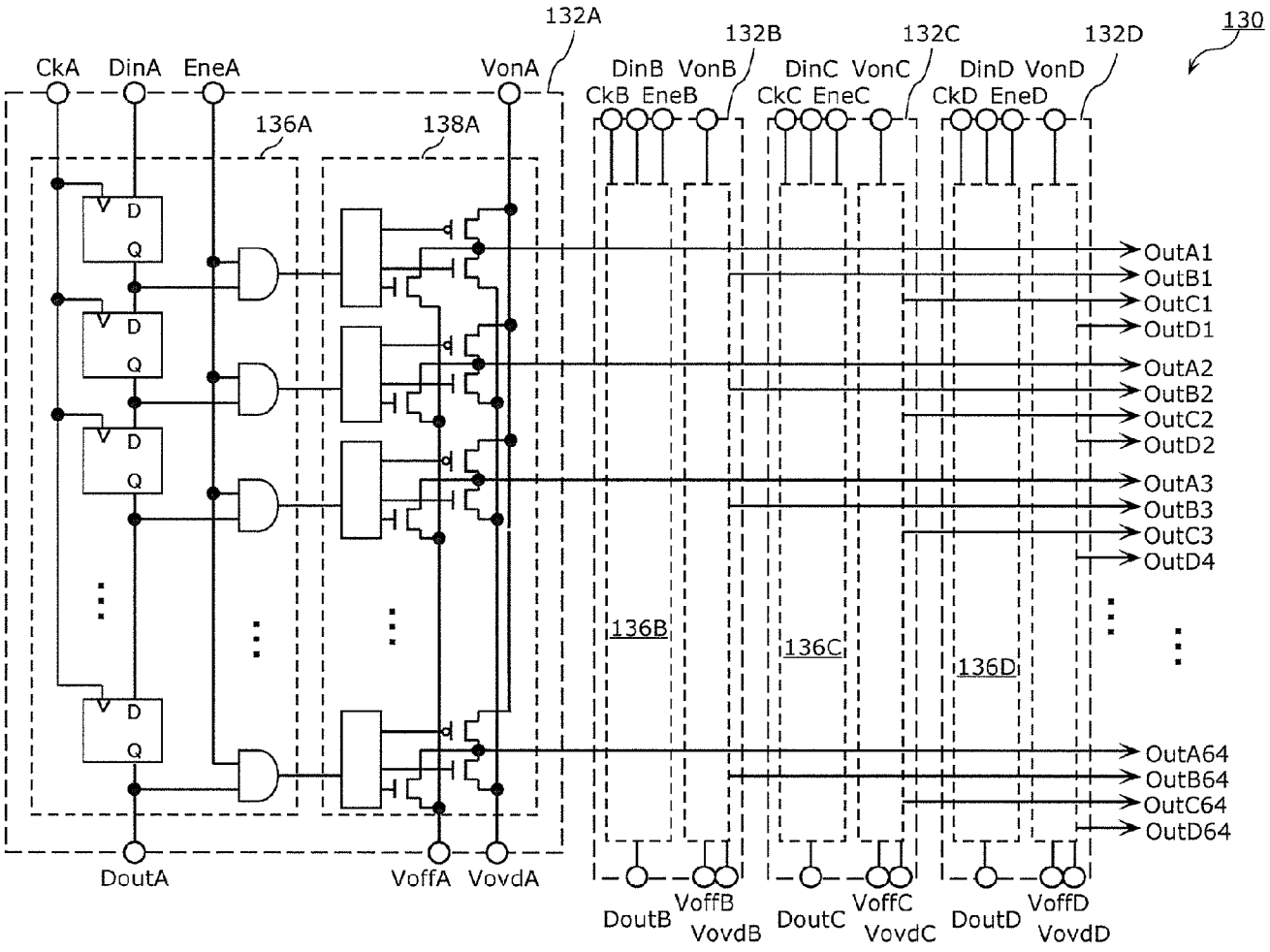
FIG. 46 is a circuit diagram of a gate driver integrated circuit of the image display apparatus according to Embodiment 2.

FIG. 46 is a circuit diagram of a gate driver integrated circuit of the image display apparatus according to Embodiment 2. A gate driver integrated circuit 130 according to the present embodiment includes four gate signal line driving units 132A, 132B, 132C, and 132D. The gate signal line driving units 132A, 132B, 132C, and 132D each have the same configuration as the gate signal line driving unit 32A of the gate driver integrated circuit 30 according to Embodiment 1.

The gate signal line driving unit 132A is connected to the clock input terminal CkA, the data input terminal DinA, the enable input terminal EneA, the data output terminal DoutA, power supply terminal VonA, the power supply terminal VoffA, the power supply terminal VovdA, and the output terminal OutAi (1≤i≤64), of the gate driver integrated circuit 130.

In the same manner as above, the gate signal line driving unit 132B is connected to the clock input terminal CkB, the data input terminal DinB, the enable input terminal EneB, the data output terminal DoutB, power supply terminal VonB, the power supply terminal VoffB, the power supply terminal VovdB, and the output terminal OutBi, of the gate driver integrated circuit 130. The gate signal line driving unit 132C is connected to the clock input terminal CkC, the data input terminal DinC, the enable input terminal EneC, the data output terminal DoutC, power supply terminal VonC, the power supply terminal VoffC, the power supply terminal VovdC, and the output terminal OutCi, of the gate driver integrated circuit 130. The gate signal line driving unit 132D is connected to the clock input terminal CkD, the data input terminal DinD, the enable input terminal EneD, the data output terminal DoutD, power supply terminal VonD, the power supply terminal VoffD, the power supply terminal VovdD, and the output terminal OutDi, of the gate driver integrated circuit 130.

The data output terminals of the gate driver integrated circuit 130 are arranged in the following order: OutA1, OutB1, OutC1, OutD1, OutA2, OutB2, OutC2, OutD2, . . . , OutA64, OutB64, OutC64, and OutD64.

Figure 47:
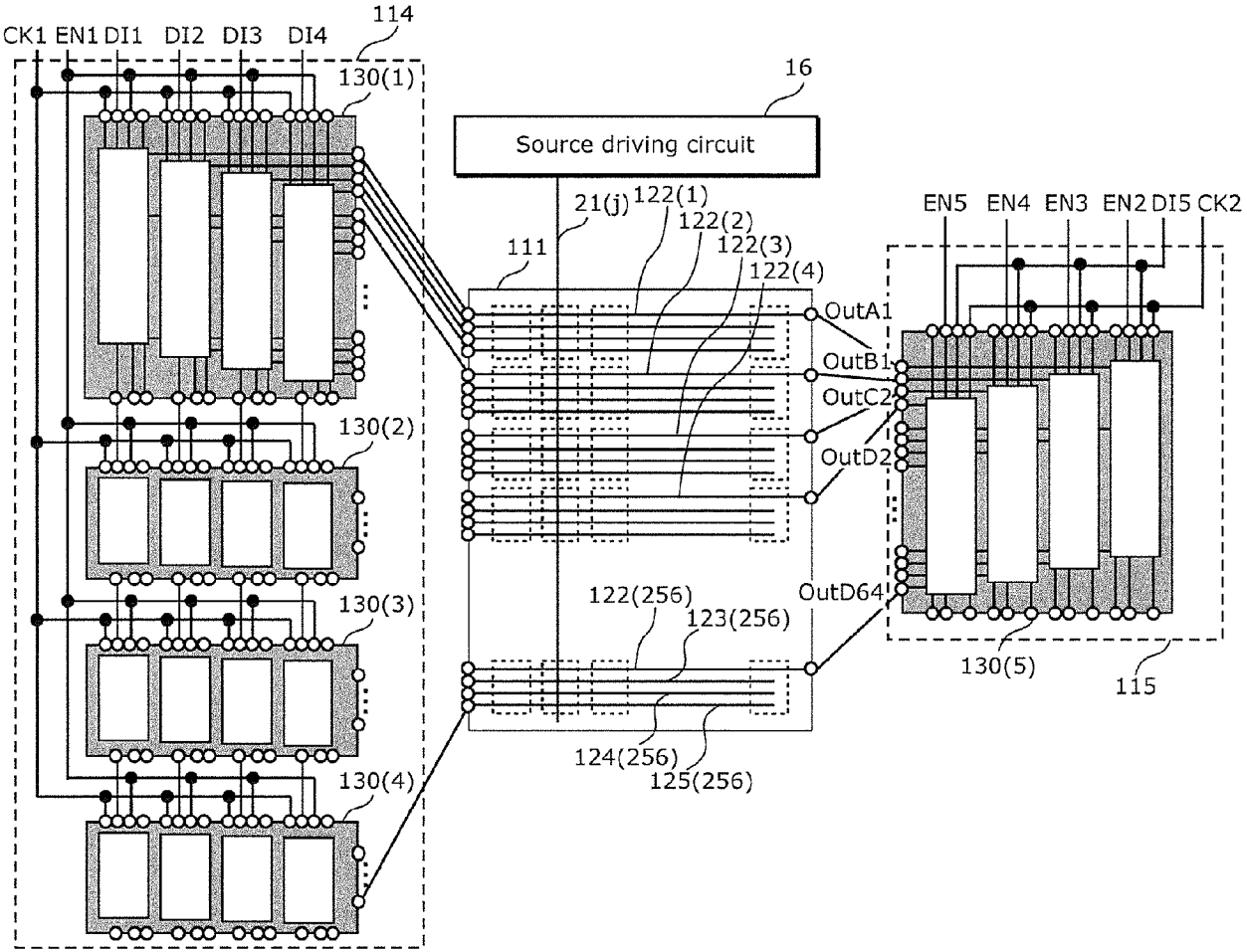
FIG. 47 is a configuration diagram of a gate driving circuit of the image display apparatus according to Embodiment 2.

FIG. 47 is a configuration diagram of a gate driving circuit of the image display apparatus according to Embodiment 2. It is to be noted that, the power supply terminal VonA, the power supply terminal VoffA, the power supply terminal VovdA, the power supply terminal VonB, the power supply terminal VoffB, the power supply terminal VovdB, the power supply terminal VonC, the power supply terminal VoffC, the power supply terminal VovdC, the power supply terminal VonD, the power supply terminal VoffD, and the power supply terminal VovdD are omitted in FIG. 47.

The first gate driving circuit 114 includes four gate driver integrated circuits 130(1) to 130(4), and the second gate driving circuit 115 includes a single gate driver integrate circuit 130(5). Here, the gate driver integrated circuits 130(1) to 130(5) each have the same circuit configuration as the gate driver integrated circuit 130 illustrated in FIG. 46.

The output terminals of the gate driver integrated circuits 130(1) to 130(4) mounted on the first gate driving circuit 114 are connected to gate signal lines which are drawn to the left side of the image display panel 111.

According to the present embodiment, each of the gate signal lines 122(1) to 122(64) is connected to a corresponding one of the output terminals OutA1 to OutA64 of the gate driver integrated circuit 130(1). Each of the gate signal lines 123(1) to 123(64) is connected to a corresponding one of the output terminals OutB1 to OutB64 of the gate driver integrated circuit 130(1). Each of the gate signal lines 124(1) to 124(64) is connected to a corresponding one of the output terminals OutC1 to OutC64 of the gate driver integrated circuit 130(1). Each of the gate signal lines 125(1) to 125(64) is connected to a corresponding one of the output terminals OutD1 to OutD64 of the gate driver integrated circuit 130(1).

Furthermore, each of the gate signal lines 122(65) to 122(128) is connected to a corresponding one of the output terminals OutA1 to OutA64 of the gate driver integrated circuit 130(2). Each of the gate signal lines 123(65) to 123(128) is connected to a corresponding one of the output terminals OutB1 to OutB64 of the gate driver integrated circuit 130(2). Each of the gate signal lines 124(65) to 124(128) is connected to a corresponding one of the output terminals OutC1 to OutC64 of the gate driver integrated circuit 130(2). Each of the gate signal lines 125(65) to 125(128) is connected to a corresponding one of the output terminals OutD1 to OutD64 of the gate driver integrated circuit 130(2).

Each of the gate signal lines 122(129) to 122(192) is connected to a corresponding one of the output terminals OutA1 to OutA64 of the gate driver integrated circuit 130(3). Each of the gate signal lines 123(129) to 123(192) is connected to a corresponding one of the output terminals OutB1 to OutB64 of the gate driver integrated circuit 130(3). Each of the gate signal lines 124(129) to 124(192) is connected to a corresponding one of the output terminals OutC1 to OutC64 of the gate driver integrated circuit 130(3). Each of the gate signal lines 125(129) to 125(192) is connected to a corresponding one of the output terminals OutD1 to OutD64 of the gate driver integrated circuit 130(3).

Each of the gate signal lines 122(193) to 122(256) is connected to a corresponding one of the output terminals OutA1 to OutA64 of the gate driver integrated circuit 130(4). Each of the gate signal lines 123(193) to 123(256) is connected to a corresponding one of the output terminals OutB1 to OutB64 of the gate driver integrated circuit 130(4).

Each of the gate signal lines 124(193) to 124(256) is connected to a corresponding one of the output terminals OutC1 to OutC64 of the gate driver integrated circuit 130(4). Each of the gate signal lines 125(193) to 125(256) is connected to a corresponding one of the output terminals OutD1 to OutD64 of the gate driver integrated circuit 130(4).

The clock input terminals CkA, CkB, CkC, and CkD of the gate driver integrated circuit 130(1), the clock input terminals CkA, CkB, CkC, and CkD of the gate driver integrated circuit 130(2), the clock input terminals CkA, CkB, CkC, and CkD of the gate driver integrated circuit 130(3), and the clock input terminals CkA, CkB, CkC, and CkD of the gate driver integrated circuit 130(4) are connected, respectively, and the first clock CK1 is supplied.

The enable input terminals EneA, EneB, EneC, and EneD of the gate driver integrated circuit 130(1), the enable input terminals EneA, EneB, EneC, and EneD of the gate driver integrated circuit 130(2), the enable input terminals EneA, EneB, EneC, and EneD of the gate driver integrated circuit 130(3), and the enable input terminals EneA, EneB, EneC, and EneD of the gate driver integrated circuit 130(4) are connected, respectively, and the enable signal EN1 is supplied.

Each of the data output terminals DoutA, DoutB, DoutC, and DoutD of the gate driver integrated circuit 130(1) is connected to a corresponding one of the data input terminals DinA, DinB, DinC, and DinD of the gate driver integrated circuit 130(2). Each of the data output terminals DoutA, DoutB, DoutC, and DoutD of the gate driver integrated circuit 130(2) is connected to a corresponding one of the data input terminals DinA, DinB, DinC, and DinD of the gate driver integrated circuit 130(3). Each of the data output terminals DoutA, DoutB, DoutC, and DoutD of the gate driver integrated circuit 130(3) is connected to a corresponding one of the data input terminals DinA, DinB, DinC, and DinD of the gate driver integrated circuit 130(4).

In such a manner as described above, the gate driver integrated circuits 130(1) to 130(4) are connected in a cascade arrangement.

The signal DI1 is supplied to the data input terminal DinA of the gate driver integrated circuit 130(1). The signal DI2 is supplied to the data input terminal DinB of the gate driver integrated circuit 130(1). The signal DI3 is supplied to the data input terminal DinC of the gate driver integrated circuit 130(1). The signal DI4 is supplied to the data input terminal DinD of the gate driver integrated circuit 130(1).

In addition, although omitted in FIG. 47, the power supply terminals VonA of the gate driver integrated circuits 30(1) to 30(4) are mutually connected, and the voltage V122on is supplied. The power supply terminals VoffA of the gate driver integrated circuits 30(1) to 30(4) are mutually connected and supplied with the voltage V122off. The power supply terminals VovdA of the gate driver integrated circuits 30(1) to 30(4) are mutually connected and supplied with the voltage V122*ovd*.

In addition, the power supply terminals VonB of the gate driver integrated circuits 30(1) to 30(4) are mutually connected, and the voltage V123on is supplied. The power supply terminals VoffB and the power supply terminals VovdB of the gate driver integrated circuits 30(1) to 30(4) are mutually connected, and the voltage V123off is supplied. The power supply terminals VonC of the gate driver integrated circuits 30(1) to 30(4) are mutually connected, and the voltage V124on is supplied. The power supply terminals VoffC and the power supply terminals VovdC of the gate driver integrated circuits 30(1) to 30(4) are mutually connected and supplied with the voltage V124off. The power supply terminals VonD of the gate driver integrated circuits 30(1) to 30(4) are mutually connected, and the voltage V125on is supplied. The power supply terminals VoffD and the power supply terminals VovdD of the gate driver integrated circuits 30(1) to 30(4) are mutually connected and supplied with the voltage V125off.

Meanwhile, the gate signal lines 122(1) to 122(256) which are drawn to the right side of the image display panel 111 are connected to the gate driver integrated circuit 130(5) mounted on the second gate driving circuit 115.

According to the present embodiment, among the gate signal lines 122(1) to 122(256), the (a multiple of 4+1)th gate signal line 122(1) is connected to the output terminal OutA1 of the gate driver integrated circuit 130(5). The gate signal line 122(5) is connected to the output terminal OutA2 of the gate driver integrated circuit 130(5), the gate signal line 122(9) is connected to the output terminal OutA3 of the gate driver integrated circuit 130(5), . . . , and the gate signal line 122(253) is connected to the output terminal OutA64 of the gate driver integrated circuit 130(5).

The (a multiple of 4+2)th gate signal line 122(2) is connected to the output terminal OutB1 of the gate driver integrated circuit 130(5). The gate signal line 122(6) is connected to the output terminal OutB2 of the gate driver integrated circuit 130(5), the gate signal line 122(10) is connected to the output terminal OutB3 of the gate driver integrated circuit 130(5), . . . , and the gate signal line 122(254) is connected to the output terminal OutB64 of the gate driver integrated circuit 130(5).

The (a multiple of 4+3)th gate signal line 122(3) is connected to the output terminal OutC1 of the gate driver integrated circuit 130(5). The gate signal line 122(7) is connected to the output terminal OutC2 of the gate driver integrated circuit 130(5). The gate signal line 122(11) is connected to the output terminal OutC3 of the gate driver integrated circuit 130(5), . . . , and the gate signal line 122(255) is connected to the output terminal OutC64 of the gate driver integrated circuit 130(5).

The (a multiple of 4)th gate signal line 122(4) is connected to the output terminal OutD1 of the gate driver integrated circuit 130(5). The gate signal line 122(8) is connected to the output terminal OutD2 of the gate driver integrated circuit 130(5). The gate signal line 122(12) is connected to the output terminal OutD3 of the gate driver integrated circuit 130(5), . . . , and the gate signal line 122(256) is connected to the output terminal OutD64 of the gate driver integrated circuit 130(5).

The clock input terminals CkA, CkB, CkC, and CkD of the gate driver integrated circuit 130(5) are mutually connected and supplied with the second clock CK2. Furthermore, the enable input terminal EneA, the enable input terminal EneB, the enable input terminal EneC, and the enable input terminal EneD, of the gate driver integrated circuit 130(5) are supplied with an enable signal EN2, an enable signal EN3, an enable signal EN4, and an enable signal EN5, respectively. The data input terminals DinA, DinB, DinC, and DinD of the gate driver integrated circuit 130(5) are mutually connected and supplied with the signal DI5 for generating the write controlling signals CNT122(1) to CNT122(256).

Although omitted in FIG. 47, the power supply terminals VonA, VonB, VonC, and VonD of the gate driver integrated circuits 130(5) are mutually connected and supplied with the voltage V122on. The power supply terminals VoffA, VoffB, VoffC, and VoffD are mutually connected and supplied with the voltage V122off. The power supply terminals VovdA, VovdB, VovdC, and VovdD are mutually connected and supplied with the voltage V122*ovd*.

Next, operations of the first gate driving circuit 114 and the second gate driving circuit 115 will be described in detail below.

The first clock CK1 having a cycle of 3.5 μs is supplied to the clock input terminals CkA, CkB, CkC, and CkD of the gate driver integrated circuits 130(1) to 130(4) of the first gate driving circuit 114, and the enable input terminal EneA is fixed to a high level.

The data input terminal DinA of the gate driver integrated circuit 130(1) is supplied with the signal DI1 for generating the write controlling signals CNT122(1) to CNT122(256). The data input terminal DinB of the gate driver integrated circuit 130(1) is supplied with the signal DI2 for generating the display controlling signals CNT123(1) to CNT123(256). The data input terminal DinC of the gate driver integrated circuit 130(1) is supplied with the signal DI3 for generating the control signals CNT124(1) to CNT124(256). The data input terminal DinD of the gate driver integrated circuit 130(1) is supplied with the signal DI4 for generating the control signals CNT125(1) to CNT125(256).

Each of the signals DI1, DI2, DI3, and DI4 is shifted every time the clock CK1 is supplied to the clock terminals of the gate driver integrated circuits 130(1) to 130(4), and corresponding control signals are output. As described above, the write controlling signals CNT122(1) to CNT122(256) which are the first control signals are output from the output terminals OutA1 to OutA64 of the gate driver integrated circuits 130(1) to 130(4). The display controlling signals CNT123(1) to CNT123(256) are output from the output terminals OutB1 to OutB64. The control signals CNT124(1) to CNT124(256) are output from the output terminals OutC1 to OutC64. The control signals CNT125(1) to CNT125(256) are output from the output terminals OutD1 to OutD64.

Figure 48:
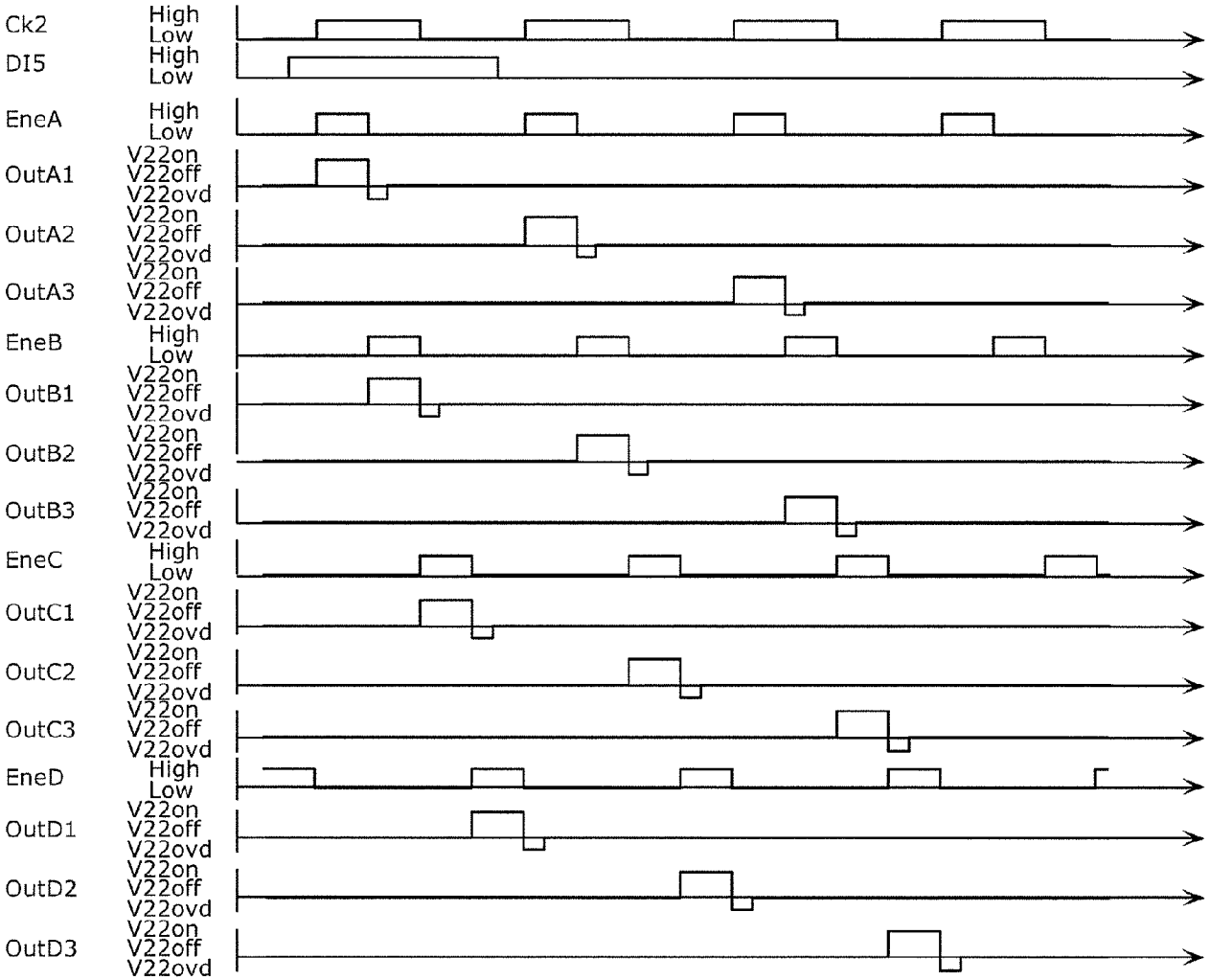
FIG. 48 is a timing chart illustrating an operation of a second gate driving circuit of the image display apparatus according to Embodiment 2.

FIG. 48 is a timing chart illustrating an operation of a second gate driving circuit of the image display apparatus according to Embodiment 2.

The second clock CK2 having a cycle of 14 μs that is a quadruple of the clock CK1 is supplied to the clock input terminals CkA, CkB, CkC, and CkD of the gate driver integrated circuit 130(5). The data input terminals DinA, DinB, DinC, and DinD of the gate driver integrated circuit 130(5) are supplied with the signal DI5 for generating the write controlling signals CNT122(1) to CNT122(256).

The enable input terminal EneA is supplied with the enable signal EN2 which has: the same cycle as the clock CK2; a duty of ¼; and the same timing of rising as the clock CK2. The enable input terminal EneB is supplied with the enable signal EN3 having a phase delayed by 90° from the enable signal EN2. The enable input terminal EneC is supplied with the enable signal EN4 having a phase further delayed by 90° from the enable signal EN3. The enable input terminal EneD is supplied with the enable signal EN5 having a phase further delayed by 90° from the enable signal EN4.

The gate driver integrated circuit 130(5) shifts the signal D15 every time the clock CK2 is supplied. Then, a logical AND with the enable signal EN2 is obtained, and the second write controlling signals CNT22(1), CNT22(5), . . . , and CNT22(253) are output. A logical AND with the enable signal EN3 is obtained, and the second write controlling signals CNT22(2), CNT22(6), . . . , and CNT22(254) are output. A logical AND with the enable signal EN4 is obtained, and the second write controlling signals CNT22(3), CNT22(7), . . . , and CNT22(255) are output. A logical AND with the enable signal EN5 is obtained, and the second write controlling signals CNT22(4), CNT22(8), . . . , and CNT22(256) are output.

As described above, according to Embodiment 2 as well, the first gate driving circuit 114: includes the gate driver integrated circuits 130(1) to 130(4) which are connected in the cascade arrangement, and thereby includes (i) a first shift register unit (i.e., the shift register unit 36A of the gate driver integrated circuits 130(1) to 130(4) which are connected in the cascade arrangement) having a length corresponding to at least the same number of the pixel circuit rows included in the image display panel, and (ii) a first voltage outputting unit capable of converting each of the outputs of the first shift register unit into a control signal having a predetermined voltage and amplitude and applying, for a predetermined time period, an over-drive voltage which has an amplitude exceeding at least one of rising and falling of the control signal; and supplies, from one side of the pixel circuit rows, each of the first gate signal lines (gate signal lines 122(*i*)) with the first control signal (write controlling signal CNT122(*i*)) generated by the first shift register unit and the first voltage outputting unit, using the first clock CK1.

In addition, the second gate driving circuit 115: includes (i) N (N=4, in the present embodiment) second shift register units each having the length corresponding to at least 1/N of the number of the pixel circuit rows included in the image display panel, and (ii) N second voltage outputting units each capable of converting each of the outputs of the second shift register units into a control signal having a predetermined voltage and an amplitude, and applying, for a predetermined time period, an over-drive voltage which has an amplitude exceeding at least one of rising and falling of the control signal (i.e., the second gate driving circuit 115: includes the shift register units 136A, 136B, 136C, and 136D of the gate driver integrated circuit 130(5)); and supplies, from the other side of the pixel circuit rows, each of the first gate signal lines (gate signal line 122(*i*)) with the first control signal (write controlling signal CNT122(*i*)) generated by each of the second shift register unit and the second voltage outputting unit, using the second clock CK2 having the Nth cycle of the first clock CK1.

As described above, in the case where M types of gate signal lines are formed for each of the pixel circuits, and among the M types of gate signal lines, the bilateral driving is applied to S types of gate signal lines, and the unilateral driving is applied to (M-S) types of gate signal lines, it is possible to realize the design which satisfies (the number of gate driver integrated circuits used in the first gate driving circuit):(the number of gate driver integrated circuits used in the second gate driving circuit)=M:S.

It is to be noted that, although the gate signal line 124(*i*) performs the bilateral driving and the gate voltage ternary driving and the other gate signal lines 123(*i*), 124(*i*), and 125(*i*) perform the unilateral driving and the gate voltage binary driving in Embodiment 2, the present invention is not limited to this. For example, the gate signal line which performs the bilateral driving may perform the gate voltage binary driving, and the gate signal line which performs the unilateral driving may perform the gate voltage ternary driving.

(Others)

In addition, the configurations of the pixel circuit, and the numerical values of voltages, time, etc. illustrated in Embodiments 1 and 2 are presented as examples, and it is desirable to optimally set the configuration of the pixel circuit or the numerical values according to the characteristics of the EL element, the specification of the image display apparatus, and the like.

In addition, a multigate (at least a dual gate) configuration is employed for the transistor Q22 illustrated in FIG. 2, the transistors Q122 and Q124 illustrated in FIG. 44, the transistor Q22 illustrated in FIG. 4, and the transistor Q illustrated in FIG. 12, and the LDD configuration is combined, thereby making it possible to suppress the off-leakage and implement excellent contrast and offset cancelling operation In addition, excellent high-luminance display and image display can be implemented.

It is particularly preferable that a multigate (at least a dual gate) configuration is employed for a transistor which applies a video signal to a pixel circuit (for example, the transistor Q22 in FIG. 12). Furthermore, it is preferable that the bilateral driving is performed on a gate signal line to which the transistor which applies a video signal to a pixel circuit is connected. In addition, it is preferable that the gate voltage ternary driving is performed on a gate signal line to which the transistor which applies a video signal to a pixel circuit is connected.

It is possible to apply, to various electronic devices, the details (or part of the details) described in each of the diagrams of the above-described embodiment. To be specific, it is possible to apply them to display units of electronic devices.

Examples of such electronic devices include: a video camera, a digital camera, a head mounted display, a navigation system, an audio reproducing device (a car audio, an audio component, etc.), a computer, a gaming device, a mobile information terminal (a mobile computer, a mobile phone, a mobile gaming device, a digital book, etc.), an image reproducing apparatus including a recording medium (to be specific, a device including a display capable of reproducing a recording medium of a digital versatile disc (DVD) or the like and displaying the image thereof), etc.

Figure 49:
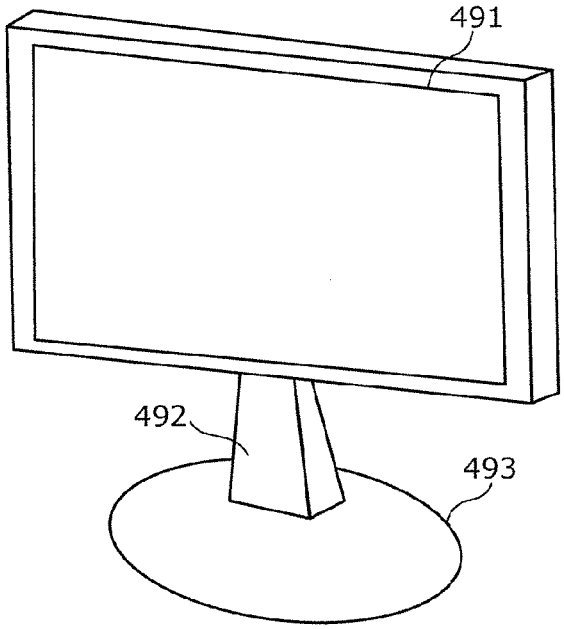
FIG. 49 is a broad overview of a display including the image display apparatus according to the embodiments.

FIG. 49 is a broad overview of a display including an image display apparatus according to the above-described embodiments. The display illustrated in the diagram includes: a support column 492; a holding base 493; and an image display apparatus (image display panel) 491 according to the present disclosure. The display illustrated in FIG. 49 has a function of displaying various information items (a still image, video, a text image, etc.) on a display portion. It is to be noted that the function of the display illustrated in FIG. 49 is not limited to this, and the display can have various functions.

Figure 50:
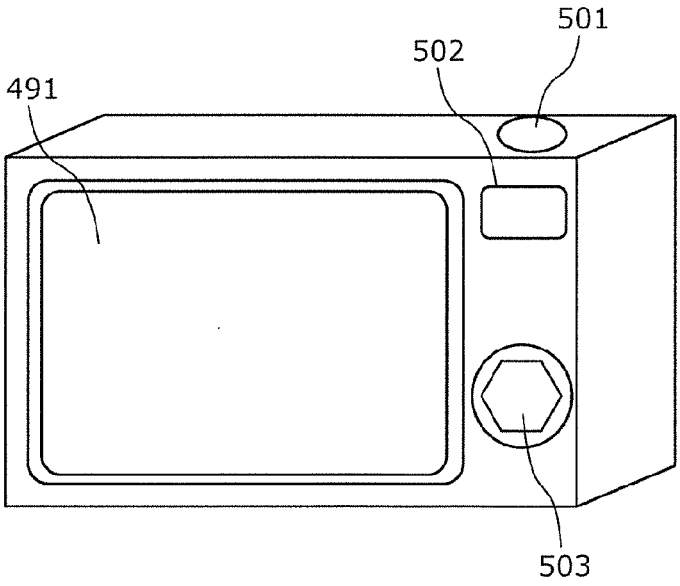
FIG. 50 is a broad overview of a camera including the image display apparatus according to the embodiments.

FIG. 50 is a broad overview of a camera including an image display apparatus according to the above-described embodiments. The camera illustrated in the diagram includes: a shutter 501; a viewfinder 502; a cursor 503; and the image display apparatus (image display panel) 491 according to the present disclosure. The camera illustrated in FIG. 50 has a function of capturing a still image and video. It is to be noted that the functions of the camera illustrated in FIG. 50 are not limited to these functions, and the camera can have various functions.

Figure 51:
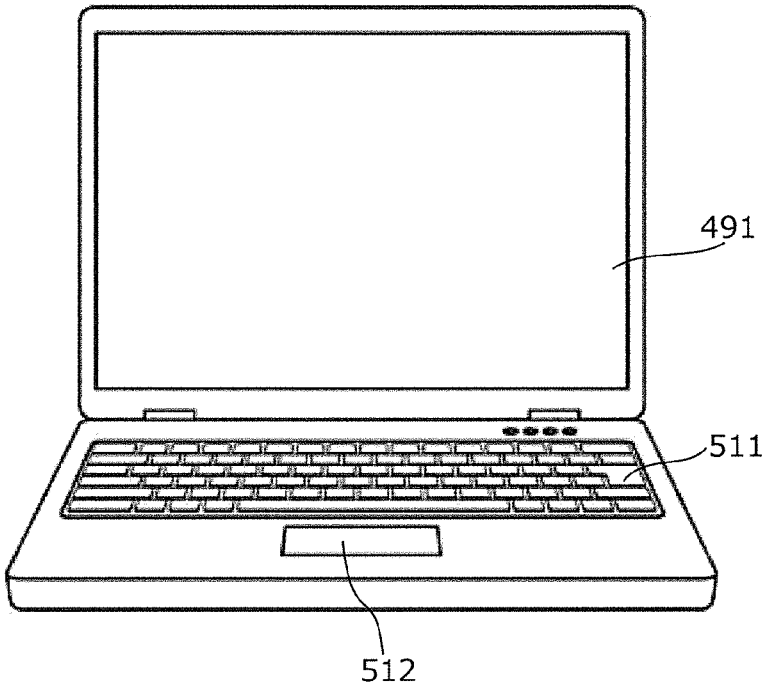
FIG. 51 is a broad overview of a computer including the image display apparatus according to the embodiments.

FIG. 51 is a broad overview of a computer including an image display apparatus according to the above-described embodiments. The computer illustrated in the diagram includes: a keyboard 511; a touch-pad 512; and the image display apparatus (image display panel) 491 according to the present disclosure. The computer illustrated in FIG. 51 has a function of displaying various information items (a still image, video, a text image, etc.) on a display portion. It is to be noted that the function of the computer illustrated in FIG. 51 is not limited to this, and the computer can have various functions.

It should be understood that the above-described embodiments can also be applied to other embodiments. It should also be understood that it is possible to combine the above-described embodiments with other embodiments.

It is possible to upgrade the image quality of the above-described information devices illustrated in FIG. 49 to FIG. 51, by employing, in the configuration of the information devices or the like, the image display apparatus (image display panel) or the driving system described in the above-described embodiments. In addition, it is possible to easily perform test or adjustment.

In the above-described embodiments, the image display apparatus has been described. However, it should be understood that the technical idea described in the Description can be applied not only to the image display apparatus but also to other display apparatuses.

The image display apparatus according to the above-described embodiments is a concept which includes a system device such as an information device. The concept of the display panel includes, in a broad sense, a system device such as an information device.

As described above, the embodiments are described as exemplifications of the technique according to the present disclosure. The attached Drawings and the detailed descriptions are provided for that purpose.

Accordingly, the structural elements described in the attached Drawings and the detailed descriptions may include not only the structural elements which are essential for solving the problems but also the structural elements which are not essential for solving the problems but used for exemplifying the above-described techniques. As such, description of these non-essential structural elements in the accompanying drawings and the detailed description should not be taken to mean that these non-essential structural elements are essential.

Furthermore, since the foregoing embodiments are for exemplifying the technique according to the present disclosure, various changes, substitutions, additions, omissions, and so on, can be carried out within the scope of the Claims or its equivalents.

INDUSTRIAL APPLICABILITY

The present invention provides an image display apparatus which includes a gate driver integrated circuit that is highly versatile and can be used irrespective of the number of the gate signal lines to be driven at high speed and the gate signal lines to which the bilateral driving should be applied and irrespective of the arrangement of the gate signal lines, and is useful as an image display apparatus such as an active-matrix image display apparatus including a current light-emitting element.

REFERENCE SIGNS LIST

10, 110 image display apparatus

11, 111 image display panel

12(*i, j*), 112(*i, j*) pixel circuit

14, 114 first gate driving circuit

15, 115 second gate driving circuit

16 source driving circuit

21(*j*), 121(*j*) source signal line
22(*i*), 122(*i*) (first) gate signal line
23(*i*), 123(*i*), 124(*i*), 125(*i*) (second) gate signal line
28, 128 anode power line
29, 129 cathode power line
30, 60, 130 gate driver integrated circuit (gate driver IC)
32, 32*a*, 32*b*, 32A, 32B, 62A, 62B, 132A, 132B, 132C, 132D gate signal line driving unit
36A, 36B, 66A, 136A, 136B, 136C, 136D shift register unit
38A, 38B, 68A, 138A voltage outputting unit
42, 72 D-type flip-flop
70, 71, 73 selector
44, 74 AND gate
45 selecting circuit
46 transistor control unit
47, 48, 49, Q22, Q23, Q122, Q123, Q124, Q125 transistor
51 delay unit
52, 53 logic gate
57, 58, 59 level shift unit
191, 221 COF
222 display screen
223 source printed circuit board
224 gate printed circuit board
226 source driver IC
241*a*, 241*b*, 241*c*, 241*d*, 241*e* COF line
243*a*, 243*b* driver input terminal
243*c* operating terminal
244*a*, 244*b*, 244*c* connecting terminal
245 output terminal
246 driver output terminal
247 operating terminal
361, 361*a*, 361*b* switching circuit
491 image display apparatus
492 support column
493 holding base
501 shutter
502 viewfinder
503 cursor
511 keyboard
512 touch-pad
C20, C120 capacitor
D20, D120 EL element
Q20, Q120 driving transistor
CkA, CkB, CkC, CkD clock input terminal
DinA, DinB, DinC, DinD data input terminal
EneA, EneB, EneC, EneD enable input terminal
Din/out, Dout/in data input and output terminal
DoutA, DoutB, DoutC, DoutD data output terminal
OutA1, OutA2, OutA3, OutAi, OutB1, OutB2, OutB3, OutBi, OutC1, OutC2, OutC3, OutCi, OutD1, OutD2, OutD3, OutDi, OutA64, OutB64, OutC64, OutD64 output terminal
VonA, VonB, VonC, VonD, VoffA, VoffB, VoffC, VoffD, VovdA, VovdB, VovdC, VovdD, power supply terminal
Ti initialization period
To detecting period
Tw, Tw1, Tw2, Twi writing period
Td, Td1, Td2, Tdi display period
CK1, CK2, CK3 clock
DI1, DI2, DI3, DI4, DI5 signal
EN1, EN2, EN3, EN4, EN5 enable signal
Vdd, Vos, Vsg, Vss, Vini, Vref, V22off, V22on, V22*ovd*, V23off, V23on, V122off, V122on, V122*ovd*, V123off, V123on, V124off, V124on, V125off, V125on voltage
V22*ovd*, V122*ovd* over-drive voltage
Vos offset voltage
Vsg image signal voltage
CNT22, CNT122 write controlling signal
CNT23, CNT123 display controlling signal
CNT124, CNT125 control signal

The invention claimed is:

1. An image display apparatus comprising:
a display screen which includes pixels arranged in a matrix, each of the pixels including a light-emitting element, a first switching transistor, a second switching transistor, and a driving transistor that supplies a current to the light-emitting element;
a first gate signal line disposed for each of rows of the pixels and connected to the first switching transistor;
a second gate signal line disposed for each of the rows of the pixels and connected to the second switching transistor;
a source signal line disposed for each of columns of the pixels;
a first gate driver circuit which applies a control voltage to the first gate signal line and the second gate signal line;
a second gate driver circuit which applies a control voltage to the first gate signal line; and
a source driver circuit which supplies a video signal to the source signal line,
wherein the first gate driver circuit and the second gate driver circuit each have
a first mode in which a first control voltage is supplied to one of the first gate signal line and the second gate signal line, the first control voltage being one of an ON voltage, a first OFF voltage, and a second OFF voltage, and
a second mode in which a second control voltage is supplied to at least one of the first gate signal line and the second gate signal line, the second control voltage being one of the ON voltage and the first OFF voltage.

2. The image display apparatus according to claim 1,
wherein a gate driver circuit including the first gate driver circuit and the second gate driver circuit includes:
a first shift register circuit which specifies, to the first gate signal line, a position at which the ON voltage is applied; and
a second shift register circuit which specifies, to the second gate signal line, a position at which the ON voltage is applied.

3. The image display apparatus according to claim 1,
wherein a time period for applying the second OFF voltage is a time period during which one pixel row is selected.

4. The image display apparatus according to claim 1,
wherein a control terminal disposed in a gate driver circuit including the first gate driver circuit and the second gate driver circuit selects between the first control voltage and the second control voltage.

5. The image display apparatus according to claim 1,
wherein a gate driver circuit including the first gate driver circuit and the second gate driver circuit includes a plurality of shift register circuits, and
the plurality of shift register circuits are each operated by an independent clock.

6. The image display apparatus according to claim 1,
wherein the first gate driver circuit and the second gate driver circuit each include a first shift register circuit and a second shift register circuit,
the first shift register circuit of the first gate driver circuit is connected to the first gate signal line disposed for a first pixel, the second shift register circuit of the first gate driver circuit is connected to the second gate signal line disposed for the first pixel, the first shift register circuit of the second gate driver circuit is connected to the first gate signal line disposed for the first pixel, and the second shift register circuit of the second gate driver circuit is connected to the first gate signal line disposed for a second pixel.

7. An image display apparatus comprising:

a display screen which includes pixels arranged in a matrix, each of the pixels including a light-emitting element, a first switching transistor, a second switching transistor, and a driving transistor that supplies a current to the light-emitting element;

a first gate signal line disposed for each of rows of the pixels and connected to the first switching transistor;

a second gate signal line disposed for each of the rows of the pixels and connected to the second switching transistor;

a source signal line disposed for each of columns of the pixels;

a gate driver circuit which applies a control voltage to the first gate signal line and the second gate signal line; and a source driver circuit which supplies a video signal to the source signal line, wherein the gate driver circuit sequentially supplies a first control voltage to the first gate signal line, the first control voltage being one of an ON voltage, a first OFF voltage, and a second OFF voltage, and the gate driver circuit sequentially supplies a second control voltage to the second gate signal line, the second control voltage being one of the ON voltage and the first OFF voltage.

8. The image display apparatus according to claim 7, wherein the first switching transistor applies, to the pixels, a video signal applied to the source signal line.

9. The image display apparatus according to claim 7, wherein the gate driver circuit includes:

a first shift register circuit which specifies, to the first gate signal line, a position at which the ON voltage is applied; and a second shift register circuit which specifies, to the second gate signal line, a position at which the ON voltage is applied.

10. The image display apparatus according to claim 7, wherein a time period for applying the second OFF voltage is a time period during which one pixel row is selected.

11. The image display apparatus according to claim 7, wherein a control terminal disposed in the gate driver circuit selects between the first control voltage and the second control voltage.

12. The image display apparatus according to claim 7, wherein the first gate signal line is connected to the gate driver circuit at both ends of the first gate signal line, and the second gate signal line is connected to the gate driver circuit at one end of the second gate signal line.

13. A gate driver integrated circuit for use in an image display apparatus, the gate driver integrated circuit comprising:

a plurality of gate signal line driving circuits each having a shift register circuit and an output circuit;

an ON voltage input terminal to which an ON voltage is applied;

a first OFF voltage input terminal to which a first OFF voltage is applied;

a second OFF voltage input terminal to which a second OFF voltage is applied; and an operation mode setting terminal, wherein the gate driver integrated circuit has:

a first operation mode in which a scanning signal including the ON voltage and the first OFF voltage is supplied; and a second operation mode in which a scanning signal including the ON voltage, the first OFF voltage, and the second OFF voltage is supplied, and selects one of the first operation mode and the second operation mode based on a signal applied to the operation mode setting terminal.

14. The gate driver integrated circuit according to claim 13, wherein the operation mode setting terminal is provided for each of the plurality of the gate signal line driving circuits.

15. The gate driver integrated circuit according to claim 13, wherein the ON voltage input terminal is provided for each of the plurality of the gate signal line driving circuits, and the second OFF voltage input terminal is provided in common for the plurality of the gate signal line driving circuits.

16. An image display apparatus comprising:

a display screen which includes pixels arranged in a matrix, each of the pixels including a light-emitting element, a first switching transistor, a second switching transistor, and a driving transistor that supplies a current to the light-emitting element;

a first gate signal line disposed for each of rows of the pixels and connected to the first switching transistor;

a second gate signal line disposed for each of the rows of the pixels and connected to the second switching transistor;

a source signal line disposed for each of columns of the pixels;

a gate driver circuit which applies a control voltage to the first gate signal line and the second gate signal line; and a source driver circuit which supplies a video signal to the source signal line, wherein the gate driver circuit supplies a first control voltage to the first gate signal line, and supplies a second control voltage to the second gate signal line, the first control voltage being one of an ON voltage, a first OFF voltage, and a second OFF voltage, the second control voltage being one of the ON voltage and the first OFF voltage.

17. The image display apparatus according to claim 16, wherein the gate driver circuit includes:

a first shift register circuit which specifies, to the first gate signal line, a position at which the ON voltage is applied; and a second shift register circuit which specifies, to the second gate signal line, a position at which the ON voltage is applied.

18. The image display apparatus according to claim 16, wherein a time period for applying the second OFF voltage is a time period during which one pixel row is selected.

19. The image display apparatus according to claim 16, wherein a control terminal disposed in the gate driver circuit selects between the first control voltage and the second control voltage.

20. The image display apparatus according to claim 16, wherein the first gate signal line is connected to the gate driver circuit at both ends of the first gate signal line, and the second gate signal line is connected to the gate driver circuit at one end of the second gate signal line.

* * * * *